US008881651B2

(12) United States Patent
De Joseph et al.

(10) Patent No.: US 8,881,651 B2
(45) **Date of Patent: *Nov. 11, 2014**

(54) PRINTING SYSTEM, PRODUCTION SYSTEM AND METHOD, AND PRODUCTION APPARATUS

(75) Inventors: Anthony B. De Joseph, East Amherst, NY (US); Theodore F. Cymam, Jr., Grand Island, NY (US); Kevin J. Hook, Grand Island, NY (US); Anthony V. Moscato, North Tonawanda, NY (US); Henderikus A. Haan, North Tonawanda, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 24 days.

This patent is subject to a terminal disclaimer.

(21) Appl. No.: 13/099,078

(22) Filed: May 2, 2011

(65) Prior Publication Data

US 2011/0249047 A1 Oct. 13, 2011

Related U.S. Application Data

(63) Continuation of application No. 12/229,129, filed on Aug. 20, 2008, which is a continuation-in-part of (Continued)

(51) Int. Cl.
*B41F 1/18* (2006.01)
*B41M 1/06* (2006.01)

(52) U.S. Cl.
CPC ..... *B41M 1/06* (2013.01)
USPC ..... 101/451; 101/417; 101/453; 101/465

(58) Field of Classification Search
CPC ..... B41F 19/007
USPC ..... 347/103; 101/130, 147, 450.1, 451, 101/453, 463.1, 465, 466
See application file for complete search history.

(56) References Cited

U.S. PATENT DOCUMENTS 778,892 A 1/1905 Read
1,766,957 A 6/1930 Smith (Continued)

FOREIGN PATENT DOCUMENTS

CA 2 392 730 10/2003
CN 1383992 12/2002

(Continued)

OTHER PUBLICATIONS

Letter dated Nov. 2, 2011 to Arochi, Marroquin & Lindner, S.C.

(Continued)

*Primary Examiner* — Judy Nguyen
*Assistant Examiner* — Blake A Tankersley
(74) *Attorney, Agent, or Firm* — McCracken Frey & Gillen LLC

(57) ABSTRACT

A printing system deposits a principal substance on a surface and further deposits a gating agent on selectable portions of a print medium. A portion of the principal substance is transferred from the surface to the print medium after the gating agent is applied thereto. The gating agent substantially determines where the principal substance is deposited onto the print medium. A production system and method are also disclosed, as is a production apparatus.

60 Claims, 20 Drawing Sheets

Related U.S. Application Data application No. 11/709,497, filed on Feb. 21, 2007, and a continuation-in-part of application No. 11/709,428, filed on Feb. 21, 2007, now Pat. No. 8,011,300, and a continuation-in-part of application No. 11/709,599, filed on Feb. 21, 2007, and a continuation-in-part of application No. 11/709,429, filed on Feb. 21, 2007, now Pat. No. 8,061,270, and a continuation-in-part of application No. 11/709,555, filed on Feb. 21, 2007, now abandoned, and a continuation-in-part of application No. 11/709,396, filed on Feb. 21, 2007, now Pat. No. 8,833,257.

(60) Provisional application No. 60/775,551, filed on Feb. 22, 2006, provisional application No. 60/819,301, filed on Jul. 7, 2006, provisional application No. 60/775,511, filed on Feb. 21, 2006.

(56) References Cited

U.S. PATENT DOCUMENTS

| | | | | | |
|---|---|---|---|---|---|
| 2,562,782 | A | | 7/1951 | Frost | |
| 3,574,297 | A | * | 4/1971 | Bozer | 101/451 |
| 3,589,289 | A | | 6/1971 | Gosnell | |
| 3,741,118 | A | | 6/1973 | Carley | |
| 3,790,703 | A | | 2/1974 | Carley | |
| 3,800,699 | A | | 4/1974 | Carley | |
| 3,869,986 | A | * | 3/1975 | Hubbard | 101/91 |
| 3,986,452 | A | | 10/1976 | Dahlgren | |
| 4,010,686 | A | | 3/1977 | Harris | |
| 4,069,759 | A | | 1/1978 | Endo et al. | |
| 4,368,669 | A | | 1/1983 | Love, III | |
| 4,404,907 | A | | 9/1983 | Köbler et al. | |
| 4,718,340 | A | * | 1/1988 | Love, III | 101/116 |
| 4,729,310 | A | | 3/1988 | Love, III | |
| 4,808,443 | A | | 2/1989 | Minamoto et al. | |
| 4,833,486 | A | | 5/1989 | Zerillo | |
| 4,833,530 | A | | 5/1989 | Kohashi | |
| 5,106,414 | A | | 4/1992 | Kunichika et al. | |
| 5,129,321 | A | | 7/1992 | Fadner | |
| 5,188,033 | A | | 2/1993 | Fadner | |
| 5,202,206 | A | | 4/1993 | Tam | |
| 5,221,330 | A | | 6/1993 | Matsumoto et al. | |
| 5,294,946 | A | | 3/1994 | Gandy et al. | |
| 5,312,654 | A | | 5/1994 | Arimatsu et al. | |
| 5,333,548 | A | | 8/1994 | Fadner | |
| 5,366,000 | A | | 11/1994 | Reimann et al. | |
| 5,389,958 | A | | 2/1995 | Bui et al. | |
| 5,462,591 | A | | 10/1995 | Karandikar et al. | |
| 5,476,043 | A | | 12/1995 | Okuda et al. | |
| 5,495,803 | A | | 3/1996 | Gerber et al. | |
| 5,501,150 | A | | 3/1996 | Leenders et al. | |
| 5,505,126 | A | * | 4/1996 | Ohno et al. | 101/147 |
| 5,511,477 | A | | 4/1996 | Adler et al. | |
| 5,552,817 | A | | 9/1996 | Kuehnle | |
| 5,554,212 | A | | 9/1996 | Bui et al. | |
| 5,560,608 | A | | 10/1996 | Silverschotz | |
| 5,644,981 | A | | 7/1997 | Ohno et al. | |
| 5,681,065 | A | | 10/1997 | Rua, Jr. et al. | |
| 5,697,297 | A | | 12/1997 | Rasmussen | |
| 5,738,013 | A | | 4/1998 | Kellett | |
| 5,765,083 | A | | 6/1998 | Shinohara | |
| 5,809,893 | A | | 9/1998 | Gamperling et al. | |
| 5,820,932 | A | | 10/1998 | Hallman et al. | |
| 5,826,507 | A | * | 10/1998 | Lim | 101/350.1 |
| 5,852,975 | A | | 12/1998 | Miyabe et al. | |
| 5,906,156 | A | | 5/1999 | Shibuya et al. | |
| 5,953,988 | A | | 9/1999 | Vinck | |
| 5,966,154 | A | | 10/1999 | DeBoer | |
| 5,969,740 | A | | 10/1999 | Maeda et al. | |
| 6,002,904 | A | | 12/1999 | Yoshida et al. | |
| 6,006,666 | A | | 12/1999 | Gottling | |
| 6,050,193 | A | | 4/2000 | DeBoer et al. | |
| 6,079,331 | A | | 6/2000 | Koguchi et al. | |
| 6,079,806 | A | | 6/2000 | Koguchi et al. | |
| 6,082,263 | A | | 7/2000 | Koguchi et al. | |
| 6,113,231 | A | | 9/2000 | Burr et al. | |
| 6,120,665 | A | | 9/2000 | Chiang et al. | |
| 6,125,750 | A | | 10/2000 | Achelpohl | |
| 6,125,755 | A | | 10/2000 | Link et al. | |
| 6,126,281 | A | | 10/2000 | Shimoda et al. | |
| 6,131,514 | A | | 10/2000 | Simons | |
| 6,152,037 | A | * | 11/2000 | Ishii et al. | 101/466 |
| 6,164,757 | A | | 12/2000 | Wen et al. | |
| 6,173,647 | B1 | | 1/2001 | Kakuta et al. | |
| 6,187,380 | B1 | | 2/2001 | Hallman et al. | |
| 6,196,129 | B1 | | 3/2001 | Kellett | |
| 6,231,177 | B1 | | 5/2001 | Cherukuri et al. | |
| 6,283,031 | B1 | | 9/2001 | Kakuta et al. | |
| 6,283,589 | B1 | | 9/2001 | Gelbart | |
| 6,295,928 | B1 | | 10/2001 | Heinzl et al. | |
| 6,298,780 | B1 | | 10/2001 | Ben-Horin et al. | |
| 6,315,916 | B1 | | 11/2001 | Deutsch et al. | |
| 6,318,264 | B1 | | 11/2001 | D'Heureuse et al. | |
| 6,341,559 | B1 | | 1/2002 | Riepenhoff et al. | |
| 6,354,207 | B1 | | 3/2002 | Maekawa et al. | |
| 6,367,380 | B1 | | 4/2002 | Whelan | |
| 6,386,696 | B1 | | 5/2002 | Rodi et al. | |
| 6,393,980 | B2 | | 5/2002 | Simons | |
| 6,402,317 | B2 | | 6/2002 | Yanagawa et al. | |
| 6,416,175 | B2 | | 7/2002 | Furukawa et al. | |
| 6,422,696 | B1 | | 7/2002 | Takahashi et al. | |
| 6,439,713 | B1 | | 8/2002 | Noguchi et al. | |
| 6,470,799 | B2 | | 10/2002 | Nakazawa et al. | |
| 6,477,948 | B1 | | 11/2002 | Nissing et al. | |
| 6,520,087 | B2 | * | 2/2003 | Heinzl et al. | 101/465 |
| 6,526,886 | B2 | | 3/2003 | Loccufier et al. | |
| 6,536,873 | B1 | | 3/2003 | Lee et al. | |
| 6,539,856 | B2 | | 4/2003 | Jones et al. | |
| 6,543,360 | B2 | | 4/2003 | Sasaki et al. | |
| 6,558,458 | B1 | | 5/2003 | Gloster | |
| 6,566,039 | B1 | | 5/2003 | Teng | |
| 6,585,367 | B2 | | 7/2003 | Gore | |
| 6,595,631 | B2 | | 7/2003 | Tanikawa et al. | |
| 6,634,295 | B1 | | 10/2003 | Newington et al. | |
| 6,644,183 | B2 | | 11/2003 | Takasawa et al. | |
| 6,648,468 | B2 | | 11/2003 | Shinkoda et al. | |
| 6,652,631 | B2 | | 11/2003 | Itakura | |
| 6,662,723 | B2 | | 12/2003 | Loccufier et al. | |
| 6,679,170 | B2 | | 1/2004 | Mori | |
| 6,699,640 | B2 | | 3/2004 | Verschueren et al. | |
| 6,736,500 | B2 | | 5/2004 | Takahashi et al. | |
| 6,739,260 | B2 | | 5/2004 | Damme et al. | |
| 6,745,693 | B2 | | 6/2004 | Teng | |
| 6,758,140 | B1 | | 7/2004 | Szumia et al. | |
| 6,772,687 | B2 | | 8/2004 | Damme et al. | |
| 6,779,444 | B2 | | 8/2004 | Hauptmann et al. | |
| 6,780,305 | B2 | | 8/2004 | Nishino et al. | |
| 6,783,228 | B2 | | 8/2004 | Szumia et al. | |
| 6,815,075 | B2 | | 11/2004 | Kasai et al. | |
| 6,851,363 | B2 | | 2/2005 | Schneider | |
| 6,851,366 | B2 | | 2/2005 | Gutfleisch et al. | |
| 6,852,363 | B2 | | 2/2005 | Loccufier et al. | |
| 6,862,992 | B2 | | 3/2005 | Nakazawa et al. | |
| 6,906,019 | B2 | | 6/2005 | Nitzan et al. | |
| 6,918,663 | B2 | | 7/2005 | Schaschek et al. | |
| 6,935,735 | B2 | | 8/2005 | Tanikawa et al. | |
| 6,983,693 | B2 | | 1/2006 | Simons | |
| 7,070,269 | B2 | | 7/2006 | Tanikawa et al. | |
| 7,191,703 | B2 | | 3/2007 | Dilling | |
| 7,191,705 | B2 | | 3/2007 | Berg et al. | |
| 7,240,998 | B2 | | 7/2007 | Murakami et al. | |
| 7,281,790 | B2 | | 10/2007 | Mouri et al. | |
| 7,311,396 | B2 | | 12/2007 | Kwon et al. | |
| 7,523,704 | B2 | | 4/2009 | Domotor | |
| 7,691,280 | B2 | | 4/2010 | Waldrop et al. | |
| 7,959,278 | B2 | | 6/2011 | Regan et al. | |
| 2001/0020964 | A1 | | 9/2001 | Irihara et al. | |
| 2001/0022596 | A1 | | 9/2001 | Korol | |
| 2001/0040615 | A1 | | 11/2001 | Beauchamp et al. | |
| 2001/0042460 | A1 | | 11/2001 | Yoshida | |

(56) References Cited

U.S. PATENT DOCUMENTS

| | | | | |
|---|---|---|---|---|
| 2001/0047561 | A1* | 12/2001 | Hara et al. | 15/256.51 |
| 2002/0001004 | A1 | 1/2002 | Mantell et al. | |
| 2002/0014169 | A1 | 2/2002 | Siler et al. | |
| 2002/0017209 | A1 | 2/2002 | Gutfleisch et al. | |
| 2002/0038611 | A1 | 4/2002 | Naniwa et al. | |
| 2002/0043171 | A1 | 4/2002 | Loccufier et al. | |
| 2002/0056388 | A1 | 5/2002 | Makino | |
| 2002/0100383 | A1* | 8/2002 | McPherson et al. | 101/451 |
| 2002/0104455 | A1 | 8/2002 | Deutsch et al. | |
| 2002/0139268 | A1 | 10/2002 | Emery et al. | |
| 2002/0154188 | A1 | 10/2002 | Hiyane et al. | |
| 2002/0170452 | A1* | 11/2002 | Heinzl et al. | 101/463.1 |
| 2003/0047272 | A1* | 3/2003 | Tanikawa et al. | 156/235 |
| 2003/0089261 | A1 | 5/2003 | Landsman | |
| 2003/0103093 | A1 | 6/2003 | Vanhooydonck | |
| 2003/0128249 | A1 | 7/2003 | Booth | |
| 2003/0128250 | A1 | 7/2003 | Booth | |
| 2003/0153649 | A1 | 8/2003 | Bromberg | |
| 2003/0159607 | A1 | 8/2003 | Nitzan et al. | |
| 2003/0210298 | A1 | 11/2003 | Madeley | |
| 2003/0210314 | A1 | 11/2003 | Palmer et al. | |
| 2004/0053011 | A1 | 3/2004 | Behm et al. | |
| 2004/0085395 | A1 | 5/2004 | Madeley | |
| 2004/0089179 | A1 | 5/2004 | Link | |
| 2004/0090508 | A1 | 5/2004 | Chowdry et al. | |
| 2004/0090516 | A1 | 5/2004 | Gruetzmacher et al. | |
| 2004/0103801 | A1 | 6/2004 | Miller et al. | |
| 2004/0103803 | A1 | 6/2004 | Price et al. | |
| 2004/0106696 | A1 | 6/2004 | Ma et al. | |
| 2004/0109055 | A1 | 6/2004 | Pan et al. | |
| 2004/0129158 | A1 | 7/2004 | Figov et al. | |
| 2004/0135276 | A1 | 7/2004 | Nielsen et al. | |
| 2004/0154489 | A1 | 8/2004 | Deutsch et al. | |
| 2004/0177784 | A1 | 9/2004 | Yamamoto et al. | |
| 2004/0182270 | A1 | 9/2004 | Wiedemer et al. | |
| 2004/0187720 | A1 | 9/2004 | Naniwa et al. | |
| 2004/0250836 | A1 | 12/2004 | Koppelkamm et al. | |
| 2005/0028696 | A1 | 2/2005 | Price et al. | |
| 2005/0056169 | A1 | 3/2005 | Hashimoto et al. | |
| 2005/0115429 | A1* | 6/2005 | Link | 101/463.1 |
| 2005/0122355 | A1 | 6/2005 | Kanda et al. | |
| 2005/0181187 | A1 | 8/2005 | Vosseler et al. | |
| 2005/0204945 | A1 | 9/2005 | Sonokawa | |
| 2005/0211130 | A1 | 9/2005 | Watanabe | |
| 2005/0223927 | A1 | 10/2005 | Wiedemer | |
| 2005/0270351 | A1 | 12/2005 | Mouri et al. | |
| 2006/0011817 | A1* | 1/2006 | Harush et al. | 250/221 |
| 2006/0040210 | A1 | 2/2006 | Eck et al. | |
| 2006/0066704 | A1 | 3/2006 | Nishida | |
| 2006/0075916 | A1 | 4/2006 | Edwards et al. | |
| 2006/0075917 | A1 | 4/2006 | Edwards | |
| 2006/0077243 | A1 | 4/2006 | Edwards | |
| 2006/0077244 | A1 | 4/2006 | Edwards | |
| 2006/0132566 | A1 | 6/2006 | Desie et al. | |
| 2006/0201361 | A1 | 9/2006 | Wiedemer | |
| 2006/0284951 | A1 | 12/2006 | Ikeda et al. | |
| 2007/0062389 | A1* | 3/2007 | Link | 101/211 |
| 2007/0068404 | A1 | 3/2007 | Hirahara et al. | |
| 2007/0137509 | A1 | 6/2007 | Fork | |
| 2007/0164559 | A1 | 7/2007 | Kozdras | |
| 2007/0199457 | A1 | 8/2007 | Cyman et al. | |
| 2007/0199458 | A1 | 8/2007 | Cyman et al. | |
| 2007/0199459 | A1 | 8/2007 | Cyman et al. | |
| 2007/0199460 | A1 | 8/2007 | Cyman, Jr. et al. | |
| 2007/0199461 | A1 | 8/2007 | Cyman et al. | |
| 2007/0199462 | A1 | 8/2007 | Cyman et al. | |
| 2007/0199469 | A1 | 8/2007 | Zahn | |
| 2007/0200794 | A1 | 8/2007 | Mueller et al. | |
| 2007/0204755 | A1 | 9/2007 | Moreau | |
| 2007/0227383 | A1 | 10/2007 | Decre et al. | |
| 2007/0240593 | A1* | 10/2007 | Schneider et al. | 101/228 |
| 2008/0271627 | A1 | 11/2008 | Teng | |
| 2009/0056577 | A1 | 3/2009 | Hook et al. | |
| 2009/0056578 | A1 | 3/2009 | DeJoseph et al. | |
| 2009/0064884 | A1 | 3/2009 | Hook et al. | |
| 2009/0064886 | A1 | 3/2009 | Hook et al. | |
| 2009/0213201 | A1 | 8/2009 | Numata et al. | |

FOREIGN PATENT DOCUMENTS

| | | |
|---|---|---|
| DE | 4327212 A1 | 2/1995 |
| DE | 10245066 | 4/2003 |
| EP | 101 266 | 2/1984 |
| EP | 0126479 | 11/1984 |
| EP | 0588399 | 3/1994 |
| EP | 0590164 | 4/1994 |
| EP | 0601531 | 6/1994 |
| EP | 0646458 | 4/1995 |
| EP | 0965444 | 6/1998 |
| EP | 0882584 | 12/1998 |
| EP | 0883026 | 12/1998 |
| EP | 0911154 | 4/1999 |
| EP | 0911155 | 4/1999 |
| EP | 0936064 | 8/1999 |
| EP | 1 118 470 | 7/2001 |
| EP | 1 118 471 | 7/2001 |
| EP | 1 118 472 | 7/2001 |
| EP | 1170122 | 1/2002 |
| EP | 1177514 | 2/2002 |
| EP | 1177914 | 2/2002 |
| EP | 1 426 193 | 6/2004 |
| EP | 1 522 404 | 4/2005 |
| EP | 1 547 793 | 6/2005 |
| JP | 53015905 | 2/1978 |
| JP | 56105960 | 8/1981 |
| JP | 56-113456 | 9/1981 |
| JP | 58-217567 | 12/1983 |
| JP | 62-025081 | 2/1987 |
| JP | 63-109052 | 5/1988 |
| JP | 63-125534 | 8/1988 |
| JP | 2-98482 | 4/1990 |
| JP | 02-098482 | 4/1990 |
| JP | 02-269094 | 11/1990 |
| JP | 4-69244 | 3/1992 |
| JP | 4-97236 | 3/1992 |
| JP | 4-97848 | 3/1992 |
| JP | 06-206297 | 7/1994 |
| JP | 62-25081 | 8/1994 |
| JP | 6-270380 | 9/1994 |
| JP | 8-310101 | 11/1996 |
| JP | 08-310151 | 11/1996 |
| JP | 9-85929 | 3/1997 |
| JP | 09-267549 | 10/1997 |
| JP | 10-235989 | 9/1998 |
| JP | 10-286939 | 10/1998 |
| JP | 2946201 | 10/1998 |
| JP | 11-302585 | 11/1999 |
| JP | 11-320865 | 11/1999 |
| JP | 2002-536462 | 8/2000 |
| JP | 2000-272261 | 10/2000 |
| JP | 2001-212956 | 8/2001 |
| JP | 2001-225437 | 8/2001 |
| JP | 2002-127354 | 5/2002 |
| JP | 2002-326455 | 11/2002 |
| JP | 2002-361833 | 12/2002 |
| JP | 2003-25554 | 1/2003 |
| JP | 2003-080664 | 3/2003 |
| JP | 2003-80816 | 3/2003 |
| JP | 2003-237220 | 8/2003 |
| JP | 2004-050575 | 2/2004 |
| JP | 2004-66816 | 3/2004 |
| JP | 2004-98682 | 4/2004 |
| JP | 2004-181955 | 7/2004 |
| JP | 2004-299167 | 10/2004 |
| JP | 2005-059458 | 3/2005 |
| JP | 2005-074693 | 3/2005 |
| JP | 3756943 | 3/2005 |
| JP | 2005-313490 | 11/2005 |
| WO | WO 94/11191 | 5/1994 |
| WO | WO 99/17938 | 4/1999 |
| WO | WO 01/34394 | 5/2001 |
| WO | WO 01/49506 | 7/2001 |
| WO | WO 01/54915 | 8/2001 |

(56) References Cited

FOREIGN PATENT DOCUMENTS

| | | | |
|---|---|---|---|
| WO | WO 2004/039586 | 5/2004 | |
| WO | WO 2005068197 A1 * | 7/2005 | ..... B41F 13/46 |
| WO | WO 2007/071551 | 6/2007 | |

OTHER PUBLICATIONS

Letter dated Nov. 9, 2011 from Arochi, Marroquin & Lindner, S.C.
Int'l. Search Report and Written Opinion dated Dec. 2, 2011 for International Application No. PCT/US2011/051975.
Second Office Action dated Apr. 6, 2011, with English translation attached, Chinese Patent Application No. 200780006171.3, Applicant Moore Wallace North America, Inc.
Letter to Mr. Qi Xue dated May 12, 2011, with claim amendments attached, Chinese Patent Application No. 200780006171.3, Applicant Moore Wallace North America, Inc.
Letter from Mr. Qi Xue dated Jun. 8, 2011, Chinese Patent Application No. 200780006171.3, Applicant Moore Wallace North America, Inc.
English translation of Office Action dated Aug. 30, 2011, Mexican Patent Application File No. MX/a/2010/001992, Applicant Moore Wallace North America, Inc.
International Preliminary Report on Patentability dated Sep. 4, 2008, International Application No. PCT/US2007/004437 International filing date Feb. 21, 2007.
International Preliminary Report on Patentability dated Sep. 4, 2008, International Application No. PCT/US2007/004441 International filing date Feb. 21, 2007.
International Preliminary Report on Patentability dated Sep. 4, 2008, International Application No. PCT/US2007/004440 International filing date Feb. 21, 2007.
International Preliminary Report on Patentability dated Sep. 4, 2008, International Application No. PCT/US2007/004438 International filing date Feb. 21, 2007.
International Preliminary Report on Patentability dated Sep. 4, 2008, International Application No. PCT/US2007/004444 International filing date Feb. 21, 2007.
International Preliminary Report on Patentability dated Sep. 4, 2008, International Application No. PCT/US2007/004442 International filing date Feb. 21, 2007.
International Search Report and Written Opinion in PCT/US2008/009910 dated Jan. 20, 2009.
Search Report in EP 08 00 6593 dated Jan. 12, 2009.
Search Report in EP 08 00 6594 dated Jan. 12, 2009.
Gloster et al., Abstract of "Direct Computer to Plate Printing," *Society for Imaging Science and Technology*, Oct. 2001, 1 page.
Nobuhiro et al., Abstract of "Application of Solid Ink Jet Technology to a Direct Plate Maker," *Science Links* Japan, 1999, 1 page.
Katherine O'Brien, "CTP in Small Packages," *American Printer*, Sep. 1, 1998, 4 pages.
U.S. Appl. No. 60/775,511, Inventors Cyman, Jr. et al., filed Feb. 21, 2006.
U.S. Appl. No. 60/819,301, Inventors Cyman, Jr. et al., filed Jul. 7, 2006.
Letter to EPO dated Nov. 30, 2010, with attachments, EP Application No. 07-751-214.3, Applicant Moore Wallace North America, Inc.
Letter to EPO dated Dec. 7, 2010, with attachments, EP Application No. 08-006-593.1, Applicant Moore Wallace North America, Inc.
European Patent Office Search Report & Written Opinion, EP 11 17 1598 dated Jun. 9, 2011.
3rd Supplemental Information Disclosure Statement & Interview Summary dated, Apr. 28, 2010 for U.S. Appl. No. 11/709,396.
International Preliminary Report on Patentability and Written Opinion for PCT/US2008/009893, dated Mar. 4, 2010.
Response letter to EPO for Appl. No. 08-006-593.1-1251, dated Feb. 8, 2010, and attached amendments.
Lamont Wood, 3-D Home Printers Could Change Economy Oct. 11, 2007, URL: http://www/msnbc.msn.com/id/21252137/, (2 pages).
W. Shen et al., "A New Understanding on the Mechanism of Fountain Solution in the Prevention of Ink Transfer to the Non-image Area in Conventional Offset Lithography", J. Adhesion Sci. Technol., vol. 18, No. 15-16, pp. 1861-1887, (2004), (27 pages).
Air Products, Surfynol® 400 Series Surfactants, (3 pages).
"Amine Ethoxylates," (Jun. 26, 2008), URL: http://www.huntsman.com/performance_products/Index.cfm? PageID=5723 &PrintPage=1&Showtitle=1, (1 page).
"Effect of Polyether Monoamine Structure on Pigment Dispersant Properties," (Feb. 2, 2009), Paint & Coatings Industry, (Mar. 1, 2006), URL: http://www.accessmylibrary.com/comsite5/bin/aml_landing_tt.pl?purchase_type=ITM & item . . . , (5 pages).
R. Steitz et al., "Experimental Report: Does the Chemical Nature of the Substrate Trigger Net Adsorption of Pluronic F127?", BENSC, (Jan. 15, 2003), (1 page).
BASF,Key Features & Benefits, Joncryl® 50, (2 pages); Joncryl® 52 (2 pages); Joncryl® 60 (2 pages); Joncryl® 61 (2 pages); Joncryl® 678 (3 pages); Joncryl® 682 (3 pages), (Mar. 23, 2007).
Polyethylenimines (General Information), (3 pages).
Nissan Chemical—Colloidal Silica, "Snowtex®", URL: http://www.nissanchem-usa.com/snowtex.php, (Jun. 26, 2008), (8 pages).
BASF Corporation 1999, Table of Contents, (37 pages).
BASF Corporation 2002 Technical Bulletin, "Pluronic® F127 Block Copolymer Surfactant", (1 page).
Huntsman Corporation 2005 Technical Bulletin, "Surfonic® T-2 Surfactant", (2 pages).
Huntsman Corporation 2007 Technical Bulletin, "The Use of Surfonamine® Amines in Ink and Pigment Applications", (5 pages).
"Amendment of the Claims" for PCT/US2008/009893 dated Mar. 20, 2009.
"Amendment of the Claims" for PCT/US2008/009910 dated Mar. 19, 2009.
EPO Office Action for Appl. No. 077-751-211.9-1251, dated Sep. 22, 2009, and attached Jul. 1, 2009 letter to EPO and amendments.
Response letter to EPO for Appl. No. 077-751-211.9-1251, dated Jan. 29, 2010, and attached amendments.
Epo Office Action for Appl. No. 077-751-214.3-1251, dated Aug. 3, 2009, and attached Jul. 1, 2009 letter to EPO and amendments.
Response letter to EPO for Appl. No. 077-751-214.3-1251, dated Oct. 21, 2009.
EPO Office Action for Appl. No. 077-751-214.3-1251, dated Dec. 10, 2009, and attached Jul. 1, 2009 letter to EPO and amendments.
Response letter to EPO for Appl. No. 077-751-214.3-1251, dated Mar. 31, 2010, and attached amendments.
EPO Office Action for Appl. No. 08-006-593.1-1251, dated Oct. 8, 2009.
International Search Report and Written Opinion for PCT/US2008/009893 dated Jan. 23, 2009.
Response letter to EPO for Appl. No. 08006594.9, dated Nov. 26, 2009, and attached amendments and EP search report 08006594 Jan. 12, 2009.
International Preliminary Report on Patentability and Written Opinion for PCT/US2008/009910 dated Mar. 4, 2010.
International Preliminary Report on Patentability and Written Opinion for PCT/US2008/009901 dated Mar. 4, 2010.
U.S. Appl. No. 61/254,101, Inventors DeJoseph et al., filed Oct. 22, 2009.
H. Kipphan: "Handbook of Print Media" 2001, Springer, Berlin, XP002446641, p. 52-55.
International Preliminary Report on Patentability and Written Opinion for PCT/US2008/009911 dated Mar. 4, 2010.
International Search Report and Written Opinion, International Application No. PCT/US2007/004437 dated Sep. 3, 2007.
International Search Report and Written Opinion, International Application No. PCT/US2007/004441 dated Aug. 28, 2007.
International Search Report and Written Opinion, International Application No. PCT/US2007/004440 dated Aug. 28, 2007.
International Search Report and Written Opinion, International Application No. PCT/US2007/004438 dated Aug. 28, 2007.
International Search Report and Written Opinion, International Application No. PCT/US2007/004444 dated Aug. 28, 2007.
International Search Report and Written Opinion, International Application No. PCT/US2007/004442 dated Aug. 28, 2007.
EPO Office Action dated Oct. 1, 2010, EP Application No. 08-006-593.1, Applicant Moore Wallace North America, Inc.

(56) References Cited

OTHER PUBLICATIONS

EPO Office Action dated Jul. 28, 2010, EP Application No. 07-751-214.3, Applicant Moore Wallace North America, Inc.
Letter to EPO dated Aug. 12, 2010 with attachment, EP Application No. 08-006-593.1, Applicant Moore Wallace North America, Inc.
Letter to EPO dated Jul. 19, 2010 with attachment, EP Application No. 08828001.1, Applicant Moore Wallace North America, Inc.
EPO Office Action dated Jul. 28, 2010, EP Application No. 08-006-593.1, Applicant Moore Wallace North America, Inc.
Letter from Mr. Qi Xue regarding Second Office Action from Chinese Patent Office dated Nov. 29, 2010, Chinese Patent Application No. 200780006170.9, Applicant Moore Wallace North America, Inc.
Second Office Action dated Nov. 3, 2010, with English translation attached, Chinese Patent Application No. 200780006170.9, Applicant Moore Wallace North America, Inc.
Letter to Mr. Qi Xue dated Jan. 4, 2011, Chinese Patent Application No. 200780006170.9, Applicant Moore Wallace North America, Inc.
Letter from Mr. Qi Xue dated Jan. 7, 2011, Chinese Patent Application No. 200780006170.9, Applicant Moore Wallace North America, Inc.
Letter to Mr. Qi Xue dated Jan. 12, 2011 regarding Jan. 7, 2011 communication, Chinese Patent Application No. 200780006170.9, Applicant Moore Wallace North America, Inc.
Letter from Mr. Qi Xue dated Jan. 13, 2011, Chinese Patent Application No. 200780006170.9, Applicant Moore Wallace North America, Inc.
Letter to Mr. Qi Xue dated Jan. 12, 2011 regarding Jan. 12, 2011 communication, Chinese Patent Application No. 200780006170.9, Applicant Moore Wallace North America, Inc.
Letter from Mr. Qi Xue dated Jan. 18, 2011 regarding Second Office Action Response, Chinese Patent Application No. 200780006170.9, Applicant Moore Wallace North America, Inc.
Second Office Action Response dated Jan. 18, 2011, with English translation attached, Chinese Patent Application No. 200780006170.9, Applicant Moore Wallace North America, Inc.
Email to Mr. Qi Xue dated Mar. 09, 2011, with substitute Response to Second Office Action attached, Chinese Patent Application No. 200780006170.9, Applicant Moore Wallace North America, Inc.
Second email to Mr. Qi Xue dated Mar. 9, 2011, with revised substitute Response to Second Office Action attached, Chinese Patent Application No. 200780006170.9, Applicant Moore Wallace North America, Inc.
International Search Report and Written Opinion in PCT/US2010/053830 dated Dec. 27, 2010.
EPO Communication under Rule 71(3) EPC dated Jan. 10, 2011, with attached examiner's amendments, European Patent Appl. No. 07751211.9, Applicant Moore Wallace North America, Inc.
www.flickr.com, "MacWorld Magazine: Cover Art Woes", website, http://www.flickr.com/photos/66071596@N00/3964123486/ (printed on Mar. 8, 2011).
www.livedocs.adobe.com, "Fill a selection or layer with a color", website, http://livedocs.adobe.com/en_US/Photoshop/10.0/help.html?content=WSfd1234e1c4b69f30ea53e41001031ab64-77d4.html (printed on Mar. 8, 2011).
www.magazinepublisher.com, "Mailing Magazines", website, http://www.magazinepublisher.com/mailing.html (printed on Mar. 8, 2011).
www.printindustry.com, "Magazine Cover Wraps", website, http://www.printindustry.com/Newsletters/Newsletter—67.aspx (printed on Mar. 8, 2011).
www.mdprint.com, "M&D Printing Periodical Co-mailing Template Inkjet Knockout Version", available at http://www.mdprint.com/knockout%20template.pdf, (printed on Mar. 8, 2011).
www.riponprinters.com, "Designing Your Mailpiece for Inkjet Addressing", available at http://www.riponprinters.com/tech—library/pdf/M7_TLines_Design_for_Inkjet.pdf (printed on Mar. 8, 2011).
www.malanenewman.com, "Graphic Design Terminology", website, available at http://www.malanenewman.com/graphic_design_terminology.html (printed on Mar. 8, 2011).
U.S. Appl. No. 61/278,915, Inventors DeJoseph et al., filed Oct. 14, 2009.
Letter dated Apr. 4, 2012 to Mr. Fujio Sasajima regarding Japanese Patent Application No. 2008-556392 (2 pages).
Email dated Apr. 20, 2012 to Mr. Fujio Sasajima regarding Japanese Patent Application No. 2008-556392 (1 page).
Letter dated Apr. 24, 2012 from Mr. Fujio Sasajima regarding Japanese Patent Application No. 2008-556392 (1 page).
Letter dated Apr. 19, 2012 to Mr. Qi Xue regarding Chinese Patent Application No. 2008801133100.8 (3 pages).
Letter dated May 3, 2012 from Mr. Qi Xue regarding Chinese Patent Application No. 2008801133100.8 (1 page).
Response, dated Apr. 11, 2012, to European Patent Office Search Report and Written Opinion, dated Sep. 9, 2011, (3 pages), European Patent Application No. 11171598.3, Applicant Moore Wallace North America Inc.
Office Action dated Dec. 27, 2011, for JP Patent Application No. 2008-556392, with English translation attached, Applicant, Moore Wallace North America, Inc., (5 pages).
EP Search Report and English translation, dated Jan. 5, 2012, for European Patent Application No. EP 11 18 4552, Applicant, Moore Wallace North America, Inc., (7 pages).
Office Action dated Jan. 24, 2012, for JP Patent Application No. 2008-556396, with English translation attached, Applicant, Moore Wallace North America, Inc., (7 pages).
Second Office Action dated Feb. 16, 2012, for CN Patent Application No. 2008-80113100.8, Applicant, Moore Wallace North America, Inc., (6 pages).
European Patent Office Response dated Dec. 4, 2012 for European Patent Application 11171598.3, Applicant, Moore Wallace North America Inc. (4 pages).
European Patent Office Response dated Dec. 18, 2012 for European Patent Application 11171598.3, Applicant, Moore Wallace North America Inc. (2 pages).
Japanese Patent Office Action dated Oct. 23, 2010 for Japanese Patent Application 2010-521872, with English translation attached, Applicant, Moore Wallace North America Inc. (6 pages).
Japanese Patent Office Action dated Oct. 2, 2012, for Japanese Patent Application 2010-521871, with English translation attached, Applicant, Moore Wallace North America Inc; (9 pages).
English translation of Japanese Patent Application JP 4-97848, Applicant, Mitsubishi Heavy Industries KK. (9 pages).
Amendment/Instructions to Japanese associate dated Jan. 9, 2013 and confirmation of Amendment Ming filing dated Jan. 23, 2013 (9 pages).
English Translation of Office Action for Korean Application No. 10-2008-7022776 dated Apr. 26, 2013 (2 pages).
Letter to You Me Patent & Law Firm dated May 31, 2013 regarding proposed response to Office action for Korean Application No. 10-2008-7022776 (2 pages).
E-mail to You Me Patent & Law Firm dated Jun. 21, 2013 regarding proposed Response for Korean Application No. 10-2008-7022776 (2 pages).
Letter from You Me Patent & Law Firm dated Jun. 27, 2013 confirming filing of the Response to the Office action dated Apr. 26, 2013 for Korean Application No. 10-2008-7022776 (1 page).
Office Action Response and English translation of Claim amendments filed Jun. 24, 2013 for Korean Application No. 10-2008-7022776 (11 pages).

* cited by examiner

PRINTING SYSTEM, PRODUCTION SYSTEM AND METHOD, AND PRODUCTION APPARATUS

CROSS-REFERENCE TO RELATED APPLICATIONS

The present application is a continuation of U.S. patent application Ser. No. 12/229,129, which was filed on Aug. 20, 2008, which is a continuation-in-part of U.S. patent application Ser. Nos. 11/709,497, 11/709,428, 11/709,599, 11/709,429, 11/709,555, 11/709,396, all of which were filed on Feb. 21, 2007, and claims the benefit of provisional U.S. Patent Application Ser. Nos. 60/775,511 and 60/819,301 filed on Feb. 21, 2006, and Jul. 7, 2006, respectively. In addition the present application claims the benefit of provisional U.S. Patent Application Nos. 60/965,361, filed Aug. 20, 2007; 60/965,634, filed Aug. 21, 2007; 60/965,753, filed Aug. 22, 2007; 60/965,861, filed Aug. 23, 2007; 60/965,744, filed Aug. 22, 2007; and 60/965,743, filed Aug. 22, 2007. All of the above listed applications are hereby incorporated by reference herein in their entireties.

BACKGROUND

Lithographic and gravure printing techniques have been refined and improved for many years. The basic principle of lithography includes the step of transferring ink from a surface having both ink-receptive and ink-repellent areas. Offset printing incorporates an intermediate transfer of the ink. For example, an offset lithographic press may transfer ink from a plate cylinder to a rubber blanket cylinder, and then the blanket cylinder transfers the image to a surface (e.g., a paper web). In gravure printing, a cylinder with engraved ink wells makes contact with a web of paper and an electric charge may assist in the transfer of the ink onto the paper.

Early implementations of lithographic technology utilized reliefs of the image to be printed on the plate such that ink would only be received by raised areas. Modern lithographic processes take advantage of materials science principles. For example, the image to be printed may be etched onto a hydrophilic plate such that the plate is hydrophobic in the areas to be printed. The plate is wetted before inking such that oil-based ink is only received by the hydrophobic regions of the plate (i.e., the regions of the plate that were not wetted by the dampening process).

Conventionally, all of these printing techniques have a similar limitation in that the same image is printed over and over again. This is due to the fact that conventional lithographic printing uses plates wherein each plate has a static (i.e., unvarying) image, whether it be a relief image or an etched hydrophobic image, etc. Gravure printing also uses a static image which is engraved in ink wells on a cylinder. There is a substantial overhead cost involved in making the plates that are used by a lithographic press or cylinders/cylinder sleeves used by a gravure press. Therefore, it is not cost effective to print a job on a lithographic or gravure press that will have few copies produced (i.e., a short-run job). Also, conventional lithographic and gravure presses have not been used to print variable data (e.g., billing statements, financial statements, targeted advertisements, etc.) except in cases where such presses have been retrofitted with inkjet heads, albeit at high cost and slower speeds. Typically, short-run jobs and/or jobs that require variability have been typically undertaken by laser (such as electrostatic toner) and/or ink jet printers.

Traditionally, many printed articles such as books and magazines have been printed using a process that involves a great deal of post-press processing. For example, a single page or set of pages of a magazine may be printed 5,000 times. Thereafter, a second page or set of pages may be printed 5,000 times. This process is repeated for each page or set of pages of the magazine until all pages have been printed. Subsequently, the pages or sets of pages are sent to post-processing for assembly and cutting into the final articles.

This traditional workflow is time- and labor-intensive. If variable images (i.e., images that vary from page-to-page or page set-to-page set) could be printed at lithographic image quality and speed, each magazine could be printed in sequential page (or page set) order such that completed magazines would come directly off the press. This would drastically increase the speed and reduce the expenses of printing a magazine.

Ink jet printing technology provides printers with variable capability. There are several ink jet technologies including bubble jet (i.e., thermal) and piezoelectric. In each, tiny droplets of ink are fired (i.e., sprayed) onto a page. In a bubble jet printer, a heat source vaporizes ink to create a bubble. The expanding bubble causes a droplet to form, and the droplet is ejected from the print head. Piezoelectric technology uses a piezo crystal located at the back of an ink reservoir. Alternating electric potentials are used to cause vibrations in the crystal. The back and forth motion of the crystal is able to draw in enough ink for one droplet and eject that ink onto the paper.

The quality of high speed color ink jet printing is generally orders of magnitude lower than that of offset lithography and gravure. Furthermore, the speed of the fastest ink jet printer is typically much slower than a lithographic or gravure press. Traditional ink jet printing is also plagued by the effect of placing a water-based ink on paper. Using a water-based ink may saturate the paper and may lead to wrinkling and cockling of the print web, and the web may also be easily damaged by inadvertent exposure to moisture. In order to control these phenomena, ink jet printers use certain specialized papers or coatings. These papers can often be much more expensive than a traditional web paper used for commercial print.

Furthermore, when ink jet technology is used for color printing, ink coverage and water saturation may be increased. This is due to the four color process that is used to generate color images. Four color processing involves laying cyan, magenta, yellow and black (i.e., CMYK) ink in varying amounts to make a color on the page. Thus, some portions of the page may have as many as four layers of ink if all four colors are necessary to produce the desired color. Additionally, the dots produced by an ink jet printer may spread and produce a fuzzy image. Still further, inks used in ink jet printers are extremely expensive as compared to inks used in traditional lithography or gravure printing. This economic factor alone makes ink jet technology unsatisfactory for the majority of commercial printing applications, particularly long run applications.

Laser printing has limited viability for high speed variable printing at present, because production speeds are still much slower than offset and gravure, and the material costs (e.g., toner, etc.) are extremely high compared to commercial offset or gravure ink prices. Laser color is also difficult to use for magazines and other bound publications, because the printed pages often crack when they are folded.

Printing techniques have been found to be useful in the production of other articles of manufacture, such as electrical components, including transistors and other devices. Still further, indicia or other markings have been printed on substrates other than paper, such as plastic film, metal substrates, and the like. These printing techniques may use those described above to print paper substrates, in which case these techniques suffer from the same disadvantages. In other cases flexography may be used, which, like lithography, requires the prepress preparation of plates.

SUMMARY OF THE INVENTION

In accordance with one aspect of the present invention, a printing system comprises first means for depositing a principal substance on a surface and second means for depositing a gating agent on selectable portions of a print medium. The system further comprises third means for transferring a portion of the principal substance from the surface to the print medium after the gating agent is applied to the print medium, wherein the gating agent substantially determines where the principal substance is deposited onto the print medium, and a controller that controls at least the second means.

In accordance with another aspect of the present invention, a production system includes a plate cylinder having a surface, an application apparatus adapted to apply a principal substance to the surface, and a blanket cylinder in contact with the surface and which is adapted to receive principal substance from the plate cylinder. The system further includes a plurality of ink jet heads, a controller coupled to the ink jet heads, and an impression cylinder adjacent the blanket cylinder and forming a nip therewith. The nip is adapted to receive an input product onto which a gating agent has been directly deposited by the ink jet heads in a pattern determined by the controller so that principal substance is transferable thereto from the blanket cylinder in dependence upon the determined pattern.

According to a still further aspect of the present invention, a production method includes the step of providing a plate cylinder having a surface, an application apparatus adapted to apply a principal substance to the plate cylinder surface, a blanket cylinder in contact with the plate cylinder surface and which is adapted to receive the principal substance from the plate cylinder, a plurality of ink jet heads, a controller coupled to the ink jet heads, and an impression cylinder adjacent the blanket cylinder and forming a nip therewith. The method further includes the steps of operating the controller to cause the ink jet heads to deposit a gating agent in a pattern directly onto an article and directing the article onto which gating agent has been deposited into the nip so that principal substance is transferable thereto from the blanket cylinder in dependence upon the pattern.

In accordance with yet another aspect of the present invention, a production apparatus comprises a plate cylinder having a surface, an application apparatus adapted to apply a principal substance to the plate cylinder surface, and a blanket cylinder in contact with the plate cylinder surface and which is adapted to receive the principal substance from the plate cylinder. The apparatus further comprises a plurality of ink jet heads, a controller coupled to the ink jet heads, and an impression cylinder adjacent the blanket cylinder and forming a nip therewith. The apparatus still further comprises a controller operable to cause the ink jet heads to deposit a gating agent in a pattern directly onto an article and means for directing the article onto which gating agent has been deposited into the nip so that principal substance is transferable thereto from the blanket cylinder in dependence upon the pattern.

Other aspects and advantages of the present application will become apparent upon consideration of the following detailed description and the attached drawings, in which like elements are assigned like reference numerals.

DETAILED DESCRIPTION

Figure 1:
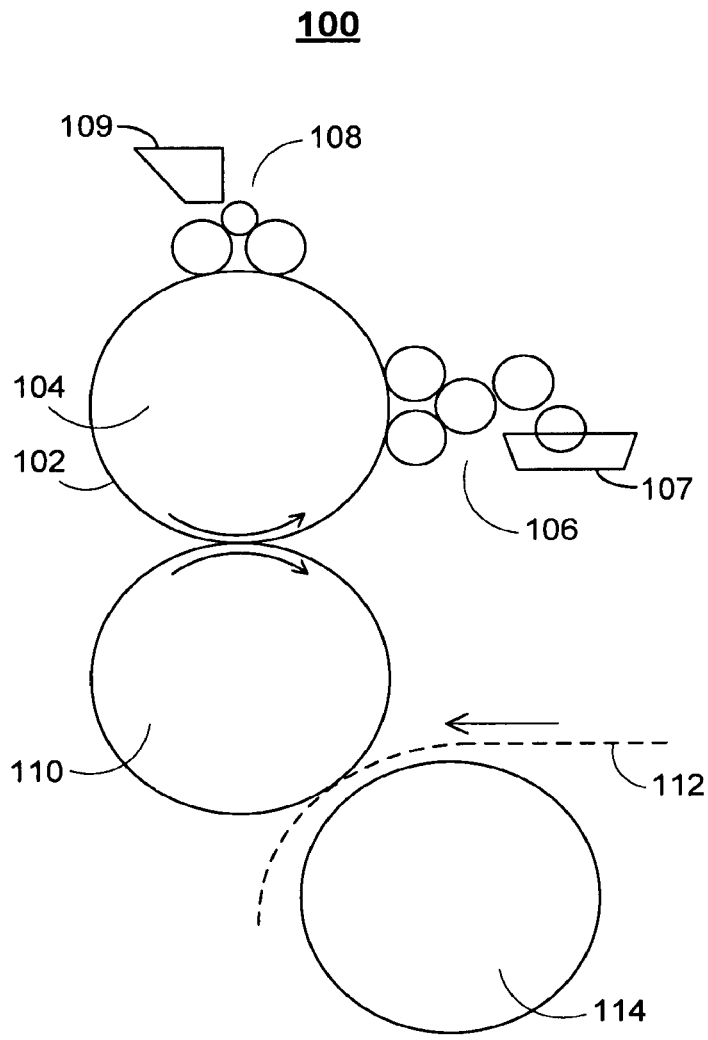
FIG. 1 PRIOR ART
FIG. 1 is a side view of a prior art printing system.

FIG. 1 illustrates traditional offset lithographic printing deck 100. In a traditional lithographic process, the image to be printed is etched onto hydrophilic plate 102 to create hydrophobic regions on the plate which will be receptive to ink. Hydrophilic plate 102 is mounted on plate cylinder 104 and rotated through dampening system 106 and inking system 108. Dampening system 106 may include water supply 107, and inking system 108 may include ink source 109. The hydrophilic portions of plate 102 are wetted by dampening system 106. By using an oil-based ink, ink is only received by the hydrophobic portions of plate 102.

If a blanket cylinder is used, such as blanket cylinder 110, the inked image may be transmitted from plate cylinder 104 to blanket cylinder 110. Then, the image may be further transferred to web 112 (e.g., paper) between blanket cylinder 110 and impression cylinder 114. Using impression cylinder 114, the image transfer to web 112 may be accomplished by applying substantially equal pressure or force between the image to be printed and web 112. When a rubber blanket is used as an intermediary between plate cylinder 104 and web 112, this process is often referred to as "offset printing." Because plate 102 is etched and then mounted on plate cylinder 104, a lithographic press is used to print the same image over and over. Lithographic printing is desirable because of the high quality that it produces. When four printing decks are mounted in series, magazine-quality four color images can be printed.

Figure 2:
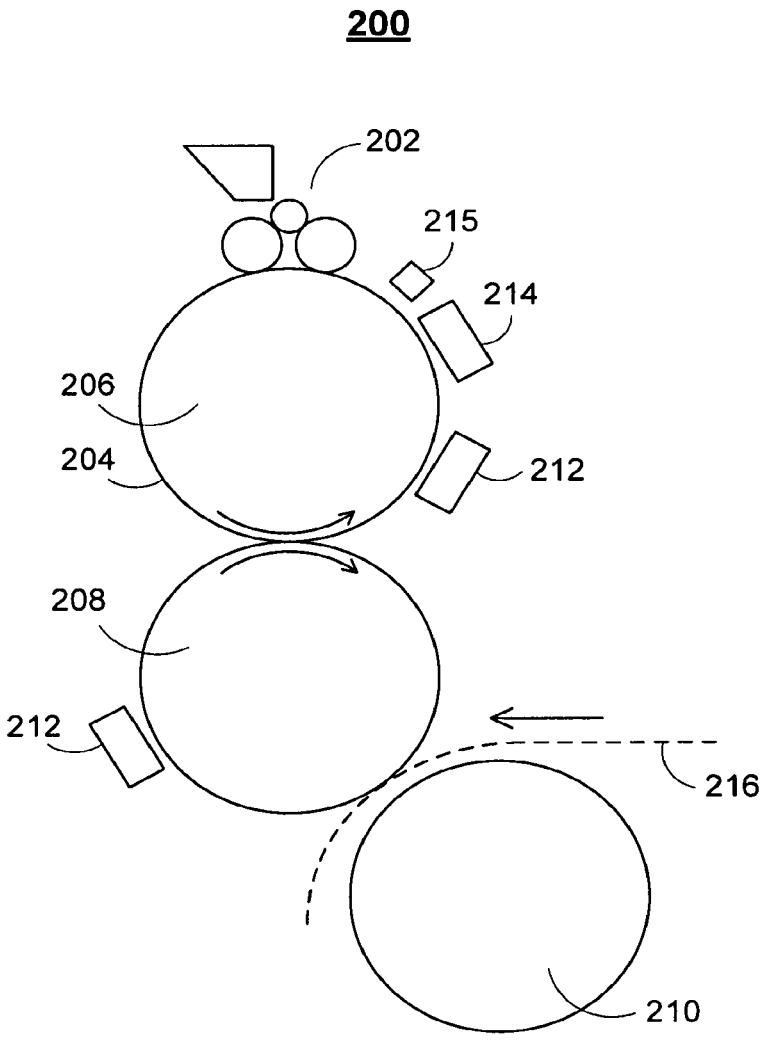
FIG. 2 is a side view of an illustrative embodiment of an apparatus for controlling application of a substance to a substrate.

An illustrative apparatus in accordance is illustrated in FIG. 2. FIG. 2 illustrates a printing deck 200, which may include inking system 202, plate 204, plate cylinder 206, blanket cylinder 208, and impression cylinder 210 as known in the lithographic printing industry. Plate 204 may be entirely hydrophilic (e.g., a standard aluminum lithographic plate). However, dampening system 106 of FIG. 1 has been replaced with cleaning system 212 and aqueous jet system 214 in FIG. 2.

Aqueous jet system 214 may contain a series of ink jet cartridges (e.g., bubble jet cartridges, thermal cartridges, piezoelectric cartridges, etc.). A bubble jet may emit a drop of ink when excited by a heater. A piezoelectric system may eject a drop of ink when excited by a piezoelectric actuator. The drop is emitted from a tiny hole in the ink jet cartridges. The cartridges may contain any number of holes. Commonly, ink jet cartridges can be found with six hundred holes, often arranged in two rows of three hundred.

The aqueous jet system 214 may be used to emit an aqueous solution (e.g., water, ethylene glycol, propylene glycol, or any combination thereof). In some embodiments as disclosed herein, the aqueous solution may contain one or more surfactants, such as Air Products' Surfynol®. Such surfactants may contain a hydrophilic group at one end of each molecule and a lipophilic group at the other end of each molecule. Adding one or more surfactants to the aqueous solution may improve the surface tension properties of the aqueous solution.

The aqueous jets of aqueous jet system 214 may be used to place aqueous solution on a hydrophilic plate in much the same way that a drop of ink is placed on a piece of paper by an ink jet. In some embodiments, the aqueous solution may be ejected through traditional ink jet nozzles (i.e., heads). Such ink jet nozzles may include, for example, ink jet nozzles manufactured by HP, Lexmark, Spectra, Canon, etc. In some embodiments, aqueous jet system 214 may support variable print speeds and output resolutions.

Figure 12:
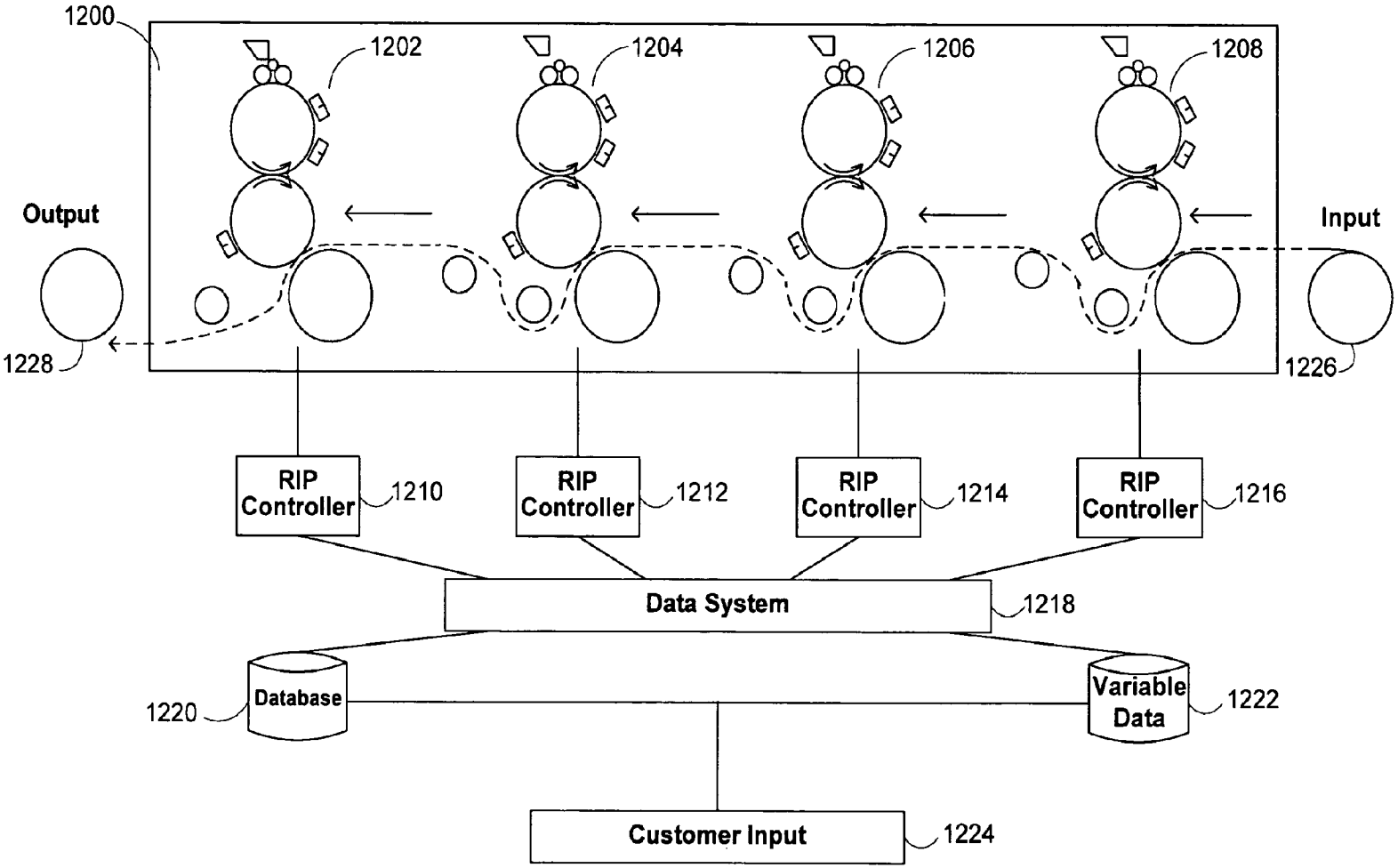
FIG. 12 is a view of an illustrative embodiment of an apparatus for controlling application of a substance to a substrate.

The aqueous jet system 214 may be used to "print" or jet a negative image of the image to be printed, or any portion thereof, on plate cylinder 206. For example, as described in more detail below with regard to FIG. 12, an image controller may receive image data from a data system. The image data may represent the image to be printed or the negative image to be printed. The image data may include variable image data that changes relatively frequently (e.g., every printed page), semi-fixed image data that changes less frequently (e.g., every 100 printed pages), fixed image data that remains static, and any combination of variable, semi-fixed, and fixed image data. Some or all of the image data may be stored as binary data, bitmap data, page description code, or a combination of binary data, bitmap data, and page description code. For example, a page description language (PDL), such as PostScript or Printer Command Language (PCL), may be used to define and interpret image data in some embodiments. A data system may then electronically control aqueous jet system 214 to print in aqueous solution the image (or the negative image) represented by some or all of the different types of image data (or any portion thereof) onto plate cylinder 206. The negative image may be an image of every portion of the paper that is not to receive ink. Thus, after a point on plate cylinder 206 passes aqueous jet system 214, that point will only receive ink from inking system 202 if a drop of aqueous solution was not placed at that point.

In some embodiments as disclosed herein, a vacuum source or heat source 215 may be positioned next to or near aqueous jet system 214. In some embodiments, vacuum source or heat source 215 may be integrated with aqueous jet system 214. The vacuum source or heat source may be used to reduce the size of the individual drops of aqueous solution placed by aqueous jet system 214 by blowing, drying, and/or heating the aqueous solution after it is printed onto plate 204 or plate cylinder 206. Alternatively, any process parameter, including ambient conditions, such as humidity levels, could be manipulated that could affect the drop formation. The ability to control drop size of the aqueous solution may improve the quality of the printed image.

As plate cylinder 206 completes its revolution, after passing the image to blanket cylinder 208, it passes through cleaning system 212, which may remove ink and/or aqueous solution residue so that plate cylinder 206 may be re-imaged by aqueous jet system 214 during the next revolution (or after a certain number of revolutions). Cleaning system 212 may comprise a rotary brush, a roller having a cleaning solution, a belt, a cleaning web treated with a cleaning solution, an apparatus for delivering heat and/or air, an electrostatic apparatus, or any other suitable means of removing ink, aqueous solution residue, or both, from plate cylinder 206. In some embodiments, blanket cylinder 208 may also have a cleaning system similar to cleaning system 215 to clean any residual material from blanket cylinder 208 after the image has been transferred to web 216.

In some embodiments, plate cylinder 206 may have all of the static data for a particular print job etched onto plate 204 by traditional lithographic techniques. Aqueous jet system 214 may then be used to image only variable portions of the job represented by the variable or semi-fixed image data on specified portions of plate 204.

In other embodiments, plate 204 may not be used. Instead, as is understood in the art, the surface of plate cylinder 206 may be treated, processed, or milled to receive the aqueous solution from aqueous jet system 214. Additionally, plate cylinder 206 may be treated, processed, or milled to contain the static data and be receptive to the aqueous solution to incorporate variable data. In these and any other embodiments herein, blanket cylinder 208 may be eliminated entirely, if desired, by transferring the image directly to web 216.

In some embodiments, one or more of plate 204, plate cylinder 206, and blanket cylinder 208 may be customized or designed to work with various properties of aqueous jet system 214 or the aqueous solution. For example, as is understood in the art, one or more of these plates and cylinders may be specially processed or milled to only accept solution ejected by print heads of a particular resolution or dot size. The plates and cylinders may also be specially processed to accept certain types of aqueous solutions and reject others. For example, the plates and cylinders may accept solutions of a certain volume, specific gravity, viscosity, or any other desired property, while rejecting solutions outside the desired parameters. This may prevent, for example, foreign agent contamination and allow for one aqueous solution to be used in the printing process and another aqueous solution (with different physical properties) to be used in the cleaning process. In other embodiments, customary, general-purpose plates and cylinders are used.

Figure 3:
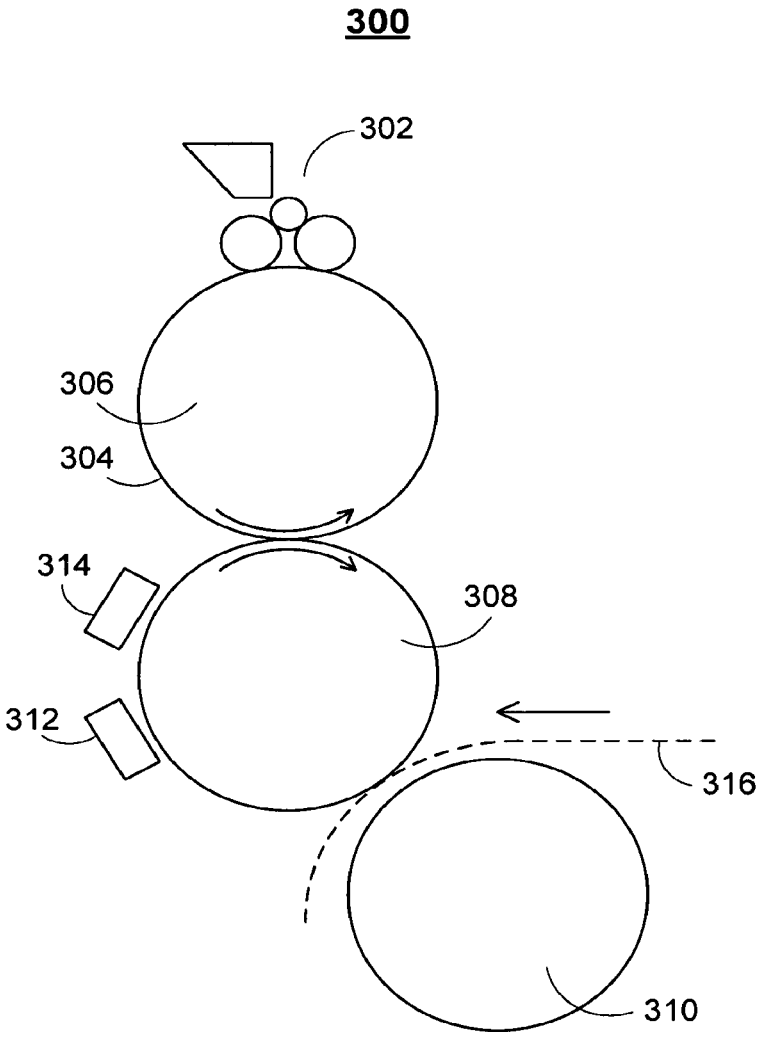
FIG. 3 is a side view of an illustrative embodiment of an apparatus for controlling application of a substance to a substrate.

As shown in FIG. 3, printing deck 300 may include aqueous jet system 314 and cleaning system 312, one or both of which may be mounted and used on blanket cylinder 308 instead of plate cylinder 306. As described with regard to FIG. 2, printing deck 300 may also include inking system 302 over plate cylinder 306. In this embodiment, plate cylinder 306 with plate 304 may be receptive to ink over its entire surface and become completely coated with ink after passing through inking system 302. However, blanket cylinder 308 may be variably imaged with an aqueous solution as described above such that ink is only transferred to certain portions of blanket cylinder 308 for transfer to web 316, which may be between blanket cylinder 308 and impression cylinder 310. When aqueous jet system 314 is used with blanket cylinder 308, as opposed to plate cylinder 306, it may be possible to use a higher volume of aqueous solution, which may result in faster imaging and re-imaging. This is due to the material properties and surface properties of blanket cylinder 308, which may include a rubber blanket that prevents spreading of the aqueous solution drops.

Figure 4:
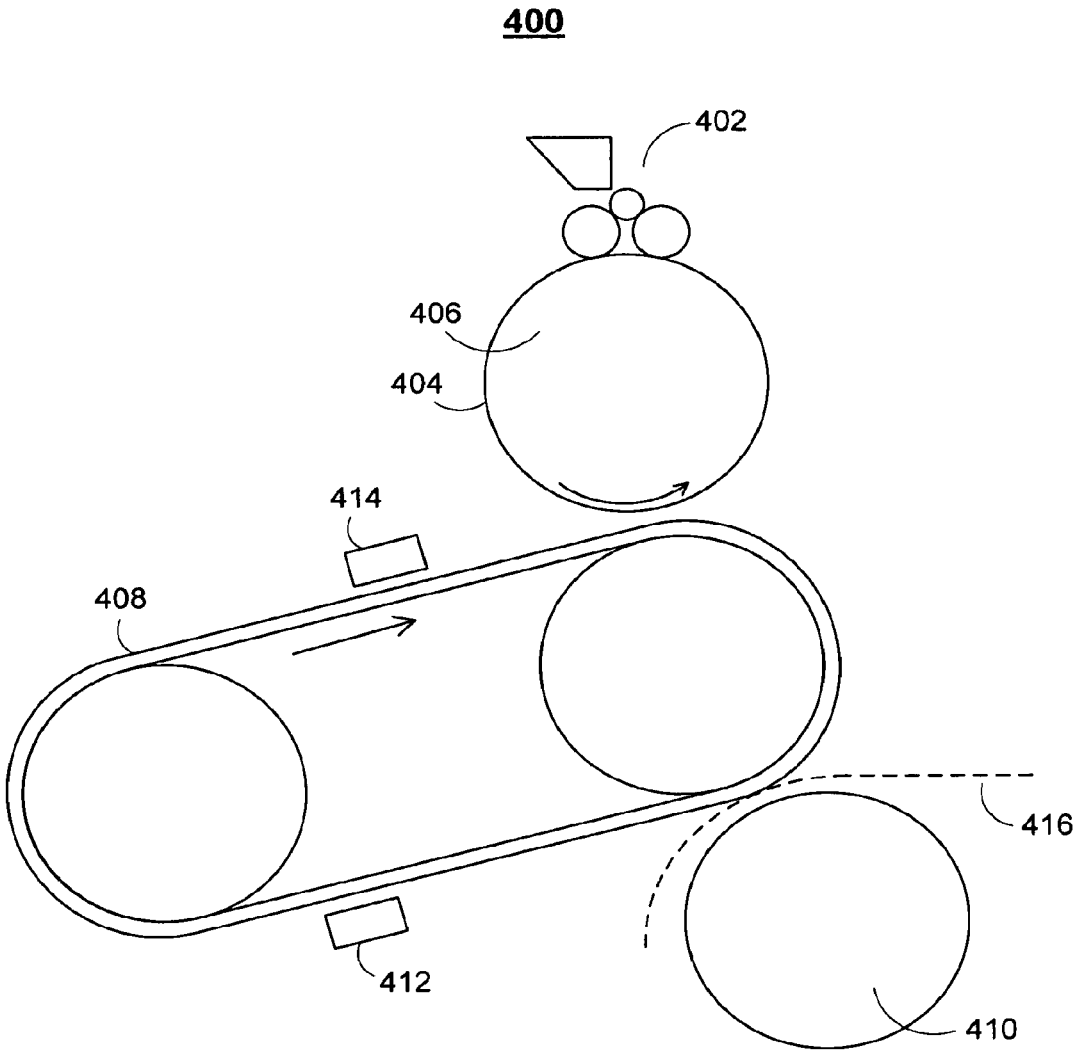
FIG. 4 is a side view of an illustrative embodiment of an apparatus for controlling application of a substance to a substrate.

The aqueous jet system and cleaning system may be mounted in other arrangements as well. As shown in the example of FIG. 4, printing deck 400 allows for more flexibility in the placement of aqueous jet system 414 and cleaning system 412. In the example of FIG. 4, the blanket cylinder may be replaced with endless belt 408. In some embodiments, the length of endless belt 408 may be adjustable to accommodate various additional systems or more convenient placement of aqueous jet system 414 and cleaning system 412. Aqueous jet system 414 and cleaning system 412 may be mounted at any suitable location along endless belt 408. As described above with regard to FIGS. 2 and 3, printing deck 400 may also include inking system 402, plate cylinder 406, plate 404, and web 416 between endless belt 408 and impression cylinder 410. Endless belt 408 may be variably imaged with an aqueous solution as described above with regard to blanket cylinder 308 of FIG. 3 such that ink is only transferred to certain portions of endless belt 408 for transfer to web 416.

Figure 5:
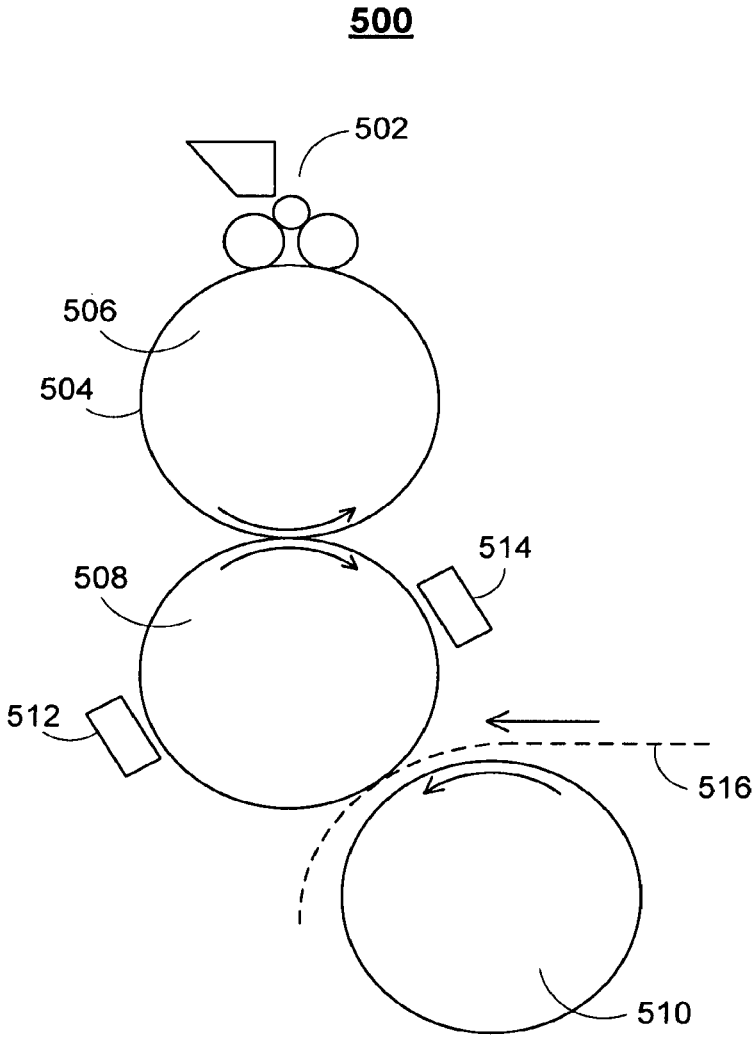
FIG. 5 is a side view of an illustrative embodiment of an apparatus for controlling application of a substance to a substrate.
Figure 6:
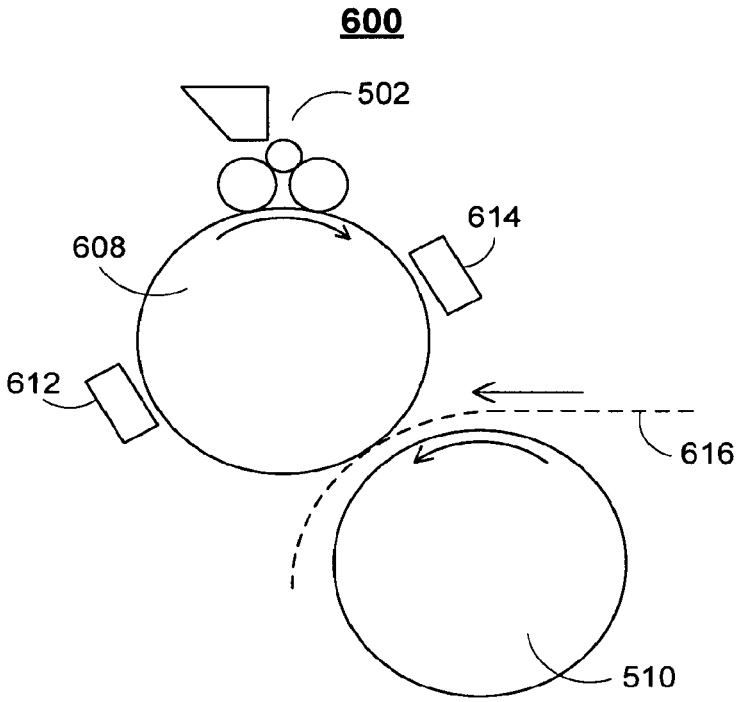
FIG. 6 is a side view of an illustrative embodiment of an apparatus for controlling application of a substance to a substrate.

FIGS. 5 and 6 depict alternative embodiments. As shown in FIG. 5, printing deck 500 may include plate cylinder 506, which may be used to transfer ink to blanket cylinder 508. As described above, printing deck 500 may also include inking system 502, plate 504, blanket cylinder 508, aqueous jet system 514, cleaning system 512, web 516, and impression cylinder 510. As shown in printing deck 600 of FIG. 6, in some embodiments, the plate and blanket cylinder system of FIG. 5 may be replaced with single imaging cylinder 608. In both embodiments of FIGS. 5 and 6, ink may be transferred to the cylinder that will contact the print medium (e.g., web 516 or 616) without regard to the image to be printed. Once ink is transferred to the cylinder, aqueous jet system 514 or 614 may then be used to place aqueous solution on top of the ink layer at the points that should not be transferred to the web. In other words, the negative image of the image to be printed is printed in aqueous solution on top of the ink layer. In some embodiments, a gel (e.g., a silicone-based gel) may be used as an alternative to the aqueous solution.

Figure 7:
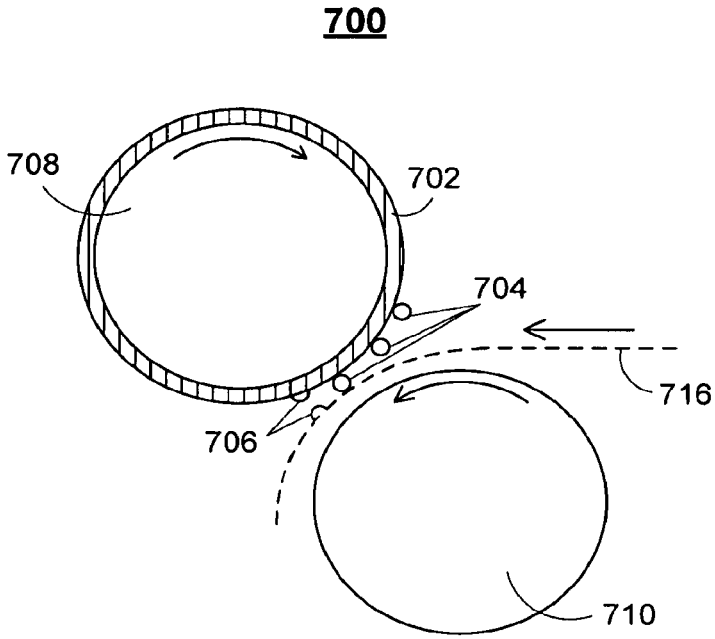
FIG. 7 is an enlarged portion of the side view of an illustrative embodiment of the apparatus shown in FIG. 6.

As shown in FIG. 7, the aqueous solution or gel drops 704 prohibit ink 702 from transferring to the print medium (e.g., web 716 between imaging cylinder 708 and impression cylinder 710). If the print medium is too absorptive, the print medium may absorb all of the aqueous solution or gel and some ink before the print medium comes away from contact with the imaging cylinder at that point. Thus, if the print medium is too absorptive, the aqueous solution or gel may only act to lighten (or wash out) the image at the points that were covered with the aqueous solution or gel. Oppositely, if a high gloss or plastic print medium is used, the ink may be prohibited from transferring to the print medium, because such print mediums may never absorb the aqueous solution or gel drops 704 that are blocking ink 702. Either way, ink 702 that is not covered with a protective layer of aqueous solution or gel drops 704 is transferred to web 716.

One benefit of an embodiment like that shown in FIGS. 5-7 is that the need for a cleaning system may be eliminated. Because imaging cylinder 708 is constantly being inked over its entire surface with ink 702, there may be no need to clean off the ink at any point in the process. A cleaning system is illustrated in FIGS. 5 and 6, however, because it may be desirable to clean off ink that may be drying or accumulating. In addition, a vacuum source or heat source (such as vacuum source or heat source 215 of FIG. 2) may be used in place of or in addition to the cleaning system. It may be desirable to dry any excess aqueous solution from the imaging cylinder before passing the imaging cylinder through the inking system again. Therefore, the vacuum source or heat source may be used to eliminate any residual aqueous solution before re-inking.

Properties of the aqueous solution or gel (e.g., viscosity or specific gravity) and of the print medium (e.g., using bond paper, gloss paper, or various coating techniques) may be varied to achieve a desirable interaction between the protective negative image that is printed with the aqueous jet system and the print medium. For example, if image sharpness is desired, it may be beneficial to choose an aqueous solution that will not be absorbed at all by the print medium. However, if some transfer of ink is desirable even from the areas covered with the output of the aqueous jet system, it may be beneficial to use a print medium that quickly absorbs the aqueous solution so that some ink transfer is also able to occur from the covered areas.

Figure 8:
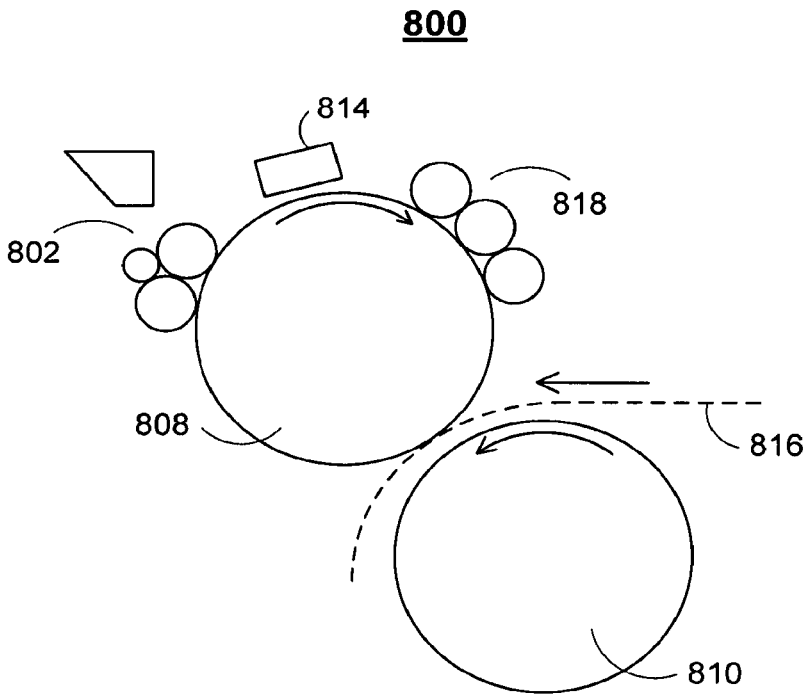
FIG. 8 is a side view of an illustrative embodiment of an apparatus for controlling application of a substance to a substrate.

FIG. 8 illustrates yet another alternative embodiment. Printing deck 800 includes inking system 802, which is used to apply ink to imaging cylinder 808. Then, aqueous jet system 814 is used to print the positive image of the image to be transferred to the print medium (e.g., web 816 between imaging cylinder 808 and impression cylinder 810). Aqueous jet system 814 prints this positive image in aqueous solution or gel on top of the ink layer. This "printed" layer is used to protect the ink in the regions that are to be transferred to the web.

Once the positive image has been protected, rotating imaging cylinder 808 next encounters stripping system 818. Stripping system 818 is used to strip away the ink from the unprotected areas of imaging cylinder 808. In other words, any ink that was not protected by aqueous jet system 814 and is therefore not part of the image to be printed, is stripped away from the imaging cylinder. Stripping system 818 may be, for example, a series of blank webs that can be used to pull the unprotected ink away from the imaging cylinder. Stripping system 818 may alternatively employ a reverse form roller as described below. The protected ink image is then transferred to the print medium.

The transfer of the protected ink image may be achieved by transferring both the protective aqueous layer and the protected ink to web 816. Alternatively, stripping system 818 may remove the protective aqueous layer so that the originally protected ink may be transferred to the web without the protective aqueous layer. In some embodiments, stripping system 818 may remove the protective aqueous layer at the same time it removes the unprotected ink (i.e., the ink not covered by the protective aqueous layer), leaving only the originally protected ink to be transferred to web 816. In such an embodiment, a reverse form roller may be used to strip off the unprotected ink and aqueous solution. The reverse form roller may also be used to return the stripped ink to inking system 802. In other words, the unused ink may be recycled by stripping system 818. Any other suitable method may be used to transfer the protected ink image to web 816.

Figure 9:
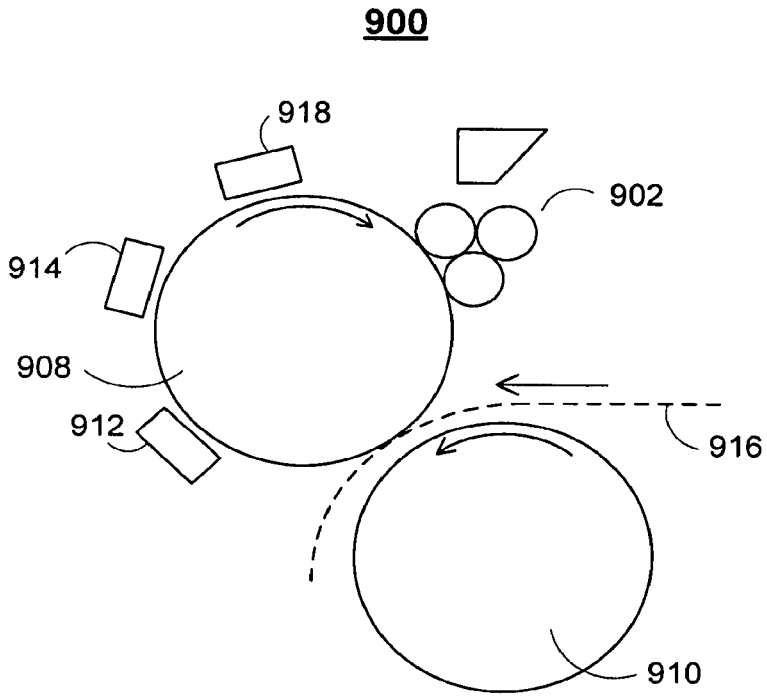
FIG. 9 is a side view of an illustrative embodiment of an apparatus for controlling application of a substance to a substrate.

Another alternative embodiment is illustrated by printing deck 900 of FIG. 9. In embodiments like that shown in FIG. 9, aqueous jet system 914 may be used to print an aqueous solution containing surfactants comprising block copolymers onto imaging cylinder 908. One example of such a surfactant is BASF's Pluronic® F-127 surfactant, which is a block copolymer based on ethylene oxide and propylene oxide. These surfactants may be used to vary the surface properties of imaging cylinder 908 between hydrophilic and lipophilic.

For example, aqueous jet system 914 may be used to print a positive image onto imaging cylinder 908. Then, a heat source, e.g., dryer 918 or any other suitable means of evaporating the water, may be used to dry the aqueous solution. This will leave the block copolymer bonded to imaging cylinder 908 at the location at which it was printed by aqueous jet system 914. The block copolymer should be chosen such that one end bonds with surface material of the imaging cylinder while the other end is lipophilic. If a naturally hydrophilic imaging cylinder is used, the imaging cylinder will be lipophilic everywhere that aqueous jet system 914 printed the block copolymer, and hydrophilic everywhere else. The imaging cylinder may now be used in the known lithographic process. For example, ink may be, constantly applied to imaging cylinder 908 by inking system 902. The image may be then be transferred to the print medium (e.g., web 916 between imaging cylinder 908 and impression cylinder 910).

The embodiment of FIG. 9 may also include cleaning system 912. The cleaning system may only selectively engage imaging cylinder 908. Because the block copolymer surfactant has been physically bonded to imaging cylinder 908, it may not be removable by mechanical means. In other words, the imaging cylinder could be used repeatedly, as if it were a standard lithographic plate. When the data system controlling the press determines that information needs to be varied, cleaning system 912 may selectively release some of the block copolymers. For example, a chemical that negates the bond between the block copolymer and the imaging cylinder could be used to remove the block copolymer in select locations. Those of ordinary skill in the art will recognize that any suitable means of releasing the bond between the block copolymer and imaging cylinder 908 may be employed to selectively release the block copolymer. For example, a reducing agent may be used to negate the bond between the block copolymer and imaging cylinder 908.

In an alternative embodiment of FIG. 9, aqueous jet system 914 may print a negative image on imaging cylinder 908. In this embodiment, it may be desirable to use a naturally lipophilic imaging cylinder and a block copolymer surfactant in the aqueous solution that is hydrophilic on its free end, i.e., the end opposite the end bonded to the imaging cylinder. Again, the aqueous solution may be dried to leave only the bonded surfactant, and imaging cylinder 908 may be used repeatedly. As described above, the block copolymer could be selectively removed using cleaning system 912 with an acceptable neutralizing solution at the appropriate time.

In yet another alternative of the FIG. 9 embodiment, charged block copolymer surfactant molecules may be employed so that the bond between imaging cylinder 908 and the surfactant can be electronically controlled. In other words, aqueous jet system 914 may be used to place the charged surfactants at the desired location. The charged properties of the surfactant molecules may be what permits their physical bond to imaging cylinder 908. Thus, removing them may require selectively applying a neutralizing charge from cleaning system 912.

Alternatively, imaging cylinder 908 may have a charged surface that is controllable to change the charged property of a particular point on the imaging cylinder at a particular time. In other words, points on imaging cylinder 908 may be toggled between positively and negatively charged to attract and repel the surfactants at the appropriate time in the printing process. In fact, one may use two or more imaging cylinders, such that each cylinder is used to print a portion of the imaged output, so that when one cylinder is being charged to repel ink, the other is being charged to attract ink. In this fashion, the reversal of charge does not impact the production process. Still further, each cylinder could be sized and positioned such to allow for recovery time between imaging cycles while the system performs continuous printing.

As evidenced by the above description, surfactant block copolymers having various properties may be used with imaging cylinders having various material properties to achieve an imaging cylinder that has a selectively oleophilic and hydrophilic surface. The physical bond created between the surfactant and the imaging cylinder's surface allows the imaging cylinder to repeat the same image multiple times or to selectively vary the image in any given rotation of the imaging cylinder. By taking advantage of the material properties of the imaging cylinder and the block copolymer surfactants, a durable, yet variable, imaging system having the quality of known lithographic printing techniques may be achieved.

Surfactants like those described above are sold in various forms (e.g., solid, powder, aqueous solution, gel, etc.). Any desirable form may be used in accordance with the present disclosure.

Figure 10:
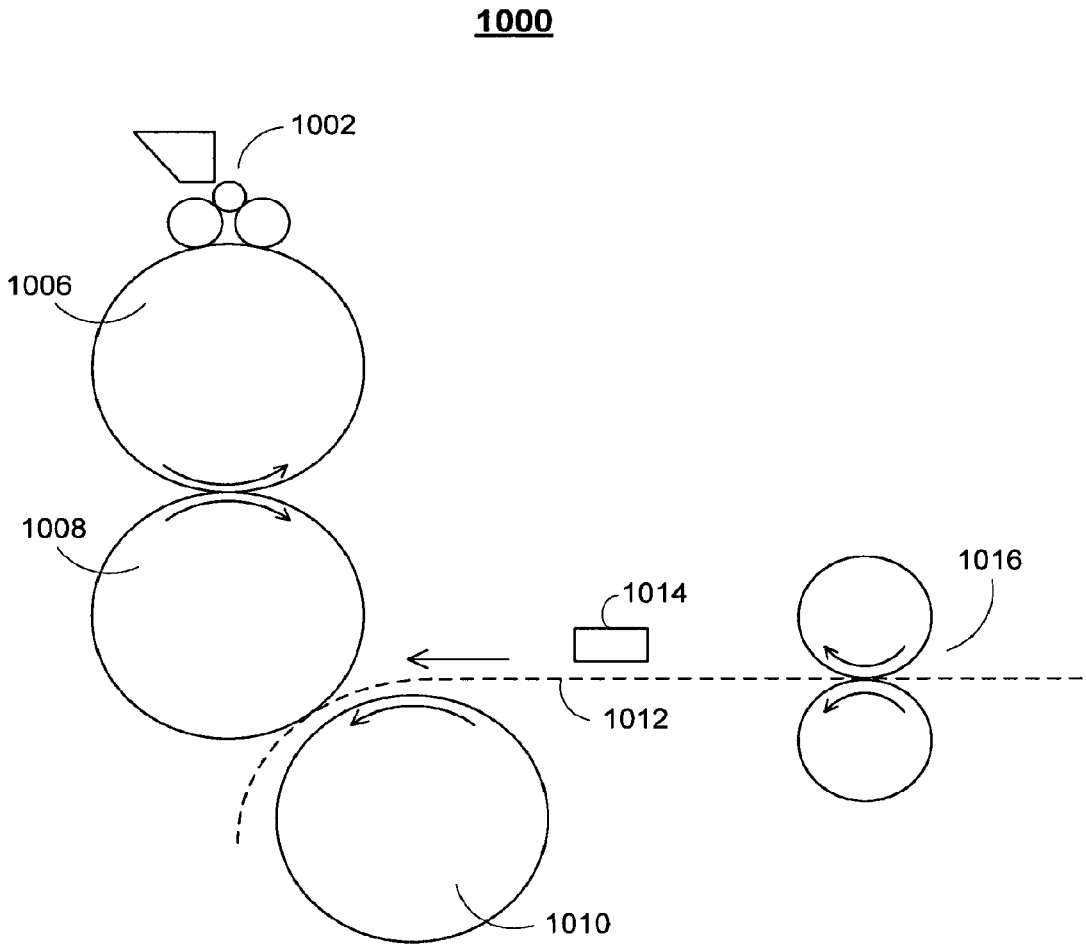
FIG. 10 is a side view of an illustrative embodiment of an apparatus for controlling application of a substance to a substrate.
Figure 11:
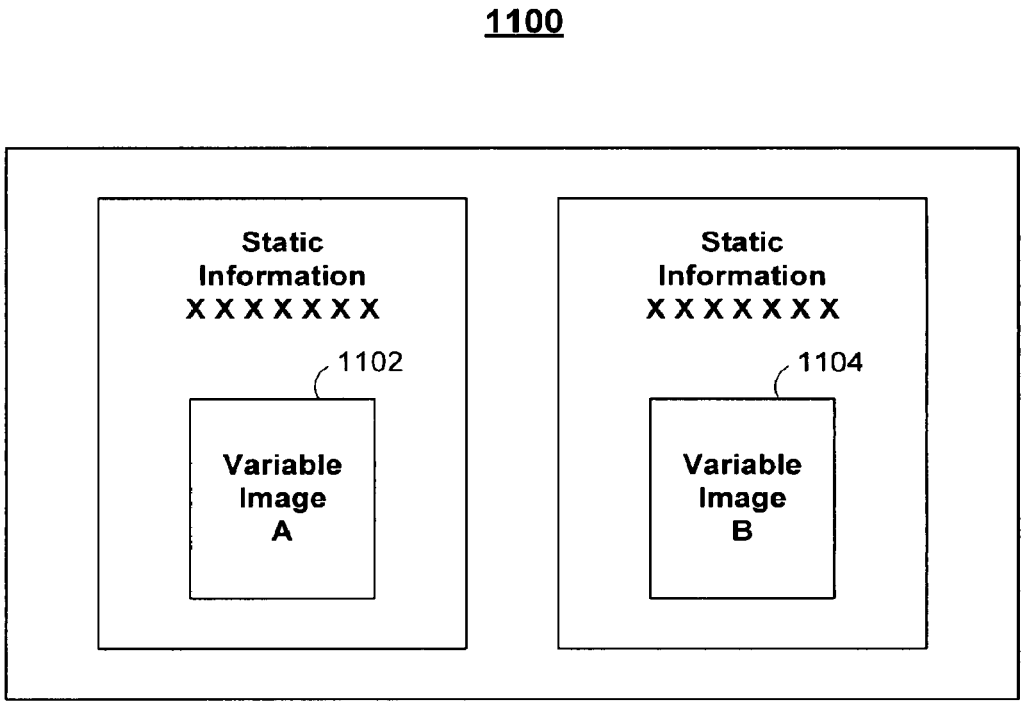
FIG. 11 is an illustration of possible output in accordance with the apparatus shown in FIG. 10.

FIG. 10 illustrates another alternative embodiment. FIG. 10 shows lithographic deck 1000 as known in the art (e.g., inking system 1002, plate cylinder 1006, blanket cylinder 1008, and impression cylinder 1010). However, upstream from lithographic deck 1000, coating system 1016 and aqueous jet system 1014 have been installed. In embodiments like that shown in FIG. 1*a*, a standard lithographic plate may be etched with the static information for a given job. However, a portion of the plate may be reserved for variable information (e.g., plate 1100 may include one or more variable image boxes, such as boxes 1102 and 1104, as shown in FIG. 11). The portion of the lithographic plate that corresponds to the variable image boxes may be formed to be ink receptive over the entire surface of the variable image boxes (i.e., when the variable image box portions of the lithographic plate passes the inking system, the entire rectangular areas will accept ink).

To generate the variable image, a negative image of the variable image may be printed by aqueous jet system 1014 directly onto web 1012. Before web 1012 reaches aqueous jet system 1014, web 1012 may be coated to prevent web 1012 from absorbing the aqueous solution. Thus, when the portion of web 1012 to receive the variable image makes contact with the portion of blanket cylinder 1008 transferring the ink for the variable image, web 1012 selectively receives the ink only in the areas not previously printed on by aqueous jet system 1014. The standard lithographic deck operates as though it is printing the same image repeatedly (e.g., a solid rectangle). However, web 1012, which is first negatively imaged by aqueous jet system 1014, only selectively receives the ink in the solid rectangle on blanket cylinder 1008 to create the variable image on web 1012.

Coating system 1016 may be an entire deck of its own for applying the coating. Alternatively, coating system 1016 may be any suitable alternative for applying a coating to web 1012 to reduce its ability to absorb the aqueous solution. For example, coating system 1016 may include a sprayer that sprays a suitable solution onto web 1012. The solution may prevent web 1012 from absorbing all or some of the aqueous solution.

In any of the foregoing embodiments, a blanket and plate cylinder combination may be replaced by a single imaging cylinder and vice versa. In any case, it may be desirable to pair a soft imaging/blanket cylinder with a hard impression cylinder (e.g., a silicone imaging/blanket cylinder and a steel impression cylinder). Alternatively, a hard imaging/blanket cylinder may be paired with a soft impression cylinder (e.g., a ceramic imaging/blanket cylinder and a rubber impression cylinder).

In some embodiments, it may be desirable to employ a silicone imaging cylinder to create a "waterless" system. In such embodiments, the imaging cylinder may have a silicone surface that is entirely oleophobic. As known in the art of waterless lithography, such cylinders may be developed (e.g., etched) such that portions of the cylinder's surface become oleophilic. Because the silicone is naturally oleophobic, there is no need to wet the cylinder before applying ink to the cylinder's surface. In some embodiments herein employing a silicone imaging cylinder, an aqueous solution may be used that includes silicone-based surfactants or other suitable materials that may be both oleophilic and attracted to the imaging cylinder's silicone surface. Thus, the imaging cylinder may be variably imaged with such an aqueous solution as described herein. If necessary, an appropriate cleaning mechanism may be used to clear any residual aqueous solution or ink from the imaging cylinder.

Multiple decks like those shown in FIGS. 2-10 may be mounted in a series to produce a press. Such an arrangement of multiple printing decks is shown in printing press 1200 of FIG. 12. This may be done, for example, to allow for four color printing. In accordance with the CMYK four color process, each of decks 1202, 1204, 1206, and 1208 is responsible for printing in one of cyan, magenta, yellow, or black. Each of the decks may be controlled by its own raster image processor ("RIP") or controller, such as controllers 1210, 1212, 1214, and 1216. Controllers 1210, 1212, 1214, and 1216 may be implemented in hardware and/or software, for example, as part of a printer driver. If desired the controllers 1210-1216 may be replaced by fewer than or more than four RIP's. For example, a single RIP may electronically process data and control the decks 1202-1208.

The entire press may be managed by a single data system, such as data system 1218, that controls RIP controllers 1210, 1212, 1214, and 1216, which in turn control decks 1202, 1204, 1206, and 1208, respectively. Data system 1218 may be provided with customer input 1224 via database 1220 and variable data source 1222. Database 1220 may include image data, messages, one-to-one marketing data, etc.

In some embodiments, database 1220 contains all the layout information and static image information for the job to be printed, while variable data source 1222 contains all the variable data. For example, customer input 1224 may provide customer data (e.g., layout and content preferences) to database 1220. Variable data source 1222 may store personalized text (e.g., the customer's name and location) and graphics. Data system 1218 may then access both database 1220 and variable data source 1222 in order to print a job. Database 1220 and variable data source 1222 may include any suitable storage device or storage mechanisms (e.g., hard drives, optical drives, RAM, ROM, and hybrid types of memory). Press 1200 may be fed by roll or sheet input 1226. Output 1228 of the press may also be in the roll or sheet format. Additionally, output 1228 of press 1200 may be fully-bound or may be prepared for optional post-processing.

One or more of the aqueous jet systems, cleaning systems, stripping systems, and vacuum or heating systems described in the embodiments above may be electronically controlled via data system 1218. For example, in a typical usage scenario, data system 1218 may access raster image data (or any other type of image data, including, for example, bitmap data, vector graphics image data, or any combination thereof) from database 1220 and/or variable data source 1222. In some embodiments, the image data may be stored in page description code, such as PostScript, PCL, or any other PDL code. The page description code may represent the image data in a higher level than an actual output bitmap or output raster image. Regardless of how the image data is stored, data system 1218 may cause the aqueous jet system disclosed herein to print a negative image representing the image data (or any portion thereof) in aqueous solution to a plate or plate cylinder. In some embodiments, as described above, only the data represented by the variable image data may be printed in aqueous solution on the plate or plate cylinder.

Controlling the entire press from a single data system, such as data system 1218, may enable a user to take advantage of form lag techniques. Form lag relates to the timing of multiple variable printing devices acting on the same document. Certain data may need to be printed by one deck while another portion of data may need to be printed by another deck on the same document. In this respect, it may be beneficial to delay the transmission of data to the latter deck, because the document may pass through several intermediary decks before reaching the latter deck. By efficiently managing form lag, image resolution and placement may be improved.

Figure 13:
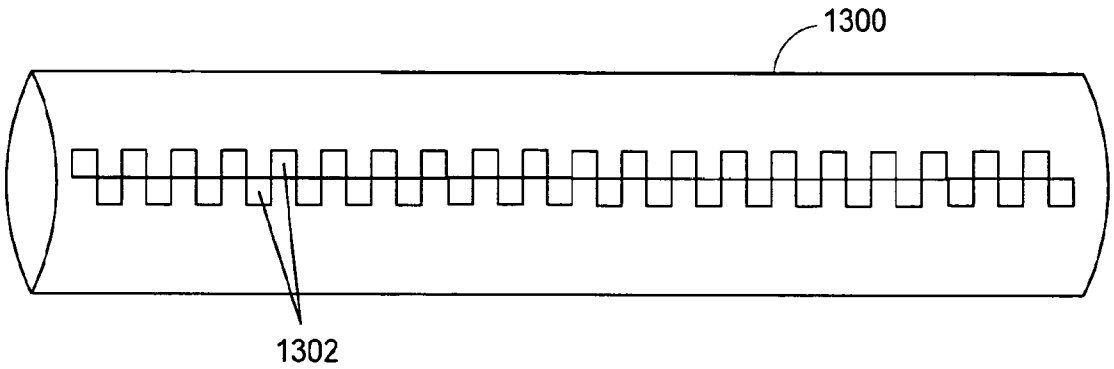
FIG. 13 is an elevational view of a portion of the apparatus shown in FIGS. 2-10.

The aqueous jet systems of the various embodiments disclosed herein may be arranged in a number of ways. For example, FIG. 13 illustrates staggered lay-out of individual aqueous jet units 1302 in cylinder 1300. Overlapping the print heads to join the print width of one print head with the print width of a second print head is known as stitching. Stitching allows for the precise alignment of multiple print heads so that no noticeable join is visibly detectable.

The aqueous jet units may be known print cartridge units such as those manufactured by HP, Lexmark, Spectra, Canon, etc. Each jet unit may comprise any number of small holes for emitting the aqueous solution. As shown in FIG. 13, aqueous jet units 1302 may overlap one another at the edges in order to avoid any gaps between the aqueous jets. This may ensure that every possible point on the plate cylinder may be imaged.

Figure 14:
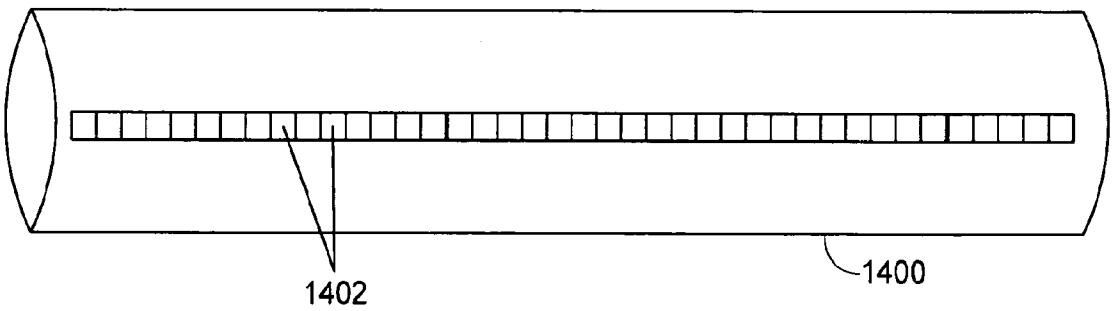
FIG. 14 is an elevational view of a portion of the apparatus shown in FIGS. 2-10.
Figure 15:
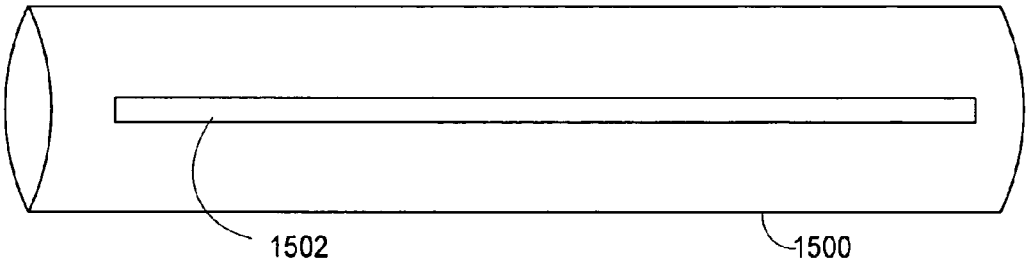
FIG. 15 is an elevational view of a portion of the apparatus shown in FIGS. 2-10.

Alternatively, aqueous jet units 1402 may be arranged in series as shown in cylinder 1400 of FIG. 14. FIG. 15 illustrates another option, in which aqueous jets 1502 are configured as a single unit in cylinder 1500 instead of multiple units. A single unit may ensure that the spacing between each aqueous jet is consistent. Multiple units may be desirable as a means of reducing maintenance and replacement costs. The aqueous jet units may be arranged in any suitable arrangement that enables aqueous solution to be positioned at any point on the plate cylinder or blanket cylinder that is desirable.

Figure 16:
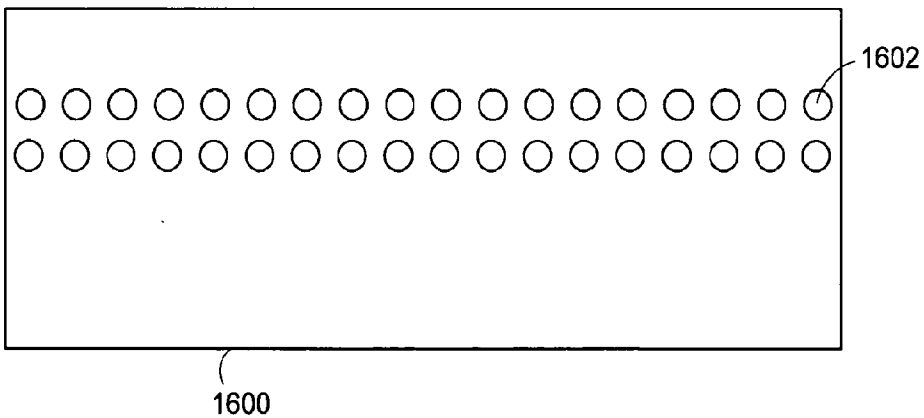
FIG. 16 is an enlarged view of a portion of the apparatus shown in FIGS. 2-10.

FIG. 16 illustrates one example of a possible arrangement of aqueous jets 1602 along aqueous jet unit 1600. Aqueous jets 1602 may be arranged in series, staggered, or arranged in any other suitable way for enabling placing a drop of aqueous solution at any point on the plate cylinder or blanket cylinder.

Figure 17:
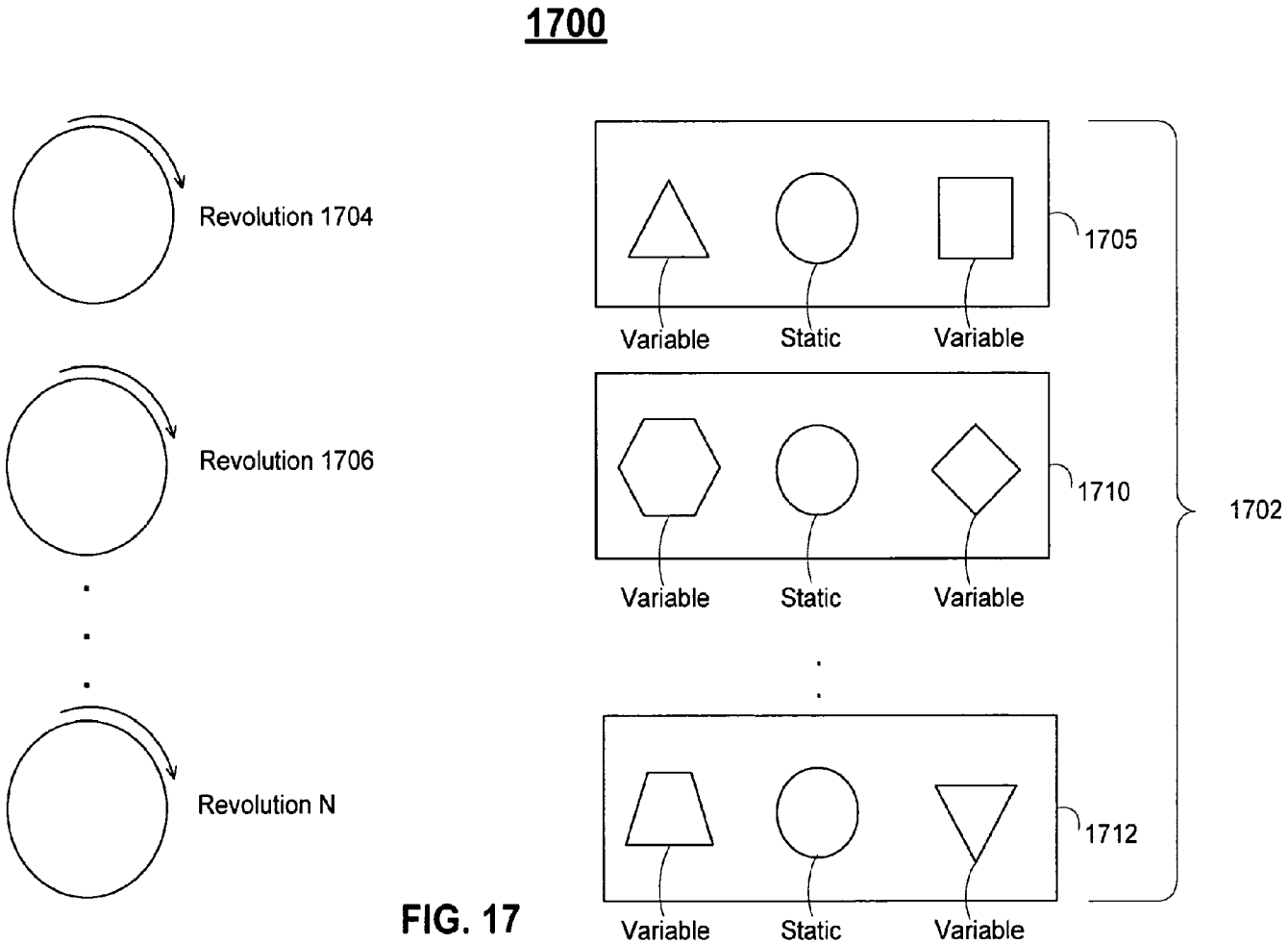
FIG. 17 is an illustration of a possible sequence of output.

FIG. 17 shows illustrative output 1702 from a press in accordance with the present disclosure. Each revolution 1704, 1706, . . . , N of the plate or blanket cylinder may produce, e.g., a document containing one static image and two variable images as shown in documents 1705, 1710, and 1712. Any combination of static and variable information may be produced by such a press. Furthermore, one revolution of the cylinder does not need to match one page of output. Depending on the cylinder size, multiple pages may be printed by the revolution of some cylinders, while the revolution of other cylinders may only produce a portion of an output page.

As should be evident from the foregoing, any agent may be utilized that blocks the application of ink as desired. Alternatively, a different form of agent may be used that facilitates application of a substance to a substrate. Because the embodiments disclosed herein comprehend the use of either (or both) blocking and transfer-aiding compositions, or one or more compositions that have both properties, reference will be made hereinafter to a gating agent that may have either or both of these capabilities with respect to a principal substance. Specifically, the gating agent may block transfer of all, substantially all, or some portions of the principal substance. The gating agent may alternatively, or in addition, aid in transfer of all, substantially all, or a portion of the principal substance, or may block some portion(s) and aid the transfer of other portion(s) of the principal substance. In the case of the examples described above, the principal substance may be an ink, the substrate may be a web of paper, and the selective portions of the principal substance may be image areas. Gating agent may be applied using one or more ink jet heads either to a plate or directly to a blanket cylinder, then ink may be applied in a non-selective fashion to the plate or blanket cylinder, and then the ink may be transferred from the image areas on the plate or blanket cylinder to the web of paper. In the event that the gating agent and the ink are applied directly to the blanket cylinder, the plate cylinder need not be used. Particular printing applications that may benefit include static print jobs (particularly, but not limited to, short runs), or variable or customizable print jobs of any size, for example, targeted mailings, customer statements, wallpaper, customized wrapping paper, or the like.

The apparatus and methods disclosed herein are also relevant in other industries and other technologies, for example, textiles, pharmaceuticals, biomedical, and electronics, among others. Variably customizable graphics or text, or a principal substance having enhanced sealing properties or water or fire resistance may be selectively applied to webs of textiles such as may be used to manufacture clothing or rugs. In the pharmaceutical industry, the principal substance may be a drug, a therapeutic, diagnostic, or marking substance other than an ink, or a carrier for any other type of substance. In biomedical applications, for example, the principal substance may be a biological material or a biocompatible polymer. In electronics applications, the principal substance may be an electrically conductive or insulative material that may be selectively applied in one or more layers on the substrate. Other electronic applications include production of radio frequency identification ("RFID") tags on articles. Other industries may also benefit from selective application of a principal substance to a substrate. For example, the principal substance may be a thermally conductive or insulative material selectively applied over components of an item of manufacture, for example, a heat exchanger, a cooking pan, or an insulated coffee mug. The principal substance may also be a material with enhanced absorptive, reflective, or radiative properties, some or all of which may be useful in other items of manufacture, for example, when the principal substance is selectively applied to components of an oven, a lamp, or sunglasses. Still further uses for the principal substance may include customizable packaging films or holograms (via selective filling of refractive wells prior to image forming). Moreover, the technology could be applied to fuel cell manufacturing and the principal substance may include functional polymers, adhesives and 3-D interconnect structures. In applications for the manufacture of micro-optical elements, the principal substance could be an optical adhesive or a UV-curing polymer. Yet a further application may be display manufacturing wherein the principal substance is a polymer light-emitting diode material.

The gating agent may be applied as, for example, an aqueous fluid by being selectively sprayed directly onto the substrate or onto an intermediate surface or directly onto the principal substance using ink jet or other precisely controllable spraying or application technology. An aqueous fluid may generally have a low viscosity and a reduced propensity to form clogs, and is therefore advantageous for use with an ink jet head. However, the gating agent may also be applied using ink jet technology in a form other than an aqueous fluid. Further, the gating agent is not limited to being a fluid at all and may be applied as a solid, for example as a thin film, a paste, a gel, a foam, or a matrix. The gating agent could comprise a powdered solid that is charged or held in place by an opposite electrostatic charge to prevent or aid in the application of the principal substance.

As an example, a liquid gating agent in the form of a solvent may be applied by one or more ink jet heads to a plate and a powdered ink colorant dispersible in the solvent may be deposited over the entire surface of the plate to form a liquid ink in situ in the jetted areas. Powder in the non-jetted areas may be removed (e.g., by inverting the plate so that the powder simply falls off the plate, by air pressure, centrifugal force, etc), thereby resulting in inked and non-inked areas. Alternatively, a charged powdered ink colorant may be applied over an entire plate surface (or substantially the entire plate surface or only a portion of the plate surface) and may be retained on the plate by an electrostatic charge applied to the plate. The solvent may then be jetted onto the areas to be imaged to form liquid ink in such areas, and the electrostatic charge removed so that the powder in the non-wetted areas can be removed. In either event, the resulting image may thereafter be applied to a substrate, for example a web of paper.

Any of the systems described herein may be modified to allow formation of different drop sizes of gating agent. For example, ink jet heads manufactured by HP may be used to obtain drop sizes on the order of 14 picoliters (pl) up to 1200 dots per inch (dpi) resolution whereas ink jet heads manufactured by Xaar are capable of ejecting 3 pl drops at 360 dpi but are also able to eject 6 pl, 9 pl, and 12 pl drops. Disparate ink jet head technologies, such as both HP and Spectra, may be used in a single system to produce a wider range of drop sizes. The resolution of the resulting imaged areas can be controlled through appropriate selection of the ink jet head(s) used to apply the gating agent. In general, a larger drop size is more susceptible to forced wetting of areas to be imaged. This forced wetting can result from merging of adjacent jetted drops when the image is transferred between surfaces (such as in the nip area between a plate and blanket) and can cause a decrease in image quality due to a reduction in print density. Such forced wetting can be minimized by the addition/removal of one or more constituents and/or changing or adjusting one or more physical properties of the gating agent. For example, reducing certain surfactants may reduce ghosting while utilizing, adding, and/or substituting other surfactants may also improve image quality. Alternatively, one could apply an electrostatic charge to a cylinder that is opposite in the polarity to the charge of the gating agent applied to the cylinder. The resulting electrostatic attraction may reduce or eliminate forced wetting.

Still further, increasing the viscosity of the gating agent and/or increasing the surface tension thereof, and/or using a supporting agent and/or mechanical structure for non-image and image areas, respectively, such that the boundaries between image and non-image areas are maintained can reduce spreading, thus improving quality. Other chemical and/or materials science properties might be utilized to reduce or eliminate this effect. Viscosity modifying agents may include propylene glycol, cellulosic materials, xanthan gum, or Johnson Polymer's Joncryl® 678, to name a few. The gating agent may also include a thixotropic fluid that changes viscosity under pressure or agitation. Increasing surface tension of the gating agent can also reduce spreading. Surface tension modifiers can include poloxamer (e.g., BASF's Pluronic®) or Air Products' Surfynols®, among others. In addition, other agents may be incorporated in the gating agent composition such as anticurl and anticockle agents, blocking agent anchors, litho ink modifiers, receiving surface modifier, antiseptic agents, biocides, and pH adjusters and maintainers.

The types and/or physical characteristics and/or chemical compositions of the ink(s) or other principal substance(s) may be selected or modified to obtain desired results. For example, by controlling the surface tension of the ink, color-to-color bleed and showthrough on the opposite side of the paper can be eliminated. As a further example, one or more ink(s) used in waterless printing applications may be employed together with jetted gating agent (whether the latter is aqueous or non-aqueous) to block or promote transfer of ink from plate to paper. In the case of the use of waterless printing ink(s) with an aqueous gating agent, the composition of the gating agent may be adjusted in view of the lipophilic characteristics of such ink(s) so that the gating agent has a molecular structure that attracts and/or repels the ink(s) as necessary or desirable. Alternatively, jetted gating agent applied initially to a hydrophilic plate may include one or more hydrophilic components that bond with the plate and one or more other components that bond with or repel ink molecules.

As a still further example, a phase change of the gating agent, or the principal substance, or both, may be employed to prevent and/or promote substance blocking or transfer/collection. For example, gating agent may be selectively jetted onto a surface, such as a plate, and principal substance may be applied to the surface having the gating agent applied thereto, whereupon the portions of the principal substance that contact the jetted gating agent may be converted to a gel or a solid. Alternatively, the principal substance may be applied in an indiscriminate (i.e., non-selective) fashion to the plate and the gating agent may thereafter be selectively applied to portions of the plate that are not to be imaged (i.e., non-image areas), whereupon the principal substance in the jetted portions is converted to a gel or solid. Still further, a two (or more) component gating solution could be used wherein the components are individually selectively applied in succession where each is individually jettable, but which, when applied in the same location, result in a chemical or physical reaction (e.g., similarly or identically to an epoxy-type reaction) to promote advantageous gating characteristics. The principal substance, such as ink may be applied before or after one or more of the gating agent components are applied. In any of the foregoing examples, a substrate (such as a web of paper) may be imaged by the plate.

Another process variable is the substrate itself. In the case of a paper substrate, a conventional coated stock of appropriate size, weight, brightness, etc. may be used. One or more coatings, such as clay, may be applied thereto to delay/prevent absorption of principal substance and/or gating agent. In the case of other substrates, such as a printing blanket, a printing plate, a printing cylinder, a circuit board, a plastic sheet, a film, a textile or other sheet, a planar or curved surface of a wall, or other member, etc., the surface to which the principal substance is to be applied may be suitably prepared, processed, treated, machined, textured, or otherwise modified, if necessary or desirable, to aid in and/or block transfer of portions of the principal substance, as desired.

Still further, the nip pressure of the roller(s) and the compressibility characteristic of the roller(s) at which the principal substance is applied to the substrate may be varied to control image quality as well as the compressibility characteristic of the nip roller. Also, rolls or cylinders having a textured surface may be used to control the application of the principal substance to the substrate, as desired. Examples of cylinders having such a textured surface include a gravure cylinder having either a regular or irregular pattern of cells engraved thereon (by any known process e.g., diamond engraving, electron beam or laser engraving, acid etching, etc.) and an anilox roller used in conventional flexographic printing. In the latter case, an anilox roller with cells at a uniform or non-uniform line screening may be used. In specific examples, anilox rollers having resolutions between 600 lines per inch (lpi) and 3,500 lpi may be used, wherein the volume of each cell is related in some fashion to the drop volume of the ink jet heads that apply the gating agent. For example, the cell volume may be substantially equal to the drop volume of the particular ink jet head of the printing system. Alternatively, the cell volume may be selected so that gating agent rises slightly above the cylinder surface when a drop of gating agent is deposited into a cell (this may be desirable to aid in subsequent removal of the gating fluid upon contact with the paper or another substrate). Still further, or in addition, the volume of the drops of gating fluid could be adjusted to control the amount of ink transferred into each cell, thereby affecting grayscale. In the case of the HP ink jet head noted above, an anilox roller may be used having a resolution of 600 lpi to accommodate the 14 pl drop size emitted by such head. Alternatively, an anilox roller having a resolution greater than or lesser than 600 lpi may be used with the HP head such that each drop emitted by the head is deposited into multiple cells or occupies a portion of a cell, respectively. In any event (i.e., whether an anilox roller of particular resolution(s) is used or a gravure cylinder having cells of particular size(s) are used), gating agent is selectively jetted by the ink jet head(s) onto the textured roll or cylinder and such agent is retained thereon whereby lateral spreading of the gating agent is minimized/prevented by the constraining action of the walls forming the cells. Principal substance may thereafter be applied in a non-selective manner to the roll or cylinder, whereupon such principal substance flows to the non-wetted portions of the roll or cylinder. The roll or cylinder may then be used to transfer an image to the substrate, such as a web or sheet of paper, or an intermediate surface, as desired.

In these embodiments, the shape(s) and/or depths of the cells (the cell shapes may be the same or different on the roll or cylinder, as may the cell depths), may be optimized to the gating agent based on the surface energies of the gating agent and roll or cylinder surface and/or may be selected based upon another physical process parameter. Still further, one may use a roll or cylinder with cells arranged according to a random or pseudo-random screen, if desired.

A further approach using a gravure or anilox cylinder or roll differs from the foregoing in that all cells are initially indiscriminately filled with a first substance (preferably a fluid), prior to jetting, to a level where contact with paper or another further substrate would not draw the substance from the cells. Thereafter, selective application of a different or the same substance to one or more cell(s) increases the volume in such cell(s) in such a way as to enable contact with the paper or other substrate and selectively transfer at least some, if not a majority of the volume of the substance(s) in such cells. In these embodiments a small amount of jetted fluid can impact the transfer of a larger amount of cell volume, which may be required to achieve proper color density in a gravure-like application. This methodology also has the advantage in that more traditional gravure ink can be used to initially fill the cell.

Figures 25A, 25B, 25C:
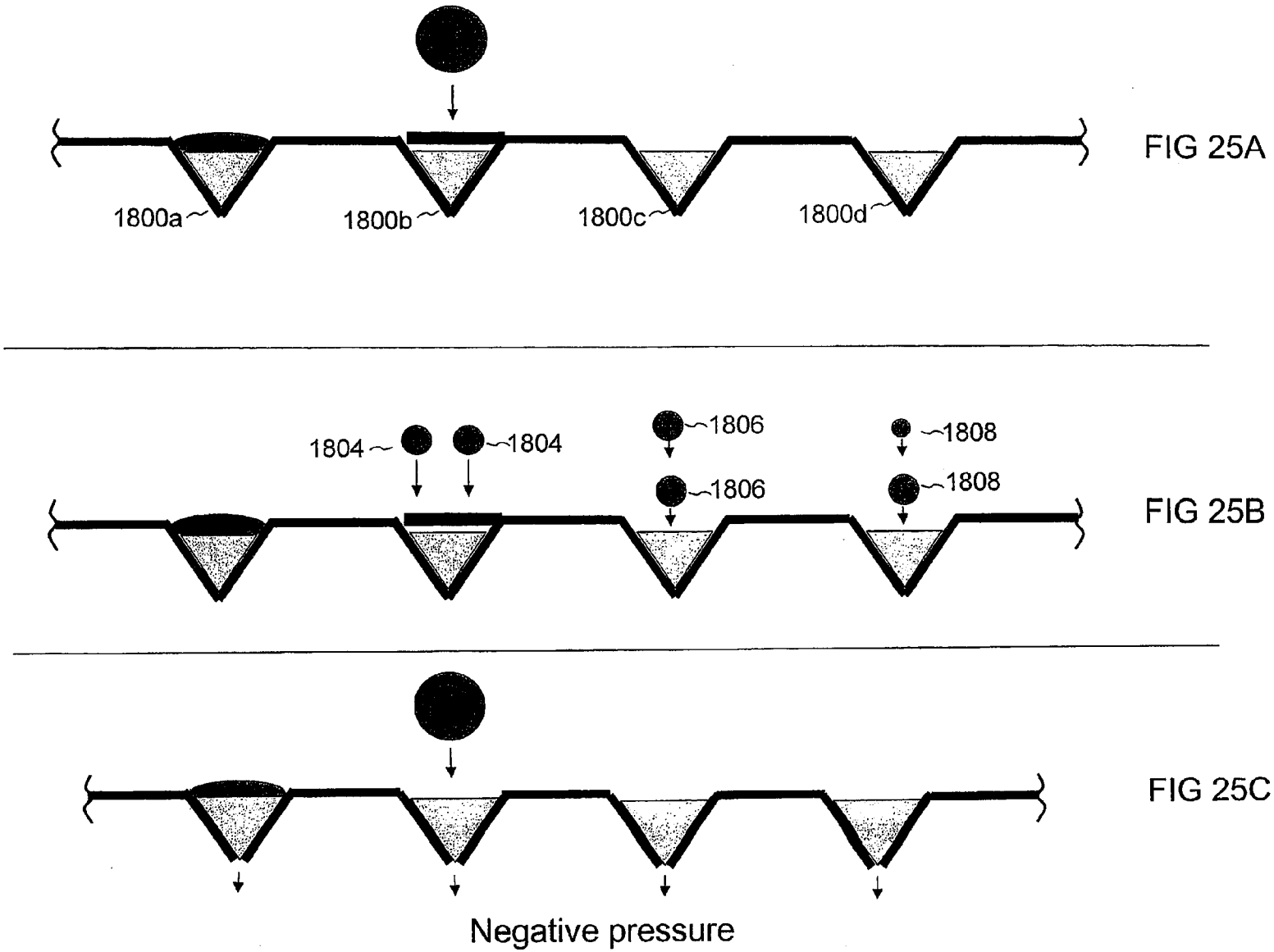
FIGS. 25A-25C are diagrammatic views of alternative methods according to further embodiments.

These embodiments are illustrated in FIGS. 25A, 25B, and 25C, in which a cylinder 1798 is created with pre-etched cells 1800 preferably, although not necessarily, in a regular (screened) pattern. After fluid(s) have been indiscriminately and selectively applied as described above, contact with the further substrate enables transfer of cell contents to the further substrate via surface tension between the cell contents and the further substrate.

In FIG. 25A, cells 1800*a*-1800*d* are filled with a first substance, such as fluid colorant, with a meniscus (not shown) located sufficiently below an outer cylinder surface 1802 to prevent transfer of the cell contents to a substrate if such substrate were brought into contact therewith. One drop (FIG. 25A) or multiple drops (FIG. 25B) of a second substance (which may be different than the first substance or identical thereto) are added to selected cells by one or more ink jet heads to create a meniscus in each such cell just below, even with, or slightly above the outer cylinder surface 1802 so that contact of the cylinder 1798 will cause transfer of the cell contents with the other substrate. In the case of the cell 1800*b* as shown in FIG. 25B, two or more drops 1804 are deposited into such cell by different nozzles of one or more ink jet heads. A different approach is illustrated in FIG. 25B with respect to the cell 1800*c* wherein multiple drops 1806 of uniform size are deposited therein from a single nozzle. A still further methodology is shown with respect to the cell 1800*d* wherein multiple drops 1808 of different sizes are deposited therein from a single nozzle.

In FIG. 25C, all cells 1800*a*-1800*d* are partially or fully filled with the first substance and a negative relative pressure or a positive relative pressure is used to control the amount of second fluid that must be deposited in a cell and/or to control the amount of the cell contents that are transferred to the further substrate. In the illustrated embodiment, a negative relative pressure reduces the level of the first substance below the surface 1802 during and/or after indiscriminate application of such substance thereto. In an alternative embodiment, a positive relative pressure is applied to the cells during application of the first substance thereto. The relative positive pressure may be removed from the cells before selective application of the second substance thereto so that the first substance in the cells settles to the bottom of the cells 1800. The second substance is thereafter selectively added in the fashion described in connection with FIGS. 25A and 25B to raise selected cell levels to ensure transfer of such cell contents to the further substrate. Alternatively, the relative positive pressure may be maintained during application of the second substance and, possibly, during transfer of cell contents to the further substrate to assist in such transfer.

In the preferred embodiment, the first substance is an ink and the second substance is a solvent for the ink. Alternatively, the two substances could be ink alone or any two similar or dissimilar materials that mix or do not mix on contact with one another. Still further, each drop of the second substance could be large enough to flow into multiple cells, if desired.

In a more general sense, the gating agent may be used to accomplish blocking or aiding the application of the principal substance by removing or blocking or applying the principal substance in image or non-image areas, removing an aiding agent in non-image areas, preventing the application of the principal substance in certain or all areas, changing the physical or chemical properties of the gating agent or principal substance (such as changing the viscosity or surface tension of the gating agent or principal substance) to affect the application of the gating agent or principal substance, any combination of the foregoing, or by any other suitable method.

The gating agent may be, in a further embodiment, a blocking agent that may be disposed on a surface to increase the attractive forces of the principal substance in non-image areas of the surface, wherein the attractive forces between the principal substance and the blocking agent on the surface are greater than the attractive forces between the principal substance and the substrate, thereby blocking the application of the principal substance to the substrate in non-image areas. In another instance, the blocking agent may be applied to the surface to decrease the attractive forces between the principal substance and the surface in non-image areas after an application of the principal substance to the surface to aid in cleaning the surface before additional principal substance is applied thereto. In other embodiments, the gating agent may be lipophilic or hydrophilic, depending on whether the desired result is for the gating agent to increase or decrease the attractive forces of the principal substance to the surface.

In yet other embodiments, the amount of the principal substance applied to the substrate may vary through use of a gating agent in the form of a barrier or a blocking agent with barrier qualities. In such embodiments, the application of the principal substance to the substrate may be blocked either completely or partially, so that the principal substance may be applied in intermediate levels to the substrate, as the barrier or the blocking agent with barrier qualities allows, effectuating a density gradient of the principal substance on the substrate in accordance with desired intermediate levels of principal substance application.

Further embodiments include applying the blocking agent to a surface before or after the principal substance is applied thereto and, optionally, selectively applying blocking agent to a substrate, and then imaging the substrate with the surface. For example, the blocking agent may include a material dispersed within it that is resistant to affinity with the particular principal substance. The blocking agent may then be applied to the surface and/or the substrate in non-image areas, with the material dispersed within the blocking agent being absorbed into and/or received and retained on the surface and/or on or in the substrate. Thereafter, when the surface is passed adjacent the substrate, the principal substance is transferred to the substrate only in those areas that do not contain the blocking agent, as the material dispersed within the blocking agent resists the application of the principal substance to the non-image areas.

Another alternate embodiment comprehends multiple applications of a blocking agent on or near a surface. In one instance, the blocking agent may be a copolymer with hydrophilic and lipophilic components, where the hydrophilic component tends to establish a bond with the surface and the lipophilic component tends to establish a bond with the principal substance. Regardless of the composition of the blocking agent, the blocking agent is selectively applied to the surface only in the non-image areas. The principal substance may then be applied indiscriminately to the surface, such that the principal substance is transferred to areas only where the blocking agent has not been applied. In an alternate embodiment, the principal substance is selectively applied in the areas between the patterned application of the blocking agent. A second application of the same or differently composed blocking agent may then be applied to the surface and/or the further substrate to be imaged, such as a paper web, by the surface. The second application of the blocking agent may be selectively applied in a discriminate fashion either over the first application of the blocking agent and/or the principal substance on the surface or to the further substrate. For example, a determination may be made where potential areas of quality degradation has or might occur (e.g., edges, borders, transitions in image density, or highlight areas) in the application of the principal substance to the substrate. Such a second application of the blocking agent could clear up the edges, borders, transition areas, or highlight areas of the principal substance as it is applied to a substrate, creating a more precise, or sharper, application of the principal substance. In the case of highlight areas, one might selectively apply gating agent to the surface before and to the surface and/or substrate after application of principal substance, such that the resultant combination produces a highlight imaged area that is accurately reproduced. One might apply smaller and/or fewer dots of gating agent to the surface during the initial application of the gating agent to prevent merger or interaction of closely-spaced dots of gating agent. Thereafter, the second application of gating agent may be selectively applied, preferably to the further substrate, in some or all of the areas of the further substrate where no principal substance is to be applied. This can promote more accurate transfer of principal substance in areas to be lightly covered with principal substance. This method of initially applying smaller and/or fewer dots of gating agent could also be used in areas other than areas to be lightly covered with principal substance.

Figure 23:
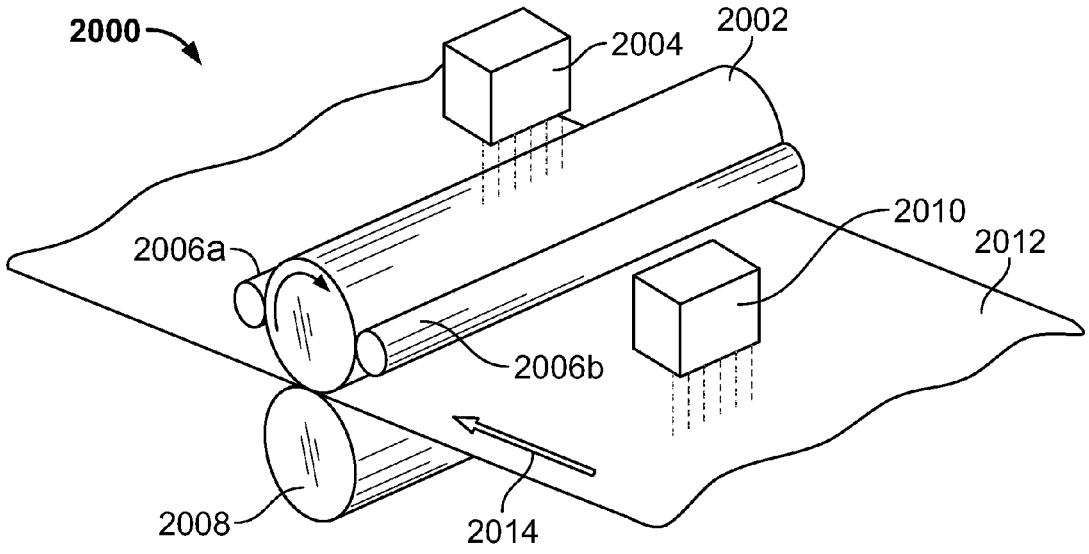
FIG. 23 is an isometric view of a print system that may implement one or more of the methods disclosed herein.

One embodiment of the method of applying smaller and/or fewer dots of gating agent is implemented by the printing deck 2000 of FIG. 23. The printing deck 2000 includes a blanket cylinder or other receiving surface 2002 and a first gating agent applicator 2004 disposed adjacent the cylinder 2002. The printing deck 200 further includes an inking system 2006 having a first and/or second ink train represented by cylinders 2006*a*, 2006*b*, an impression roller 2008, and an optional second gating agent applicator 2010 disposed upstream of the cylinder 2002. The printing deck 2000 is operational to print markings on a substrate 2012 in the form of a paper web, which moves in a web direction represented by arrow 2014.

Figure 24A:
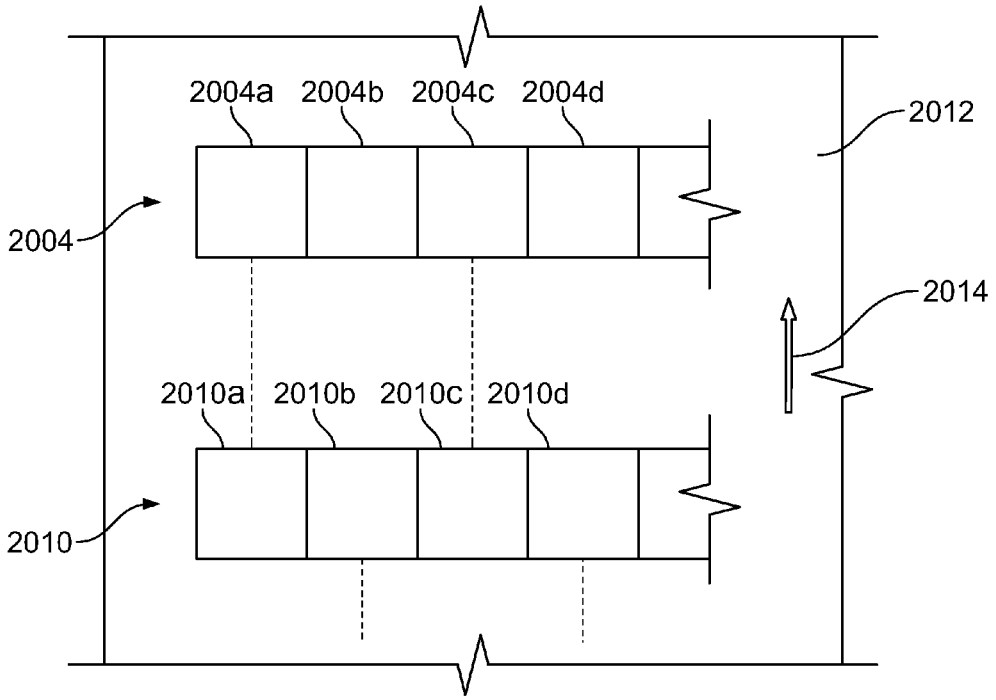
FIGS. 24A and 24B are diagrammatic views of applicators that may be used in the system of FIG. 23.
Figure 24B:
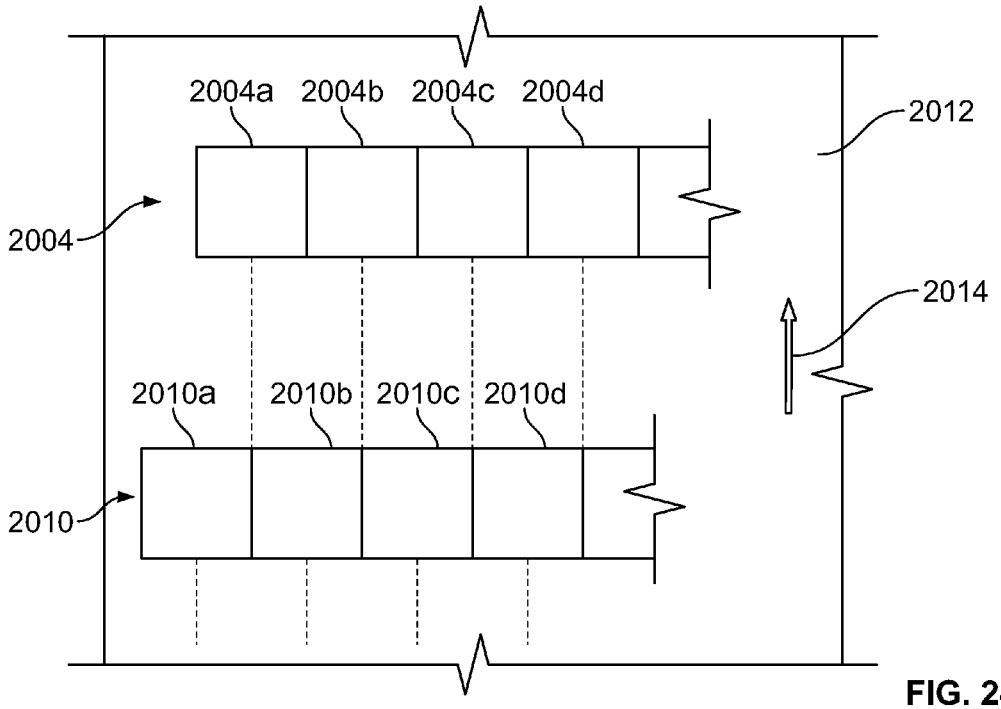

FIGS. 24A and 24B illustrate two arrangements of the applicators 2004 and 2010 for application of first and second gating agents to the substrate 2012. Referring first to FIG. 24A, each of the applicators 2004 and 2010 includes a series of representative nozzles 2004*a*-2004*d* and 2010*a*-2010*d*, respectively. In FIG. 24A, the applicators 2004 and 2010 are aligned in the sense that the nozzles 2004*a* and 2010*a* are disposed above a first longitudinal line parallel to one or both side edges of the substrate 2012, the nozzles 2004*b* and 2010*b* are disposed above a second longitudinal line parallel to and offset with respect to the first longitudinal line, etc. Some or all of the nozzles could be used to apply gating agent to the surface 2002 and/or substrate 2012. For example, during a first interval of a production sequence, the nozzles 2004*a*, 2004*c*, and successive remaining alternate nozzles of the applicator 2004 may be operable to selectively apply gating agent to the surface 2002. Also during such interval, only the nozzles 2010*b*, 2010*d*, and successive remaining alternate nozzles of the applicator 2010 may be operable to selectively apply gating agent to the substrate 2012. In a successive interval, only the nozzles 2004*b*, 2004*d*, and successive remaining alternate nozzles of the applicator 2004 and nozzles 2010*a*, 2010*c*, and successive remaining alternate nozzles of the applicator 2010 may be operable to selectively apply gating agent to the surface 2002 and the substrate 2012. Alternatively, any first subset of nozzles of the applicator 2004 and any second subset of nozzles of the applicator 2010 may be operable in one interval to selectively apply gating agent to the surface 2002 and/or the substrate 2012. Further, any third subset of nozzles of the applicator 2004 and any fourth subset of nozzles of the applicator 2010 may be operable in another interval to selectively apply gating agent to the surface 2002 and/or the substrate 2012, etc.

Alternatively, the applicators 2004 and 2010 may be arranged in a non-aligned configuration as seen in FIG. 24B. In such embodiment, the nozzles of the applicator 2004 are offset one-half pitch length with respect to the nozzles of the applicator 2010. Still further, the nozzles of the applicator 2004 may be offset any distance with respect to the nozzles of the applicator 2010. The nozzles of the applicators 2004 and 2010 may be operable in any fashion described with respect to FIG. 24A, but preferably, all the nozzles of the applicators 2004 and 2010 would be enabled for operation at all times to obtain optimal resolution.

In the embodiments of FIGS. 24A and 24B, the applicators 2004 and 2010 may be disposed at angle(s) other than 90 degrees with respect to the first and second longitudinal lines. Further, the applicators 2004, 2010 may undertake stitching of adjacent image portions and/or different images on a single substrate. Still further, the applicators 2004, 2010 may be operated either alone or in combination with other applicators to successively build up drop sizes on a surface. This may permit the range of available drop sizes to be increased.

Alternatively, or in addition, an aiding agent may be used that contains a material dispersed within it for promoting affinity to the principal substance. The aiding agent may be applied to the surface in image areas, with the material dispersed within the aiding agent being absorbed into and/or received and retained on the surface. The surface is passed adjacent a further surface having the principal substance disposed thereon and the principal substance is drawn to the first-named surface only in those areas that contain the aiding agent. Any of the embodiments of FIGS. 23, 24A, and 24B may be utilized with the aiding agent and/or blocking agent applied by one or both of the applicators 2004 and 2010. In any case, one or both of the applicators 2004 and 2010 may be replaced by any number of applicators for applying one or more aiding agent(s) and/or one or more blocking agent(s) at any point(s) in the production sequence. For example, one might apply a gating agent to a substrate, wherein the gating agent permits authentication and/or tracking of a subsequently produced product. The gating agent may be applied to a substrate in the form of indicia that identify lot number, sequence number, or other identification, the gating agent may be allowed to dry to the touch but may be formulated to continue to be effective as a blocking or aiding agent in such state, and the substrate may be processed at a later time to create a final product. The indicia may be sensed before, during, or after the product is produced to track the substrate and/or the finished product. The gating agent may be visible or invisible to the human eye once dry, and the gating agent and/or the ink (or other principal substance) affected by the gating agent may become visible or invisible once the final product is produced.

Further embodiments include dilution of the principal substance with a relatively low viscosity fluid to decrease the attractive forces of the principal substance to a surface, or addition of a relatively high viscosity fluid to increase the attractive forces of the principal substance to a surface. Decreasing the attractive forces of the principal substance decreases the binding strength between the principal substance and a surface to which it is bound. A decreased binding strength aids in the release of the principal substance from the surface. Alternately, increasing the attractive forces increases the binding strength between the principal substance and the surface to which it is applied. An increased binding strength impedes the release of the principal substance from the surface to a substrate during subsequent image transfer.

Figure 18:
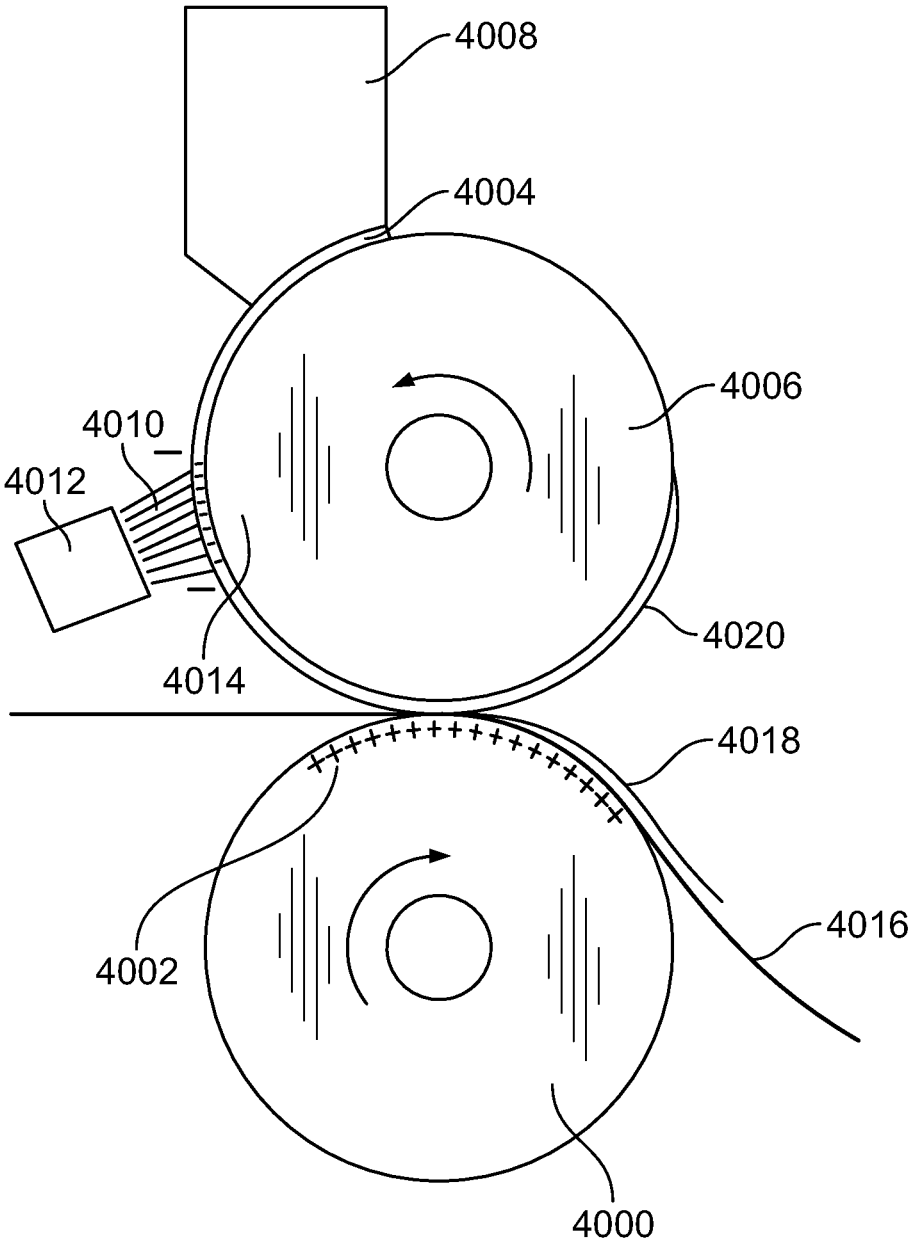
FIGS. 18-21 are side views of illustrative embodiments of an apparatus for controlling application of a substance to a substrate.

In other embodiments, electrostatic charge is used to aid in application of the principal substance to the substrate. For example, an impression cylinder 4000 may have an electrostatic charge 4002 applied thereto, as shown in FIG. 18. The electrostatic charge 4002 may be positive or negative and may be applied to a portion of the impression cylinder 4000 or to the entirety thereof. The principal substance, for example, an ink 4004, is uniformly applied to a plate or blanket cylinder 4006 by an ink train 4008, and the ink 4004 binds to the blanket cylinder 4006. An electrostatically charged gating agent having a charge opposite that applied to the impression cylinder 4000, for example, a negatively charged aqueous solution 4010, is selectively sprayed from an ink jet head 4012 over an image area 4014 on the blanket cylinder 4006. The aqueous solution 4010 is formulated to bind to the ink 4004 with a binding strength greater than that between the ink 4004 and the blanket cylinder 4006. A substrate, for example, a web of paper 4016, is guided between the impression cylinder 4000 and the blanket cylinder 4006. Each of the impression cylinder 4000 and the blanket cylinder 4006 rotates such that respective surfaces thereof are moving in a common direction proximate to the web of paper that is guided therebetween. For example, the impression cylinder 4000 rotates clockwise as shown and the blanket cylinder 4006 rotates counterclockwise as shown. As the blanket cylinder 4006 rotates, the negatively charged aqueous solution 4010 that covers the image area 4014 is electrostatically attracted to the impression cylinder 4000. The negatively charged aqueous solution 4010 separates from the blanket cylinder 4006 pulling the ink 4004 in the image area 4014 on the blanket cylinder 4006 onto the web of paper 4016 to form an image 4018. Residual ink 4020 that is not covered by the negatively charged aqueous solution 4010 remains bound to the blanket cylinder 4006. Further rotation of the blanket cylinder 4006 allows the ink train 4008 to uniformly replenish the ink 4004 carried thereon. The impression cylinder 4000 may remain charged throughout the process just described or may be charged and discharged to correspond with the proximity of the image area 4014 thereto.

Figure 19:
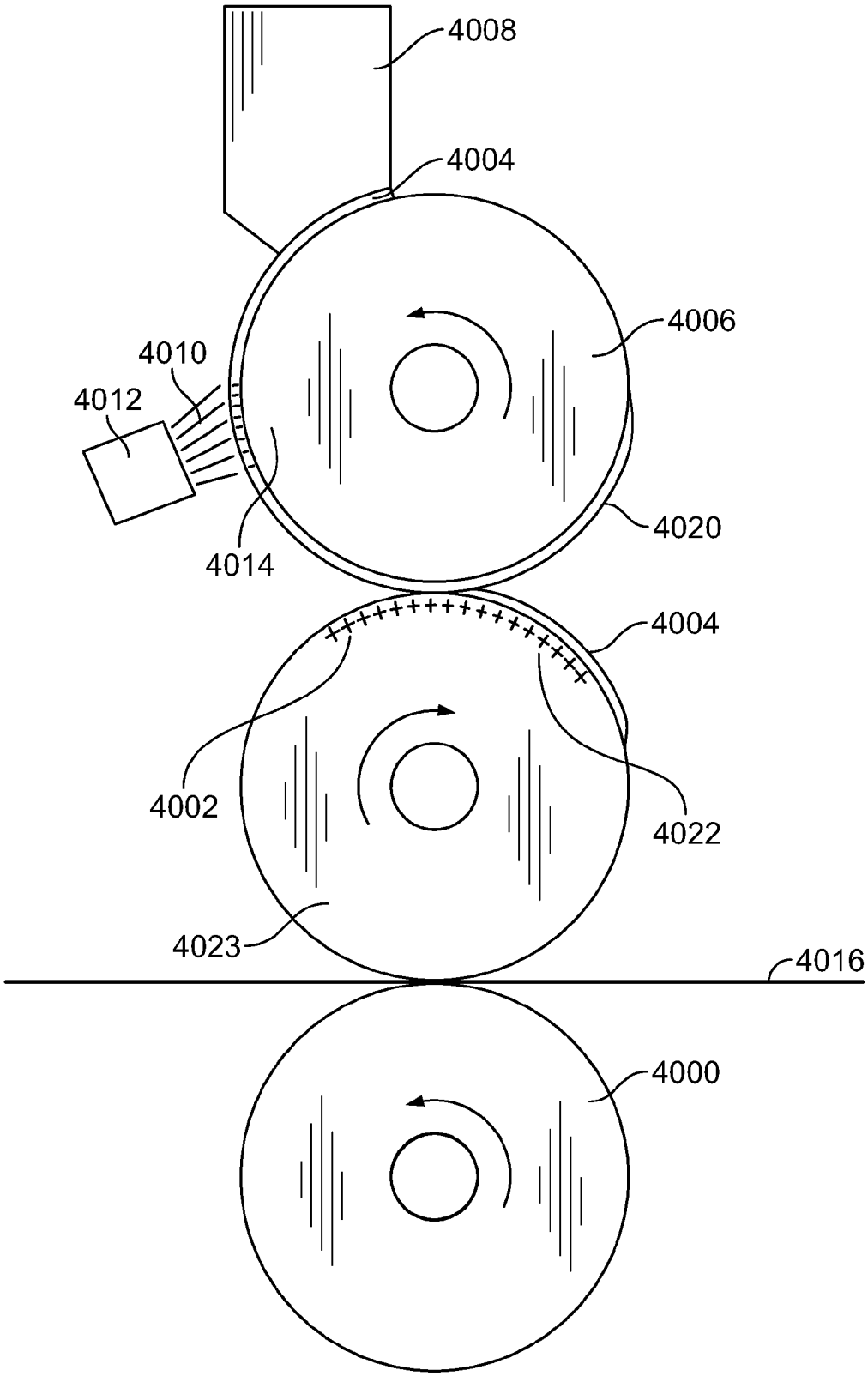

A further embodiment as shown in FIG. 19 is substantially similar to the embodiment described in FIG. 18. However, in this embodiment, the web of paper 4016 does not pass between the impression cylinder 4000 and the blanket cylinder 4006. Also, a further cylinder 4023 is interposed between the blanket cylinder 4006 and the impression cylinder 4000. As the blanket cylinder 4006 rotates, the negatively charged aqueous solution 4010 that covers the image area 4014 is attracted to a positively charged portion of the further cylinder 4023 by electrostatic attraction. The negatively charged aqueous solution 4010 separates from the blanket cylinder 4006 pulling the ink 4004 in the image area 4014 thereon onto the charged area of the further cylinder 4023. The web of paper 4016 is passed under the further cylinder 4023 through a nip formed with the impression cylinder 4000 and the ink 4004 is transferred from the further cylinder 4023 to the web of paper 4016. It is contemplated that the further cylinder 4023 may have the positive charge applied thereto only in a region adjacent the blanket cylinder 4006. This region has the electrostatic charge applied thereto before the ink 4004 is transferred from the blanket cylinder 4006 to the further cylinder 4023. After the ink 4004 is transferred, and as the further cylinder 4023 continues to rotate, the electrostatic charge 4000 may be discharged before the ink 4004 is transferred to the web of paper 4016.

Transfer of the ink 4004 from the blanket cylinder 4006 may be aided by using a silicone cylinder 4023 to create a "waterless" system, as described previously herein. The cylinder 4023 may have a silicone surface that is entirely oleophobic. As known in the art of waterless lithography, such cylinders may be developed (e.g., etched) such that portions of a surface of the cylinder become oleophilic. Because the silicone is naturally oleophobic, there is no need to wet the cylinder before applying ink to the cylinder surface.

The embodiments described in FIGS. 18 and 19 include the further advantage of not requiring a cleaning of the blanket or the cylinder 4006, 4023. Preferably, all of the ink and negatively charged aqueous solution 4010 is transferred from the blanket cylinder 4006 or the cylinder 4023 to the web of paper 4016.

As previously described herein, there may be a wide variety of methods to apply a principal substance, for example an ink, to a substrate, for example a web of paper. Each method may include one or more intermediate steps as illustrated by the embodiment described in regard to FIG. 19. Each intermediate step may also include the application of one or more layers of the principal substance and the gating agent, for example the ink 4004 and the negatively charged aqueous solution 4010, respectively. Each intermediate step further includes a receiver surface on which the principal substance is applied or collected. The final destination of the principal substance, for example, the ink 4004, may be the web of paper 4016. The ink 4004 may be applied to the web of paper 4016 from the cylinder 4023 or directly from the blanket cylinder 4006 (as shown in FIG. 18). The blanket cylinder 4006 does not have a plate attached thereover and therefore has a continuously smooth circumferential surface lacking a seam that is common on a typical plate cylinder. The blanket cylinder 4006 is typically made of rubber or some other hard yet flexible material. In the case of the cylinder 4023, such cylinder may be a conventional plate cylinder, or may be a seamless or a sleeved cylinder, as desired.

If a plate cylinder is utilized in an intermediate step to apply ink to the blanket cylinder 4006, the plate cylinder may have ink 4004 applied thereto from an ink train 4008. The plate cylinder may also have a silicone surface that is entirely oleophobic and that therefore does not require wetting before the application of ink thereto.

In addition, another embodiment may use an electrostatically charged blocking agent. The principal substance may be disposed on a surface and covered by a blocking agent in non-image areas, charged either positively or negatively, but the same polarity as the charge applied to a substrate. As the surface is brought adjacent the substrate, portions of the principal substance covered by the blocking agent will be repelled away from the substrate and remain on the surface, while the portions of the principal substance not covered by the blocking agent will be applied to the substrate, creating a desired image on the substrate.

In yet other embodiments, the gating agent(s) used to control application of the principal substance to the substrate may be combinations of blocking and aiding agents. In one example, the principal substance is disposed on a surface and is covered in non-image areas by a blocking agent that blocks application of the principal substance to the substrate. In image areas, the principal substance is covered by an aiding agent that tends to establish a bond with the principal substance to aid in application onto the substrate. Alternately, the gating agent(s) may be disposed on the surface and covered by the principal substance. In one example, a lipophilic blocking agent is selectively disposed on non-image areas of the surface and a hydrophilic aiding agent is selectively disposed on image areas of the surface. The principal substance is then disposed on top of the layer created by both gating agents. The layer of both gating agents having a consistent height on the surface may prevent migration between the principal substance and the aiding agent. As the surface is moved adjacent the substrate, the blocking agent keeps the principal substance from being applied to the substrate, while the aiding agent allows application of the principal substance to the substrate. In any event, the constituents(s) that are used during a production sequence (including the gating agent(s) and other constituents) should be compatible in the sense that undesirable results and consequences (such as the production of undesirable compounds or conditions) are avoided.

In alternate embodiments, the surface may be a lithographic plate, cylinder, or the like having a portion that may be used for controlling application of the principal substance to the substrate by applying variable configurations of the principal substance to the substrate. In such embodiments, variable symbology, encoding, addressing, numbering, or any other variable tagging technique may be utilized in the portion of the surface reserved for controlling application of the principal substance. The principal substance is first disposed on the surface indiscriminately. Before the substrate is passed near the surface for application of the principal substance, a blocking agent is selectively applied to the substrate in an area where the reserved portion of the surface will subsequently be moved adjacent the substrate so as to allow the desired configuration, or image, of the principal substance to be applied thereto. In a more general embodiment, the substrate may be brought adjacent one or more than one surface having similar or differing principal substances disposed thereon, wherein blocking and/or aiding agents are selectively transferred to the substrate from the surfaces in the reserved portion. In one embodiment, a magnetic ink is transferred from one of these surfaces to the substrate (e.g., a paper web). One or more non-magnetic inks may be transferred from the same surface or from one or more additional surfaces. A gating agent may be used to either block or aid application of the magnetic ink to the paper web in a desired configuration in the reserved portion thereof using any of the techniques for using blocking and aiding agents described above. The result is a printed paper web having markings of magnetic ink (such as a MICR marking or other encoded information) that may be changed from impression-to-impression.

According to a still further embodiment, the gating agent is selectively applied to a receiver surface by one or more ink jet heads and attracts or blocks an intermediate fluid, such as traditional fountain solution, which is applied indiscriminately to the receiver surface but gated by the gating agent, such that the fountain solution adheres selectively to the receiver surface prior to application of ink thereto. In this embodiment, the gating solution is formulated to interact with and control the fountain solution, as opposed to controlling the ink. Additional embodiments may neutralize or compromise the fountain solution, or selectively enable removal thereof from the receiver surface. In more general terms, these embodiments comprehend the use of a selectively applied gating solution together with indiscriminately applied fountain solution and ink wherein the gating agent controls where the fountain solution is maintained.

Any of the aqueous jet systems as described above with respect to FIGS. 2-6 and 8-10 may include any of a number of types of jet cartridges having any number of jet holes therein. Further, there is flexibility in selection of a gating agent for use in the jet systems, including aqueous gating agents, as well as non-aqueous gating agents. The gating agent may include one or more surfactants or may be temperature or vacuum controlled to produce drop size and viscosity characteristics that are favorable to produce a high quality image.

One of the advantages of using the concepts for processing variable and static print jobs as have been described herein is the inherent speed associated with a conventional lithographic press. In fact, press speed compared to a conventional lithographic press is limited by the speed at which an image area can be created, which in turn depends upon the method of creation of the image area. Such methods have been described herein to include application of a gating agent to create the image area. The gating agent may be a lipophilic or hydrophilic solution, or some other solution that may have an electrostatic charge applied thereto. The gating agent may also be an electrostatic charge applied to a portion of a cylinder, as illustrated by the embodiment described in regard to FIG. 19. The maximum speed at which any of these gating agents is applied to one or more cylinders of the press may limit the speed of operation of the press.

Ink jet cartridges eject droplets of ink by various methods depending on the type of cartridge, as discussed in detail hereinbefore. Each type of cartridge has a maximum frequency at which droplets may be generated for ejection. This maximum drop generation frequency for a single ink jet cartridge may limit the speed at which the press may be operated. Multiple ink jet cartridges may be used to overcome this frequency limitation. For example, two ink jet cartridges may be used to eject droplets out of phase with one another to attain double the drop generation frequency of a single cartridge, and therefore double the press speed. Following this logic, three or more ink jet cartridges may be used to eject droplets out of phase with one another to further increase the press speed. More generally, multiple ink jet cartridges may be positionally staggered perpendicular to or at any other angle relative to the direction of travel of a receiving surface to increase resolution of the ejected droplets. A larger diameter target substrate in the form of an imaging blanket or cylinder may be used onto which the gating agent is applied, wherein the increased diameter permits multiple ink jet heads to be arrayed adjacent thereto. Ink jet heads having multiple channels may be used, wherein each channel is normally intended to apply a particular color of ink to a substrate. In such a case the ink jet head can be used to supply gating agent(s) via each channel (either at the same times or at different times during a production sequence) so that higher resolution, higher run speeds, or another desirable result can be achieved.

For most operating conditions wherein an ink jet cartridge may be utilized, the ejection of a droplet from the cartridge is effectively an instantaneous event that produces a spot of ink of predetermined size on a target substrate. In reality, the ejection of a droplet from an ink jet cartridge is not an instantaneous event, but is in fact a transient event, having a beginning, a middle, and an end. If a target substrate is moving at a high speed, the ink droplet may strike the substrate to form a spot of ink having a tail trailing the spot in a direction opposite to the direction of travel of the substrate. This phenomenon, known as tailing, is a direct result of the transient nature of the droplet generation. Tailing at high press speeds may limit the effective speed of the press due to print quality concerns. However, certain gating agents, when used with particular ink jet cartridges may inhibit or alleviate the tailing of the ejected droplets, thereby removing this effect as a limiting factor on maximum press speed. Also, the positioning of the ink jet heads relative to the target substrate may reduce tailing. For example, the ink jet heads may be disposed at an angle relative to the target substrate such that drops travel along a path that is not along a radius of the target substrate.

Because the generation of an electrostatic charge on one or more of the press cylinders may also limit the speed of operation of a press, it is contemplated that press cylinders may be charged internally using a known high speed process. For example, a laser or light emitting diode (LED) array may be embedded within a press cylinder fabricated of known materials, including, for example selenium, to selectively charge or discharge selected portions of the cylinder, as discussed in regard to FIG. 19.

The utility of the concepts described herein is not limited only to variable jobs, wherein, for example, successive different pages of a book are printed. The concepts are also useful for short run static jobs, which would be much more expensive and time consuming to produce using traditional fixed plate lithographic methods. Traditionally, each short run job would require a plate to be produced bearing the short run image areas, and when the short run is finished, the press would have to be stopped to have the plate changed to a different plate to be used in the next short run. The methods of creating an image area as discussed herein allow the press to be run continuously while having the capacity to update the image area at any point during the run.

The ability to update an image area without stopping the press also facilitates another capability that is impossible using a traditional press, such as an offset or gravure press. The embodiments disclosed herein permit pages of different sizes to be imaged by a cylinder, even pages longer than the circumference of the imaging cylinder. In traditional offset page sizes are restricted depending on the size of the cylinder, i.e., based on the integral number of pages that can fit about the circumference of the cylinder. That gives a set size page, which can reduced by trimming and creating waste to some extent, but essentially a press is purchased and used for certain size work. In the present embodiments, on the other hand, the variable length cutoff capability overcomes this limitation. This ability is useful for sequentially producing books of different sizes, for example, in postal sort order, so that postal discounts can be obtained. In the case of a printed image which is to be longer than the circumference of the cylinder, a leading portion of the image that has already been printed is updated while a trailing portion of the image is printing. This continuous updating/printing methodology may be used to print long banners or strips of an exceedingly large print area that might otherwise require a much larger press apparatus.

Alternatively, multiple pages can be resized on-the-fly to be printed by a single cylinder during a single impression. An example of where this might be useful is where larger images are to be reduced in size and printed together on a single page, which may be enlightening for side-by-side comparisons or contrasts of the images.

If ink and an associated gating agent are entirely transferred from the cylinder to the paper in such a continuous variable cut-off application, then no intermediate cleaning of the leading portion is required because application of the image onto the paper concurrently cleans the cylinder. However, if a method is employed wherein the cylinder does require intermediate cleaning, a cleaning solution engineered for that purpose may be selectively applied to the cylinder to clean residual matter from the leading portion of the image area before additional imaging is applied thereto. The cleaning solution may be sprayed uniformly over the leading portion of the image area as it comes around on the cylinder. However, it is contemplated that a cleaning solution that is applied only where desired or needed is advantageous because such precise application results in less residual cleaning solution to collect. To facilitate precise guidance, the cleaning solution may have an electrostatic charge applied thereto interacts with an electrostatic charge applied to the cylinder. The cylinder may be electrostatically charged from within, for example by a laser or LED array as described previously. Internal application of the electrostatic charge as described may target a desired portion of the cylinder and may be accomplished as quickly as possible so as to have no effect on the press speed.

In a still alternate embodiment, an imaging element, such as a plate, cylinder, blanket, etc. could be selectively cleaned between imaging cycles thereof based upon the differences between successive images. This could be accomplished by the selective application of cleaning solution to the imaging element using one or more ink jet heads (which may be the same ink jet heads that apply gating agent to the imaging element or one or more separate heads) during the interval between application of successive images only to those areas where image changes are to occur.

In a typical cyan, magenta, yellow, and key (CMYK) printing press, each of the four colored inks is applied to the image individually to build the overall image. This traditional methodology is applicable to the concept of a continuously updating image area as well. The continuously updated image may just be repeated once for each applied colored ink. Therefore, as in a traditional system, it may be important to precisely align the application of each color with respect to the previous color to provide sharpness and inhibit a blurred image. Alignment of each image area of a successive color may be facilitated by electronic registration of the image areas. Such a system operates by a registration mark being applied to a substrate, such as a web of paper, just ahead of or possibly as part of an image area in one or more parts of the image area. An electronic sensor disposed above the web of paper may optically or otherwise sense the registration mark as it passes thereunder. The timing control of when to update the image area may be matched to the position of the web of paper on each of the presses as sensed by the sensors. This methodology eliminates the need for servo motors, wherein the exact position of each motor is known and coordinated. Instead, it is the precise position of the web of paper itself that is tracked by the electronic registration marks and sensors. Further, such a method may be used to account for stretching of webs of paper that may invariably occur when inks and other fluids are applied to the paper. A system that utilizes multiple registration marks both within and preceding an image area may be used to account for stretching to very high levels of accuracy that may only be limited by the number and spacing of the registration marks or accuracy limitations inherent to creation of the image area.

If desired, the above-described registration methodology may be replaced or augmented by a registration methodology that uses other sensors, devices, controlling apparatus, etc.

Ink jet head(s) or cartridge(s) may be positioned depending on the desired functionality thereof in a number of positions relative to components of the press. As described previously, one or more ink jet cartridges may be positioned to apply a gating agent ejected therefrom onto a plate cylinder, a blanket cylinder, a pre-plate cylinder, or onto the web of paper. Further, one or more ink jet cartridges may apply a cleaning solution to one or more image areas of the plate cylinders or to the blanket cylinder. The ink jet cartridge(s) may further be positioned relative to each of the components, for example, above or below each component, or ahead of or behind each component relative to the path that the web of paper takes through the press.

An ink jet cartridge employed to clean an image area may be positioned following an ink train. The ink jet cartridge may remain idle so long as the image area is static. However, between application of a last impression of a first static job and application of a first impression of a second job, the ink jet cartridge applies a cleaning solution to the image area. This application of the cleaning solution assists the process of loosening any latent image ink of the first job so that a cleaning mechanism, for example the cleaning mechanism 212 as described in regard to FIG. 2, has a better chance of removing the ink. The cleaning solution may be formulated to be primarily a cleaning solution, but may also be formulated to have any of the properties of a gating agent as discussed herein. When formulated primarily as a cleaning solution, multiple ink jet cartridges may also be used to apply an additional spray or sprays that may further aid in the ink removal process by hastening removal of built up ink.

Figure 20:
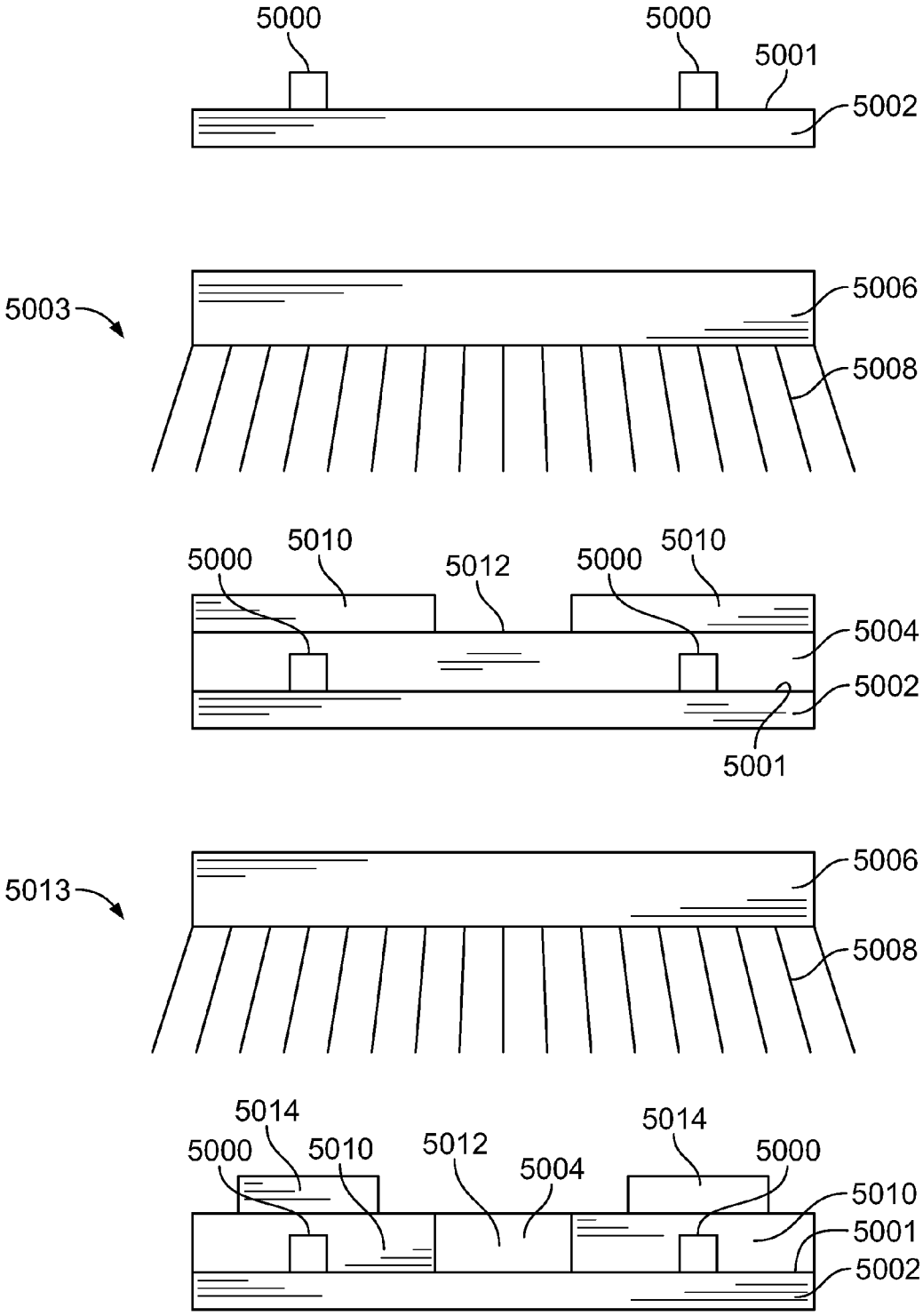

Referring to FIG. 20, two alternative approaches to cleaning a latent image 5000 with a cleaning solution utilize a blocking agent, for example, a fountain solution, to temporarily cover the latent image 5000. The latent image 5000 is illustrated in FIG. 20 as a pair of parallel lines viewed along a circumferential surface 5001 of a cylinder 5002. These alternate approaches allow the press to continue operating without any down time for cleaning of the latent image 5000. In a first alternate approach 5003, following the application of the last impression of a first static job from the cylinder 5002, ink 5004 is uniformly applied to the cylinder 5002 from an ink train (not shown) and an ink jet cartridge 5006 applies a blocking agent 5008 to form a negative image 5010 over the ink 5004 to create a new image area 5012. The press may therefore continue to operate with the latent image 5000 on the cylinder 5002 blocked or covered by the negative image 5010 of the blocking agent 5008 until the latent image 5000 is entirely removed from the cylinder 5002.

In a second alternate approach 5013, following the application of the last impression of a first static job from the cylinder 5002, the ink jet cartridge 5006 applies the blocking agent 5008 to form the negative image 5010 on the cylinder 5002 to create the new image area 5012. The ink 5004 is then applied in the new image area 5012, followed by a second layer 5014 of the blocking agent 5008 selectively applied to the cylinder 5002 to ensure coverage of the latent image 5000 until the latent image 5000 is entirely removed.

Removal of the latent image 5000 as described above may proceed concurrently with the continued operation of the press utilizing either of the two alternate approaches just described. On each rotation of the cylinder, the latent image area may have the cleaning solution precisely applied thereto and the cleaning mechanism 212 may brush and wipe the latent image area, followed by application of the ink 5004 and the blocking agent 5008 as in the first alternate approach, or application of the blocking agent 5008, ink 5004, and a second layer 5014 of the blocking agent 5008, as in the second alternate approach. Complete removal of the latent image 5000 may require several rotations of the cylinder 5002. Although applying the cleaning solution to the image area may be more effective to completely eliminate the ink in the latent image area in a timely fashion, each of the alternative approaches may allow the press to produce a high quality image of the second job immediately by covering the latent image 5000 from the first job.

A still further option is to modulate/control the temperature of one or more process parameters. For example, one might elevate the temperature of the gating agent upon application thereof to a surface to improve adherence and facilitate dispensing thereof. Alternatively, or in addition, the surface may initially be heated during application of gating agent to control adhesion, drop shape/size, and the like, and/or the surface may be chilled (or, in the case of other constituents, heated) at some point in the process once the gating agent is applied thereto so that the viscosity of the gating agent is increased, thereby reducing spread of the gating agent into non-wetted areas.

One could further use multiple different liquids dispensed by separate inkjet devices that, when applied together, create a gating agent that has improved adherence and/or viscosity and/or other desirable characteristic. The liquids may be applied at the different or same temperatures, pressures, flow rates, etc.

Yet another embodiment comprehends the use of two or more arrays or ink jet heads for selectively applying gating agent alone, or for selectively applying gating solution to one or more areas of a surface and, optionally, ink to one or more remaining areas of the surface, wherein one or more of the arrays can be independently removed and switched over while the press is running, or, reconfigured (in terms of position) for the next succeeding job (e.g., where regional customization is required).

Due to variations in ink tack from print unit to print unit, one may undertake a successive modification of gating agent characteristics from unit to unit to effectively optimize ink transfer by each unit.

If desired, the gating agent may be applied to a roll or cylinder of small diameter wherein the speed of the roll is significantly higher than in a conventional process. This high rotational speed forces applied droplets to extend outwardly due to centripetal forces at the surface of the small roller. This effect, in turn, reduces the contact pressure required to transfer liquid to another surface, such as a paper web, thereby minimizing spread of gating solution into non-wetted areas and permitting reduction in spot size. Thus, quality and resolution may be improved.

Different physical angles for screening may be used, e.g., different angles relative to vertical may be employed to affect the shape of dots of the gating agent. Further, a delay may be electronically interposed in the application of drops of gating agent to simulate screening, and/or an offset alignment may be used to eliminate overlap. The distance of the ink jet heads from the surface onto which gating agent is to be applied may be varied to vary dot sizes for different colors.

One could direct air from an air source to a surface on which gating agent is applied to change drop structure to reduce tailing, reduce film thickness, or interact with liquid. In this case, one could employ a liquid gating agent that is sensitive to air and supply same in an enclosed environment, such that air reacts with it after application to promote a favorable effect.

As noted above, one could apply liquid gating agent to a plate and thereafter spray diffuse particles to adhere to moistened area, and then transfer to paper. As contrasted with the embodiment described above, the gating agent and the diffuse particles need not be limited to powdered colorant and solvent, but may be any liquid and any particles (or any substances of any type, whether solid or fluidic).

An optional process step comprehends the periodic or aperiodic cleaning of system components, either in-line or off-line. Still further, ink emulsification, color density, or any other feedback parameter may be monitored to determine the volume of gating agent to spray to maintain color quality, and when to change ink supply. One or more process parameters may be sensed and used to control the distance of the ink jet head(s) from a roll, plate, or other substrate so that dot size is controlled.

Still further, one may utilize an intermediate roll with a pitted surface onto which the gating agent is applied to reduce spreading prior of same to application thereof to a blanket. Alternatively, or in addition, the ink jet heads may apply gating agent (and, optionally, ink) to a large diameter roll that rotates at a slow rotational speed as compared with conventional printing processes so that a large number of ink jet heads can be placed adjacent the roll. As a still further alternative, gating agent may be selectively applied by ink jet heads to a plate having through holes and a negative pressure may be developed behind the plate to reduce droplet size. More generally, negative and/or positive pressures may be used. If the cylinder is chambered, or has an independent structure therein that is chambered, a negative pressure can be developed in a first chamber that serves to reduce droplet size. The air flow that is used to develop the negative air pressure may be at a positive pressure in a second chamber, and such positive pressure may be used to release drops for application to or cleaning of the cylinder. Pressures can be adjusted as necessary or desirable to optimize the interaction (i.e., application and/or release) of the gating agent with the receiver surface and/or the interaction of the gating agent with the paper.

Yet another modification involves the use of a phase change material to build up a printing surface. One example involves the use of one or more curable and removable materials as the gating agent. For example, a UV curable gating agent in liquid form may be deposited on a plate and is thereafter subjected to UV light. The gating agent hardens, and ink is thereafter non-selectively applied to the plate. The ink is either attracted to or repelled by the hardened gating agent, and the resulting image is applied to substrate, such as a paper web. The gating agent and ink (if any) are then removed from the plate in preparation for subsequent imaging. This removal may be effected by washing any remaining ink from the plate, reversing the phase of the gating agent to a liquid, and/or removing the agent and any ink by washing, or the like.

If desired, gating agent may be applied indiscriminately over an entire imaging surface wherein the gating agent is responsive to the application of energy thereto to either activate or deactivate the gating agent. For example, the distributed gating agent may be selectively exposed to a source of UV, IR, or other non-visible wavelength energy or light emanated by a laser to create ink receptive or ink repellant areas in those portions of the surface exposed to such energy. Ink may then be indiscriminately applied to the surface and the ink may migrate to the exposed or non-exposed portions. The surface may then be used to image a further substrate, as in previous embodiments.

One could optimize the inter-imaging cleaning process by using a paper or other substrate type that minimizes residue on the imaging surface once the image has been printed or otherwise transferred. A still further embodiment comprehends the use of two or more imaging elements in the form of cylinders, plates, blankets, etc., for each ink to be applied to a further substrate wherein one or more, but fewer than all, of the imaging cylinders, plates, blankets, etc. are in use at any particular time of a production sequence and the remaining imaging elements are being cleaned. At a later point in the production sequence a different subset of the imaging elements may be in use while remaining imaging elements are being cleaned. This arrangement may permit higher press speeds to be employed.

In another embodiment, an aqueous jet system may print or jet an aqueous solution or other composition that has a multifunctional potential onto a pattern substrate. In one embodiment, for example, the composition may have a bifunctional potential, though any number of functionalities are contemplated herein. For example, the multifunctional composition may include one or more compounds each having a multifunctional potential or a plurality of compounds each having monofunctional potentials. A functional potential may include, for example, a function portion of a compound that may be attributable to a specific chemical moiety and/or structural region of the compound that confers attachment and/or repellant properties to the compound, such as, for example, a hydrophilic region, a lipophilic region, a receptor/recognition region (for example, a paratope), an ionic region, and others known in the art. In the present embodiment, one functionality confers attachment capabilities to the pattern substrate, and a second confers attachment properties to one or more principal substances that may be applied thereto.

In another embodiment, a multifunctional composition may include more than one multifunctional compound where each species of multifunctional compound has at least one functionality in common with the other multifunctional compounds and at least one functionality that differs from the other multifunctional compounds. In this example, a first multifunctional compound and a second multifunctional compound may each be printed onto a similar pattern substrate though the second functionalities of the first multifunctional compound and the second multifunctional compounds may have different specificities for a principal substance that can be attached to either the first or the second multifunctional compound, assuming the principal substance only reacts with one type of functionality. In another embodiment, compounds having monofunctional potentials may interact to form complexes having multifunctionality similar to that of single multifunctional compounds. In this embodiment, the monofunctional compounds may be included in a single composition that is deposited on the pattern substrate at one time, included in separate compositions deposited simultaneously, or may be contained in separate compositions that are deposited on the pattern substrate sequentially.

One example of a multifunctional compound contemplated herein includes a compound having one functionality that may be hydrophilic and a second functionality that may be lipophilic. The multifunctional composition may be jetted using in a desired pattern onto a substrate having either hydrophilic or a lipophilic surface, whereby like functionalities amongst the surface and the composition would associate to attach the composition to the surface and the opposite functionality of the composition would be repelled from the surface to render a pattern of the composition attached thereon.

A second composition, for example, the principal substance, having a like functionality (for example, hydrophilic or lipophilic) or otherwise attracted selectively to the second functionality of the multifunctional composition, which is not attached to the surface, and that is repulsed from or otherwise not attachable to the exposed surface of the substrate may be added to the surface by jetting, dipping, spraying, brushing, rolling, or any other manner known to a skilled artisan. Addition of the principal substance may render a pattern of the principal substance corresponding to that of the multifunctional composition, such that the principal substance is only attached to the surface via the second functionality of the multifunctional composition. It is further contemplated that after the application of the principal substance, one or more additional steps may be performed, including, for example a cleaning step, to ensure regiospecific attachment of the principal substance only to the second functionality of the multifunctional composition. Another contemplated step similar to the cleaning step includes a sterilization step. The principal substance may then be transferred to a second substrate, including, for example, an intermediate roller from which an image will be transferred to the print medium, or directly to the print medium to render the desired print image in a highly accurate and clean manner. In this way, selected patterns may be jetted onto a substrate using a multifunctional composition to which a principal substance is subsequently attached that then may be transferred to and immobilized permanently or transiently on a print medium.

Examples of multifunctional compounds contemplated herein include polymers, having at least one hydrophilic portion and at least one lipophilic portion, such as a poloxamer or acetylenediol ethoxylated. The poloxamer suitable for use can be represented by the formula $HO(CH_2CH_2O)_x(CH_2CHCH_3O)_y(CH_2CH_2O)_zH$ wherein x, y and z represent integers from the range from 2 to 130, especially from 15 to 100, and x and z are identical but chosen independently of y. Among these, there can be used poloxamer 188, wherein x=75, y=30 and z=75, which is obtainable under the trade name Lutrol® F 68 (alternatively Pluronic® F-68) from BASF, poloxamer 185 wherein x=19, y=30 and z=19 (Lubrajel® WA from ISP), poloxamer 235 wherein x=27, y=39 and z=27 (Pluronic® F-85 from BASF) and/or poloxamer 238 wherein x=97, y=39 and z=97 (Pluronic® F-88 from BASF). Another particular surfactant of this type is the block copolymer poly(ethyleneoxide)-poly(propyleneoxide)-poly(ethyleneoxide) known as Pluronic® F-123 from BASF. In addition, a triblock copolymer known commercially as Pluronic® F-127 (poloxamer 407) from BASF for which x=106, y=70, and z=106 may be used. Additionally, poloxamer 101, 108, 124, 181, 182, 184, 217, 231, 234, 237, 282, 288, 331, 333, 334, 335, 338, 401, 402, and 403, respectively can be included in the gating agent, to name a few. The acetylenediol ethoxylated suitable for use include 3,5-dimethyl-1-hexyn-3-ol (Air Products' Surfynol® 61), and/or 2,4,7,9-tetra-methyl-5-decyne-4,7-diol (Air Products' Surfynol® 104), among others. Other surfactants suitable for use include hexadecyl trimethylammonium bromide (CTAB), polyoxyalkylene ether, poly(oxyethylene)cetyl ether (e.g., Brij® 56 or Brij® 58 from Atlas Chemicals).

Additional examples include materials associated with the formation of self-assembled monolayers, such as alkylsiloxanes, fatty acids on oxidic materials, alkanethiolates, alkyl carboxylates, and the like. Other multifunctional compounds known to one skilled in the art are contemplated in the present disclosure. Further, multifunctional solutions contemplated herein may include, in addition to the one or more multifunctional compounds, for example, water, a water-soluble organic, or a combination thereof. Suitable water-soluble organic components include: alcohols, such as methyl alcohol, ethyl alcohol, n-propyl alcohol, isopropyl alcohol, n-butyl alcohol, sec-butyl alcohol, or tert-butyl alcohol; amides, such as dimethylformamide or dimethylacetamide; carboxylic acids; esters, such as ethyl acetate, ethyl lactate, and ethylene carbonate; ethers, such as tetrahydrofuran or dioxane; glycerin; glycols; glycol esters; glycol ethers; ketones, such as acetone, diacetone, or methyl ethyl ketone; lactams, such as N-isopropyl caprolactam or N-ethyl valerolactam; lactones, such as butyrolactone; organosulfides; sulfones, such as dimethylsulfone; organosulfoxides, such as dimethyl sulfoxide or tetramethylene sulfoxide; and derivatives thereof and mixtures thereof. Additional contemplated components in the multifunctional solutions include a solvent, a preservative, a viscosity modifier, a colorant, a scent, a surfactant, a polymer, a foaming agent, a salt, an inorganic compound, an organic compound, water, a pH modifier, and any combination thereof. Examples of principal substances include, for example, lithographic inks, dyes, proteins (for example, antibodies, enzymes, prions, nucleic acids (for example, DNA and/or RNA oligonucleotides), small molecules (for example, inorganic and/or organic molecules), biological samples (for example, cell and/or viral lysates and fractions thereof), pharmaceuticals (including antibiotics and/or other drugs, and salts, precursors, and prodrugs thereof), cells (for example, prokaryotic, eubacterial, and/or eukaryotic cells), and metals (for example, silicon oxides, conductive metals and oxides thereof). Print media contemplated include paper, glass, nitrocellulose, textiles, woven materials, metal, plastic, films, gels, and combinations thereof.

Figure 21:
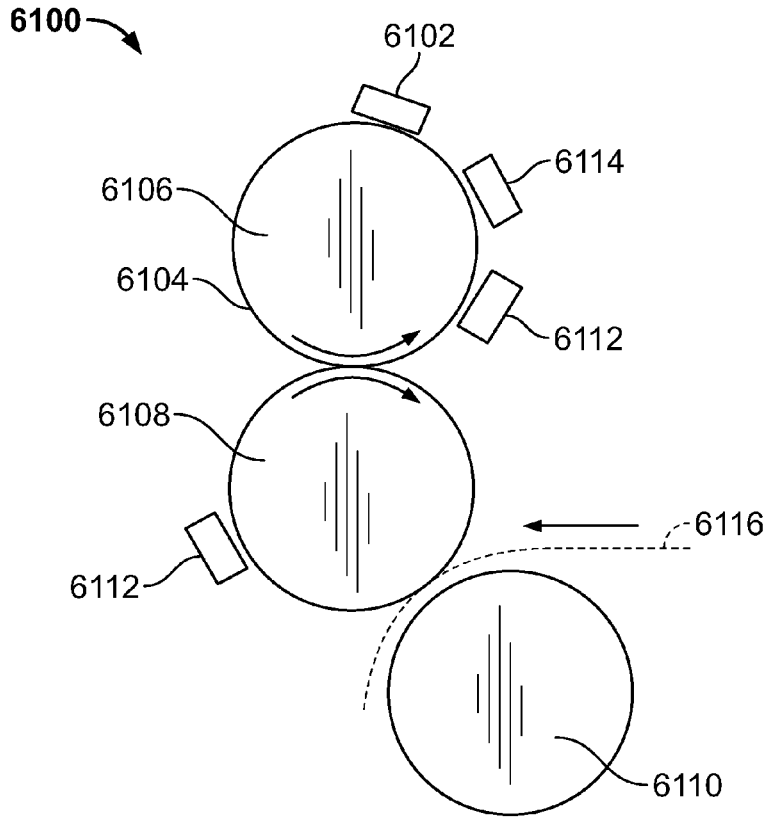

Illustratively, one example of an apparatus that may be employed to implement the current embodiment is illustrated in FIG. 21. A printing deck 6100, may include a principal substance application system 6102, a pattern surface 6104, a pattern surface cylinder 6106, a blanket cylinder 6108, and an impression cylinder 6110 as known in the lithographic printing industry. The pattern surface 6104 may be entirely hydrophilic (for example, a standard aluminum lithographic plate). Further, a cleaning system 6112 for removal of excess and/or old multifunctional composition and principal substance or other contaminants is included (shown here on both the pattern surface cylinder and the blanket cylinder, though more or fewer are contemplated). An aqueous jet system 6114 similar to those described herein for application of the multifunctional composition is depicted in relation to the pattern surface cylinder, though its placement is variable.

Operation of the printing deck 6100 is similar to other embodiments described herein. For example, a multifunctional composition is applied by the aqueous jet system 6114 onto the pattern surface 6104 of the pattern surface cylinder 6106. A principal substance is applied subsequently to the pattern surface 6104 via the application system 6102. As the pattern surface 6104 meets the surface of the blanket cylinder 6108, the principal substance is transferred thereto to be further carried thereon until deposited onto a substrate 6116. It is further contemplated that the apparatus may exclude blanket cylinder 6108 and thus the principal substance would be directly transferred from the pattern surface 6104 to the substrate 6116. Alternatively, additional rollers as desired may be added that may include, for example, additional aqueous jet systems 6114, application systems 6102, and cleaning system 6112.

Additional variations associated with other embodiments disclosed herein are equally applicable in the current embodiment as appropriate for the desired outcome. Additional apparatus configurations (not shown) are contemplated herein that enable high speed, highly accurate, selective deposition of one or more principal substances using combined multifunctional compositions and ink jet technologies. In this way, products including, for example, diagnostic tests, electric chips, oligonucleotide arrays, protein arrays, cell arrays, chemical arrays, drug arrays, detection systems, printed materials (for example, literature), and the like, and any combination thereof may be produced.

The jet system 6114 of FIG. 21 or any of the jet systems as disclosed herein may be used to emit a gating agent or a principal substance. The gating agent and principal substance can include aqueous or non-aqueous solutions. The aqueous solution may include water, a water-soluble organic, or a combination thereof. Suitable water-soluble organic components include: alcohols, such as methyl alcohol, ethyl alcohol, n-propyl alcohol, isopropyl alcohol, n-butyl alcohol, sec-butyl alcohol, or tert-butyl alcohol; amides, such as dimethylformamide or dimethylacetamide; carboxylic acids; esters, such as ethyl acetate, ethyl lactate, and ethylene carbonate; ethers, such as tetrahydrofuran or dioxane; glycerin; glycols; glycol esters; glycol ethers; ketones, such as acetone, diacetone, or methyl ethyl ketone; lactams, such as N-isopropyl caprolactam or N-ethyl valerolactam; lactones, such as butyrolactone; organosulfides; sulfones, such as dimethylsulfone; organosulfoxides, such as dimethyl sulfoxide or tetramethylene sulfoxide; and derivatives thereof and mixtures thereof. In other embodiments as disclosed herein, the gating agent or the transferring substance may contain one or more surfactants, such as poloxamer or acetylenediol ethoxylated. The poloxamer suitable for use can be represented by the formula $HO(CH_2CH_2O)_x(CH_2CHCH_3O)_y(CH_2CH_2O)_zH$ wherein x, y and z represent integers from the range from 2 to 130, especially from 15 to 100, and x and z are identical but chosen independently of y. Among these, there can be used poloxamer 188 wherein x=75, y=30 and z=75, which is obtainable under the trade name Lutrol® F 68 (alternatively Pluoronic® F 68) from BASF, poloxamer 185 wherein x=19, y=30 and z=19 (Lubrajel® WA from ISP), poloxamer 235 wherein x=27, y=39 and z=27 (Pluoronic® F 85 from BASF) and/or poloxamer 238 wherein x=97, y=39 and z=97 (Pluoronic® F 88 from BASF). Another particular surfactant of this type is the block copolymer poly(ethyleneoxide)-poly(propyleneoxide)-poly(ethyleneoxide) known as Pluoronic® 123 from BASF. In addition, a triblock copolymer known commercially as Pluoronic® 127, poloxamer 407, from BASF for which x=106, y=70, and z=106 may be used. Additionally, poloxamer 101, 108, 124, 181, 182, 184, 217, 231, 234, 237, 282, 288, 331, 333, 334, 335, 338, 401, 402, and 403, respectively can be included in the gating agent, to name a few. The acetylenediol ethoxylated suitable for use include 3,5-dimethyl-1-hexyn-3-ol (Air Products' Surfynol® 61), and/or 2,4,7,9-tetra-methyl-5-decyne-4,7-dial (Air Products' Surfynol® 104), among others. Other surfactants suitable for use include hexadecyl trimethylammonium bromide (CTAB), polyoxyalkylene ether, poly(oxyethylene)cetyl ether (e.g., Brij® 56 or Brij® 58 from Atlas Chemicals). Such surfactants may contain a hydrophilic group at one end of each molecule and a lipophilic group at the other end of each molecule. Adding one or more surfactants to the gating agent or the principal substance may improve the surface tension properties of the respective solutions. This may provide more control over drop placement and produce higher quality printed images.

Figure 22:
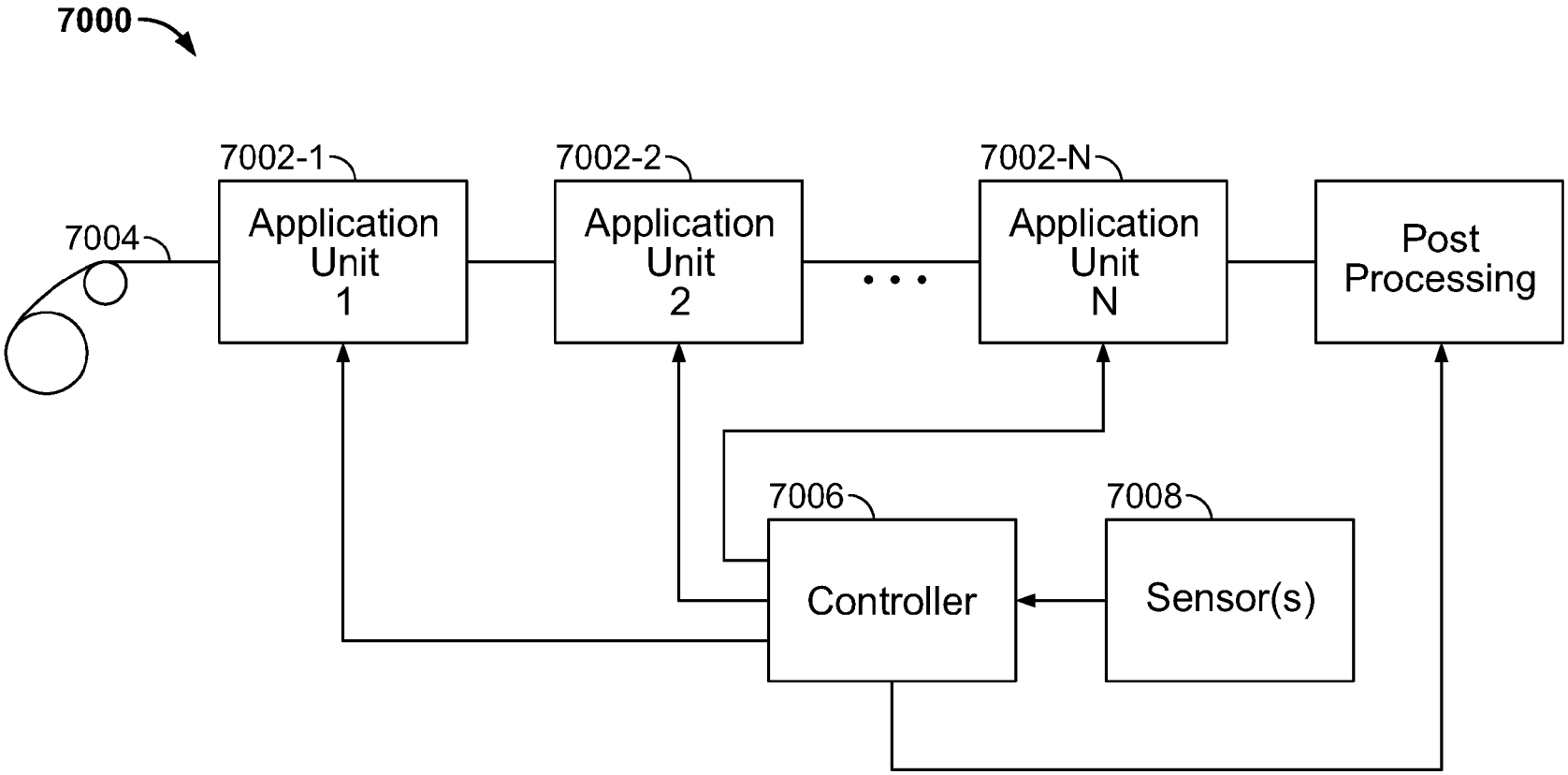
FIG. 22 is a block diagram of a control system for implementing any of the methods described herein.

An application system 7000 that may be used to implement any of the methods disclosed herein is generally shown in FIG. 22. A series of application units 7002-1 through 7002-N receive a web of material 7004, and successively apply inks and/or other materials thereto. It should be noted that there may be a single application unit 7002 or more than one application unit 7002 in the system 7000 and/or the material 7004 may comprise a web or a series of sheets or other discrete elements. The application unit(s) are operated by a controller 7006, which may be responsive to the output(s) of one or more sensor(s) 7008. These sensor(s) may detect any one or more of a number of parameters, such as the registration mark(s) noted above, the placement and/or quality of the substance applied by each application unit 7002, etc. The controller 7006 may also control post processing equipment, such as a stitcher and sheeter in the case of printing equipment, or, in more generalized systems, a packaging apparatus, quality control apparatus, and the like. The controller 7006 may be implemented by hardware, software, or a combination of the two.

A further aspect of the embodiments disclosed herein is that localized color correction can be undertaken at any portion(s) of an image. The resolution of such color correction is not limited to the location of the print area that could be impacted by individual ink keys on a traditional offset press; rather, the color correction can be undertaken at the resolution at which the gating agent is applied to the receiver surface. Further, color correction can be applied to a portion of the image or the entire image. Still further, it may be desirable to modify the gating agent applied by one applicator before application of a further substance by a further applicator. For example, in a multi-color printing process, a first gating agent that blocks or aids transfer of a first ink to a paper web and which is applied by a first printing deck may be deactivated before the paper web reaches a second printing unit where a second gating agent (which may be same as or different than the first gating agent) and second ink may be applied to the web. This deactivation may be undertaken by any suitable means, such as the selective application of a deactivating chemical using ink jet heads after the first ink has been transferred to the web. Alternatively, the gating agent(s) may be modified in another fashion using any other apparatus so that a beneficial characteristic of the gating agent(s) remains on the further substrate.

In yet another alternative embodiment, the gating agent may control absorption of a substance into a substrate. For example, a gating agent may limit or otherwise optimize absorption of a gravure ink into a paper web to improve color reproduction. The gating agent may be applied to the paper web, as in the preceding embodiments, by any suitable means, such as one or more ink jet heads.

If desired, one may adapt the methods disclosed herein to permit build up of multiple successive layers of principal substance and gating agent on a receiver surface and application of such multiple layers to a further surface. Also, if the gating agent(s) that are applied to the substrate are colored (i.e., not completely colorless) one might take this fact into account when selecting ink type and/or amounts (i.e., the ink film thickness and/or ink amounts for the image as defined by the controller (i.e., RIP(s))) to use in a color reproduction process. Still further, gating agent may interact with applied principal substance to create a desired effect. For example, in a color printing process, the gating agent may combine with applied ink to modify ink color, as desired. Instead or in addition, gating agent applied to a substrate may react with other applied substance(s) to permit counterfeit detection, integrity checking, sequence checking, etc. In this case the gating agent may be applied before, after, and/or contemporaneously with the other applied substance(s).

Also if desired, more than one imaging element such as a plate, blanket, cylinder, etc. may be used to transfer an image and gating agent to a further surface, which, in turn, transfers the image and gating agent to a further substrate, such as a paper web. Still further, gating agent may be selectively applied alone or in combination with one or more other materials to an imaging element, which, in turn applies the gating agent and other material(s) to a further imaging element that receives the principal substance. The principal substance, gating agent, and other material(s) may be transferred to the substrate by the further imaging element or another imaging element disposed between the further imaging element and the substrate. For example, a silver conductive trace may be laid down first on a cylinder, followed a resistive material followed by a semiconductive material and the combination may then be applied directly or indirectly via another imaging element to a further substrate, such as a mylar film, a paper web, a circuit board, or the like.

In a specific application, the high speed variable printing systems and methods disclosed herein may be used in a number of lithographic applications. For example, the disclosed systems and methods may be ideal for high-quality one-to-one marketing applications, such as direct mailing, advertisements, statements, and bills. Other applications are also well-suited to the systems and methods disclosed herein, including the production of personalized books, periodicals, publications, posters, and displays. The high speed variable printing systems and methods disclosed herein may also facilitate post-processing (e.g., binding and finishing) of any of the aforementioned products.

It will be understood that the foregoing is only illustrative of the principles of the systems and methods disclosed herein, and that various modifications can be made by those skilled in the art without departing from the scope and spirit of such systems and methods. For example, the order of some steps in the procedures that have been described are not critical and can be changed if desired. Also, various steps may be performed by various techniques.

INDUSTRIAL APPLICABILITY

The present disclosure is applicable in the printing arts, but also may be useful in other industries. More specifically, a gating agent is applied to a substrate to aid in determining the application of a principle substance in image or non-image areas.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A printing system, comprising:

first means for depositing a principal substance on a surface;

second means for depositing one of a liquid and gel gating agent in a first region, which defines a non-image area, of a print medium;

third means for transferring a portion of the principal substance from the surface to the print medium after the one of a liquid and gel gating agent is applied to the print medium, and a controller coupled to the second means and operable to cause the second means to deposit the one of a liquid and gel gating agent directly onto the print medium in the first region;

wherein the principal substance is deposited in a second region of the print medium that is receptive to both principal substance and the one of a liquid and gel gating agent, wherein the one of a liquid and gel gating agent substantially blocks transfer of the principal substance to the first region, and the print medium with the principal substance transferred thereto is an end product of the printing system.

2. The printing system of claim 1, wherein the surface rotates.

3. The printing system of claim 1, wherein the surface is cylindrical.

4. The printing system of claim 1, wherein the third means includes a transfer member and wherein the portion of the principal substance is transferred from the surface to the print medium by the transfer member.

5. The printing system of claim 1, wherein the one of a liquid and gel gating agent comprises an aqueous substance.

6. The printing system of claim 1, wherein the one of a liquid and gel gating agent defines image and non-image areas and wherein the principal substance is brought into contact with the image and non-image areas.

7. The printing system of claim 1, wherein the third means comprises a transfer member intermediate the surface and the print medium, and further comprising means for cleaning at least one of the surface, the transfer member, or a combination thereof.

8. The printing system of claim 7, wherein the means for cleaning comprises means for removing principal substance.

9. The printing system of claim 7, wherein the means for cleaning comprises means for removing the one of a liquid and gel gating agent.

10. The printing system of claim 1, wherein a coating is deposited on the print medium before the one of a liquid and gel gating agent is deposited thereon, and wherein the coating controls absorption of the one of a liquid and gel gating agent by the print medium.

11. The printing system of claim 1, wherein the first region of the print medium comprises non-image areas and remaining portions of the print medium other than the first region comprise image areas.

12. The printing system of claim 11, wherein the second means comprises a plurality of ink jet heads.

13. The printing system of claim 12, wherein the surface comprises an outer surface of a plate cylinder.

14. The printing system of claim 13, wherein the third means includes a blanket cylinder disposed between the plate cylinder and the print medium wherein the blanket cylinder transfers the principal substance to the print medium.

15. The printing system of claim 1, wherein the principal substance comprises at least one of an ink, a drug, a therapeutic substance, a diagnostic substance, a marking substance other than an ink, a biological material, a biocompatible polymer, an electrically conductive, semiconductive, or insulative substance, a thermally conductive or insulative substance, a functional polymer, an adhesive, a substance comprising 3-D interconnect structures, an optical adhesive, a UV-curing polymer, a light-emitting diode material, and a magnetic material.

16. The printing system of claim 1, wherein the second means comprises multiple ink jet heads that are operated by a controller out of phase with one another.

17. The printing system of claim 1, wherein the second means comprises an ink jet head having multiple channels wherein a controller operates the ink jet head to supply the one of a liquid and gel gating agent via each channel either simultaneously or at a plurality of different times during a production sequence.

18. The printing system of claim 1, wherein the printing system is operable during a plurality of imaging cycles and further including means for selectively cleaning portions of the surface where image changes occur between imaging cycles.

19. The printing system of claim 1, wherein the second means comprises multiple ink jet heads that produce different drop sizes.

20. The printing system of claim 1, wherein the second means comprises multiple ink jet heads produced by different manufacturers.

21. A production system, comprising:

an application apparatus adapted to apply a principal substance to a blanket cylinder;

a plurality of ink jet heads;

a controller coupled to the ink jet heads and operable to cause the ink jet heads to deposit one of a liquid and gel gating agent directly onto an input product in a first region thereof which defines a non-image area; and an impression cylinder adjacent the blanket cylinder and forming a nip therewith;

wherein the nip is adapted to receive the input product onto which the one of a liquid and gel gating agent has been deposited by the ink jet heads in the first region so that principal substance is transferred to the input product from the blanket cylinder in a second region of the input product that is receptive to both principal substance and the one of a liquid and gel gating agent, wherein the one of a liquid and gel gating agent substantially blocks transfer of the principal substance to the first region, and the input product with principal substance transferred thereto is an end product of the production system.

22. The production system of claim 21, further including a monitoring device that senses a process parameter and wherein the controller is responsive to the monitoring device to determine an amount of the one of a liquid and gel gating agent to deposit in accordance with the sensed process parameter.

23. The production system of claim 21, in combination with the input product.

24. The production system of claim 23, wherein the input product is a sheet of material.

25. The production system of claim 23, wherein the input product is a web of material.

26. The production system of claim 23, wherein the input product is paper.

27. The production system of claim 21, in combination with the principal substance.

28. The production system of claim 27, wherein the principal substance is lithographic ink.

29. The production system of claim 21, in combination with the one of a liquid and gel gating agent.

30. The production system of claim 29, wherein the one of a liquid and gel gating agent comprises an aqueous solution.

31. The production system of claim 30, wherein the aqueous solution includes ethylene glycol or propylene glycol or a combination thereof and a surfactant.

32. The production system of claim 21, in combination with the principal substance comprising a lithographic ink, the input product comprising paper, and the one of a liquid and gel gating agent comprising an aqueous solution adapted to block transfer of the lithographic ink from the blanket cylinder to the paper.

33. The production system of claim 21, wherein the principal substance comprises at least one of an ink, a drug, a therapeutic substance, a diagnostic substance, a marking substance other than an ink, a biological material, a biocompatible polymer, an electrically conductive, semiconductive, or insulative substance, a thermally conductive or insulative substance, a functional polymer, an adhesive, a substance comprising 3-D interconnect structures, an optical adhesive, a UV-curing polymer, light-emitting diode material, and a magnetic material.

34. A production method, comprising:

providing an application apparatus adapted to apply a principal substance to a blanket cylinder, a plurality of ink jet heads, a controller coupled to the ink jet heads, and an impression cylinder adjacent the blanket cylinder and forming a nip therewith;

operating the controller to cause the ink jet heads to deposit one of a liquid and gel gating agent in a first region of an article; and directing the article onto which the one of a liquid and gel gating agent has been deposited into the nip so that the principal substance is transferred from the blanket cylinder to the article in a second region that is receptive to both the principal substance and the one of a liquid and gel gating agent, wherein the one of a liquid and gel gating agent substantially blocks transfer of the principal substance to the first region, and the article with the principal substance transferred thereto is an end product.

35. The method of claim 34, further including the step of varying a pressure between the impression cylinder and the blanket cylinder at the nip.

36. The method of claim 34, wherein the step of operating comprises the step of directing individually controllable drops of the one of a liquid and gel gating agent onto the article.

37. The method of claim 34, wherein the one of a liquid and gel gating agent on the article defines image and non-image areas of the article and wherein the step of directing comprises the step of contacting the image and non-image areas of the article with the principal substance on the blanket cylinder.

38. The method of claim 34, wherein the principal substance comprises a lithographic ink.

39. The method of claim 34, wherein the one of a liquid and gel gating agent comprises an aqueous solution.

40. The method of claim 39, wherein the aqueous solution includes ethylene glycol or propylene glycol or a combination thereof and a surfactant.

41. The method of claim 34, wherein the principal substance comprises a lithographic ink, the article comprises paper, and the one of a liquid and gel gating agent comprises an aqueous solution that blocks transfer of the lithographic ink from the blanket cylinder to the paper.

42. The method of claim 41, wherein the operating step comprises the step of directing individually controllable drops of the one of a liquid and gel gating agent onto the article.

43. The method of claim 42, wherein the one of a liquid and gel gating agent on the article defines image and non-image areas of the article and wherein the step of directing comprises the step of contacting the image and non-image areas of the article with the principal substance on the blanket cylinder.

44. The method of claim 34, wherein the principal substance comprises at least one of an ink, a drug, a therapeutic substance, a diagnostic substance, a marking substance other than an ink, a biological material, a biocompatible polymer, an electrically conductive, semiconductive, or insulative substance, a thermally conductive or insulative substance, a functional polymer, an adhesive, a substance comprising 3-D interconnect structures, an optical adhesive, a UV-curing polymer, light-emitting diode material, and a magnetic material.

45. The method of claim 34, wherein the article comprises paper.

46. The method of claim 45, wherein the paper is in the form of a web.

47. The method of claim 45, wherein the paper is in the form of a sheet.

48. A production apparatus, comprising:

an application apparatus adapted to apply a principal substance to a blanket cylinder;

a plurality of ink jet heads;

an impression cylinder adjacent the blanket cylinder and forming a nip therewith;

a controller operable to cause the ink jet heads to deposit one of a liquid and gel gating agent directly onto an article in a first region thereof which defines a non-image area; and means for directing the article with the one of a liquid and gel gating agent thereon into the nip so that the principal substance is transferred to the article from the blanket cylinder in a second region of the article that is receptive to both the principal substance and the one of a liquid and gel gating agent, wherein the one of a liquid and gel gating agent substantially blocks transfer of the principal substance to the first region.

49. The production apparatus of claim 48, wherein the controller causes the ink jet heads to deposit individually controllable drops of the one of a liquid and gel gating agent onto the article.

50. The production apparatus of claim 48, wherein the one of a liquid and gel gating agent on the article defines image and non-image areas of the article.

51. The production apparatus of claim 48, wherein the principal substance comprises a lithographic ink.

52. The production apparatus of claim 48, wherein the one of a liquid and gel gating agent comprises an aqueous solution.

53. The production apparatus of claim 52, wherein the aqueous solution includes ethylene glycol or propylene glycol or a combination thereof and a surfactant.

54. The production apparatus of claim 48, wherein the principal substance comprises a lithographic ink, the article comprises paper, and the one of a liquid and gel gating agent comprises an aqueous solution that is adapted to block transfer of the lithographic ink from the blanket cylinder to the paper.

55. The production apparatus of claim 54, wherein the controller causes the ink jet heads to deposit individually controllable drops of the one of a liquid and gel gating agent onto the article.

56. The production apparatus of claim 55, wherein the one of a liquid and gel gating agent on the article defines image and non-image areas of the article, and wherein the directing means causes the image and non-image areas of the article to contact the principal substance on the blanket cylinder.

57. The production apparatus of claim 48, wherein the principal substance comprises at least one of an ink, a drug, a therapeutic substance, a diagnostic substance, a marking substance other than an ink, a biological material, a biocompatible polymer, an electrically conductive, semiconductive, or insulative substance, a thermally conductive or insulative substance, a functional polymer, an adhesive, a substance comprising 3-D interconnect structures, an optical adhesive, a UV-curing polymer, light-emitting diode material, and a magnetic material.

58. The production apparatus of claim 48, wherein the article comprises paper.

59. The production apparatus of claim 58, wherein the paper is in the form of a web.

60. The production apparatus of claim 58, wherein the paper is in the form of a sheet.

* * * * *